US005835874A

United States Patent [19]

Hirata et al.

[11] Patent Number: 5,835,874

[45] Date of Patent: Nov. 10, 1998

[54] REGION LIMITING EXCAVATION CONTROL SYSTEM FOR CONSTRUCTION MACHINE

[75] Inventors: Toichi Hirata, Ushiku; Eiji Yamagata, Niihari-gun; Hiroshi Watanabe, Ushiku; Masakazu Haga; Kazuo Fujishima, both of Niihari-gun; Hiroyuki Adachi, Tsuchiura, all of Japan

[73] Assignee: Hitachi Construction Machinery Co., Ltd., Tokyo, Japan

[21] Appl. No.: 553,702

[22] PCT Filed: Apr. 27, 1995

[86] PCT No.: PCT/JP95/00843

§ 371 Date: Dec. 5, 1995

§ 102(e) Date: Dec. 5, 1995

[87] PCT Pub. No.: WO95/30059

PCT Pub. Date: Nov. 9, 1995

[30] Foreign Application Priority Data

Apr. 28, 1994 [JP] Japan ..... 6-092367
Apr. 28, 1994 [JP] Japan ..... 6-092368

[51] Int. Cl.[6] ..... E02F 3/43; E02F 9/22

[52] U.S. Cl. ..... 701/50; 364/424.07; 364/559; 364/565; 60/426; 60/452; 414/4; 414/699

[58] Field of Search ..... 364/424.07, 472.07, 364/559, 565; 60/452, 426, 428, 431; 414/699, 701, 723, 4

[56] References Cited

U.S. PATENT DOCUMENTS

| | | | |
|---|---|---|---|
| 4,516,117 | 5/1985 | Couture | 340/685 |
| 4,866,641 | 9/1989 | Nielsen et al. | 364/559 |
| 4,910,673 | 3/1990 | Narisawa et al. | 364/424.07 |
| 4,942,737 | 7/1990 | Tatsumi | 60/431 |
| 5,088,020 | 2/1992 | Nishida et al. | 364/160 |
| 5,245,828 | 9/1993 | Nakamura | 60/452 |
| 5,312,217 | 5/1994 | Lawrence et al. | 414/4 |
| 5,446,981 | 9/1995 | Kamada et al. | 364/424.07 |
| 5,490,081 | 2/1996 | Kuromoto et al. | 364/474.2 |

FOREIGN PATENT DOCUMENTS

| | | |
|---|---|---|
| 0 293 057 | 5/1988 | European Pat. Off. . |
| 60-65834 | 4/1985 | Japan . |
| 62-72826 | 4/1987 | Japan . |
| 62-160325 | 7/1987 | Japan . |
| 63-55222 | 3/1988 | Japan . |
| 63-219731 | 9/1988 | Japan . |
| 1-271535 | 10/1989 | Japan . |
| 1-278623 | 11/1989 | Japan . |
| 2-140333 | 5/1990 | Japan . |
| 4-1333 | 1/1992 | Japan . |
| 4-35310 | 2/1992 | Japan . |
| 4-136324 | 5/1992 | Japan . |

*Primary Examiner*—Tan Q. Nguyen
*Attorney, Agent, or Firm*—Fay, Sharpe, Beall, Fagan, Minnich & McKee

[57] ABSTRACT

In a region limiting excavation control system for a construction machine, a region where a front attachment (1A) is movable is set beforehand. A control unit (9) calculates the position and posture of the front attachment based on signals from angle sensors (8*a*–8*c*), calculates a target speed vector (Vc) of the front attachment based on signals from control lever units (4*a*, 4*b*), and modifies the target speed vector such that the target speed vector is maintained as it is when the front attachment is within the set region but not near the boundary thereof. A vector component (Vcy) of the target speed vector in the direction toward the boundary of the set region is reduced when the front attachment is within the set region near the boundary thereof, and the front attachment is returned to the set region and when the front attachment is outside the set region. As a result, the excavation within a limited region can be implemented efficiently and smoothly.

34 Claims, 40 Drawing Sheets

REGION LIMITING EXCAVATION CONTROL SYSTEM FOR CONSTRUCTION MACHINE

TECHNICAL FIELD

The present invention relates to a region limiting excavation control system for a construction machine, and more particularly to a region limiting excavation control system which is mounted on a construction machine such as a hydraulic excavator having a multi-articulated front attachment and which can perform excavation while limiting the region where the front attachment is movable.

BACKGROUND ART

A hydraulic excavator is a typical known construction machine. A hydraulic excavator includes front attachment comprising a boom, an arm and a bucket which are each rotatable in the vertical direction, and a body comprising an upper structure and an undercarriage, the boom of the front attachment having its base end supported to a front portion of the upper structure. In such a hydraulic excavator, the front members such as the boom are operated by respective manual control levers. However, because the front members are coupled to each other in an articulated manner for pivotal motion, it is very difficult to carry out excavation work over a predetermined region by controlling the front members. In view of the above, a region limiting excavation control system is proposed in JP, A, 4-136324 for facilitating the excavation work. The proposed region limiting excavation control system comprises means for detecting a posture of a front attachment, means for calculating a position of the front attachment based on a signal from the detecting means, means for teaching an entrance forbidden region where the front attachment is inhibited from entering, lever gain calculating means for determining the distance d between the position of the front attachment and a boundary line of the taught entrance forbidden region, and outputting the product of a lever control signal multiplied by a function depending on the distance d that takes a value 1 when the distance d is greater than a certain value, and a value between 0 and 1 when it is smaller than the certain value, and actuator control means for controlling motion of an actuator in accordance with a signal from the lever gain calculating means. With the construction of the proposed system, since the lever control signal is restricted depending on the distance to the boundary line of the entrance forbidden region, even when the operator attempts to move the end of the bucket into the entrance forbidden region by mistake, the bucket end is smoothly stopped at the boundary line automatically, or on the way of movement of the bucket end to the boundary line, the operator can notice the movement approaching the entrance forbidden region, judging from a reduction in the speed of the front attachment, and return the bucket end.

Further, JP, A, 63-219731 discloses a hydraulic excavator wherein a work limit position beyond which the work carried out by a front attachment may encounter any trouble is set, and an arm is controlled to return its end into a work permitted region if the arm end goes out of the work limit position.

DISCLOSURE OF THE INVENTION

However, the above-mentioned prior arts have problems as follows.

With the prior art disclosed in JP, A, 4-136324, since the lever gain calculating means outputs, to the actuator control means, the product of the lever control signal multiplied by the function depending on the distance d, the bucket end is gradually slowed down as it approaches the boundary of the entrance forbidden region, and is finally stopped at the boundary of the entrance forbidden region. Therefore, a shock that would otherwise be generated when the operator attempts to move the bucket end into the entrance forbidden region can be avoided. But, this prior art is arranged to reduce the speed of the bucket end such that the speed is always reduced regardless of the direction in which the bucket end is moving. Accordingly, when excavation is performed along the boundary of the entrance forbidden region, the digging speed in the direction along the boundary of the entrance forbidden region is also reduced as the bucket end approaches the entrance forbidden region with operation of the arm. This requires the operator to manipulate a boom lever to move the bucket end away from the entrance forbidden region each time the digging speed is reduced, in order to prevent a drop of the digging speed. As a result, the working efficiency is extremely deteriorated when excavation is performed along the entrance forbidden region. Alternatively, to increase the working efficiency, the excavation must be performed at a distance away from the entrance forbidden region, making it impossible to excavate the predetermined region.

With the prior art disclosed in JP, A, 63-219731, if the operating speed is high at the time the arm end moves beyond the work limit position, the amount by which the arm end moves beyond the work limit position is increased and the arm end is abruptly moved back to the work limit position, thereby causing a shock. As a result, the work cannot smoothly be performed.

A first object of the present invention is to provide a region limiting excavation control system for a construction machine by which excavation can efficiently be performed within a limited region.

A second object of the present invention is to provide a region limiting excavation control system for a construction machine by which excavation can smoothly be performed within a limited region.

A third object of the present invention is to provide a region limiting excavation control system for a construction machine by which the function of efficiently performing excavation within a limited region can be added to the system including manipulation means of hydraulic pilot type.

A fourth object of the present invention is to provide a region limiting excavation control system for a construction machine by which, when excavation is performed within a limited region, the bucket end can slowly be moved when high finish accuracy is required, and it can quickly be moved when high finish accuracy is not required, but high working speed is required.

A fifth object of the present invention is to provide a region limiting excavation control system for a construction machine by which, when excavation is performed within a limited region, control accuracy in a working posture where a front attachment has a large reach can be improved.

To achieve the above first object, according to the present invention, there is provided a region limiting excavation control system for a construction machine comprising a plurality of driven members including a plurality of front members which make up a multi-articulated type front attachment and are vertically movable, a plurality of hydraulic actuators for respectively driving the plurality of driven members, a plurality of manipulation means for instructing operation of the plurality of driven members, and a plurality of hydraulic control valves driven in accordance with control signals from the plurality of manipulation means for controlling flow rates of a hydraulic fluid supplied to the plurality of hydraulic actuators, wherein the system further comprises region setting means for setting a region where the front attachment is movable; first detecting means for detecting status variables with regard to the position and posture of the front attachment; first calculating means for calculating the position and posture of the front attachment based on signals from the first detecting means; and first signal modifying means for, based on the control signals from those manipulation means of the plurality of manipulation means which are associated with particular front members and the values calculated by the first calculating means, modifying the control signals from those manipulation means for the front attachment so that, when the front attachment is within the set region near the boundary of the set region, the front attachment is moved in the direction along the boundary of the set region while a moving speed of the front attachment in the direction toward the boundary of the set region is reduced.

By so modifying the control signals from those manipulation means for the front attachment by the first signal modifying means, directional change control for slowing down the movement of the front attachment in the direction toward the boundary of the set region is performed, enabling the front attachment to move along the boundary of the set region. Therefore, the excavation within a limited region can efficiently be implemented.

To achieve the above second object, according to the present invention, there is provided a region limiting excavation control system for a construction machine further comprising second signal modifying means for, based on the control signals from those manipulation means of the plurality of manipulation means which are associated with particular front members and the values calculated by the first calculating means, modifying the control signals from those manipulation means for the front attachment so that, when the front attachment is outside the set region, the front attachment is returned to the set region.

When the front attachment approaches the boundary of the set region under the direction change control, if the movement of the front attachment is fast and goes out of the set region due to a delay in control response and the inertia of the front attachment, the second signal modifying means modifies the control signals from the manipulation means for the front attachment so that the front attachment is returned to the set region. Thus, the front attachment is controlled to quickly return to the set region after going out of the set region. As a result, even if the front attachment is moved fast, it can be moved along the boundary of the set region and the excavation within a limited region can precisely be implemented.

Also, on this occasion, since the movement of the front attachment is already slowed down through the direction change control as mentioned above, the amount by which the bucket end goes out of the set region is so reduced that the shock occurred upon returning to the set region is greatly alleviated. Therefore, even if the front attachment is moved fast, the excavation within a limited region can smoothly be implemented and the excavation within a limited region can be implemented with no troubles.

In the above region limiting excavation control system for a construction machine, preferably, the first signal modifying means comprises second calculating means for calculating a target speed vector of the front attachment based on the control signals from the manipulation means associated with the particular front members; third calculating means for receiving the values calculated by the first and second calculating means and modifying the target speed vector so that, when the front attachment is within the set region near the boundary of the set region, a vector component of the target speed vector in the direction along the boundary of the set region remains and a vector component of the target speed vector in the direction toward the boundary of the set region is reduced; and valve control means for driving the associated hydraulic control valves so that the front attachment is moved in accordance with the target speed vector.

As a result of that the third calculating means modifies the target speed vector such that the vector component of the target speed vector in the direction along the boundary of the set region remains and the vector component of the target speed vector in the direction toward the boundary of the set region is reduced, the first signal modifying means can modify the control signals from the manipulation means for the front attachment as mentioned above.

Preferably, the second signal modifying means comprises second calculating means for calculating a target speed vector of the front attachment based on the control signals from the manipulation means associated with the particular front members; and fourth calculating means for receiving the values calculated by the first and second calculating means and modifying the target speed vector so that, when the front attachment is outside the set region, the front attachment is returned to the set region.

As a result of that the fourth calculating means modifies the target speed vector so that the front attachment is returned to the set region, the second signal modifying means can modify the control signals from the manipulation means for the front attachment as mentioned above.

In the above region limiting excavation control system for a construction machine, preferably, the third calculating means maintains the target speed vector as it is when the front attachment is within the set region but not near the boundary of the set region. With this arrangement, when the front attachment is within the set region but not near the boundary of the set region, the work can be implemented in a normal manner.

Preferably, the third calculating means employs, as the vector component of the target speed vector in the direction toward the boundary of the set region, a vector component vertical to the boundary of the set region.

Preferably, the third calculating means reduces the vector component of the target speed vector in the direction toward the boundary of the set region such that an amount of reduction in the vector component is increased as a distance between the front attachment and the boundary of the set region decreases. In this case, preferably, the third calculating means reduces the vector component of the target speed vector in the direction toward the boundary of the set region by adding, to the vector component, a reversed speed vector which is increased as the distance between the front attachment and the boundary of the set region decreases. Also, preferably, the third calculating means sets the vector component of the target speed vector in the direction toward the boundary of the set region to 0 or a small value when the front attachment reaches the boundary of the set region. The third calculating means may reduce the vector component of the target speed vector in the direction toward the boundary of the set region by multiplying the vector component by a coefficient which is not larger than 1 and is gradually reduced as the distance between the front attachment and the boundary of the set region decreases.

In the above region limiting excavation control system for a construction machine, preferably, the fourth calculating means modifies the target speed vector so that the front attachment is returned to the boundary of the set region, by leaving the vector component of the target speed vector in the direction along the boundary of the set region remained, and changing the vector component of the target speed vector in the direction vertical to the boundary of the set region into a vector component of the target speed vector in the direction toward the boundary of the set region. With this arrangement, since the speed component in the direction along the boundary of the set region is not reduced when the front attachment is controlled so as to return to the set region, the front attachment can also be moved along the boundary of the set region even when it is outside the set region.

Preferably, the fourth calculating means gradually reduces the vector component in the direction toward the boundary of the set region as a distance between the front attachment and the boundary of the set region decreases. With this arrangement, the path along which the front attachment is returned to the set region is in the form of a curved line which is curved to come closer to a parallel line while approaching the boundary of the set region. This enables the front attachment to be returned to the set region in a smoother manner.

Preferably, the third calculating means maintains the target speed vector as it is when the front attachment is within the set region and the target speed vector is a speed vector in the direction away from the boundary of the set region, and modifies the target speed vector so that the vector component of the target speed vector in the direction toward the boundary of the set region is reduced depending on the amount the distance between the front attachment and the boundary of the set region decreases, when the front attachment is within the set region and the target speed vector is a speed vector in the direction toward the boundary of the set region.

To achieve the above third object, according to the present invention, there is provided a region limiting excavation control system for a construction machine wherein, of the plurality of manipulation means, at least the manipulation means associated with particular front members are of the hydraulic pilot type outputting pilot pressures as the control signals, and a manipulation system including the manipulation means of hydraulic pilot type drives the corresponding hydraulic control valves. The control system further comprises second detecting means for detecting input amounts from the manipulation means of hydraulic pilot type; the second calculating means being means for calculating the target speed vector of the front attachment based on signals from the second detecting means; and the valve control means including fifth calculating means for calculating target pilot pressures for driving the corresponding hydraulic control valves based on the modified target speed vector, and pilot control means for controlling the manipulation system so that the calculated target pilot pressures are established.

Since the modified target speed vector is converted into target pilot pressures and the manipulation system is controlled so as to establish the target pilot pressures, the above direction change control can be performed in a system including manipulation means of hydraulic pilot type. Therefore, the function of efficiently implementing the excavation within a limited region can be added to any system including the manipulation means of hydraulic pilot type.

When the hydraulic drive system includes a boom and an arm of a hydraulic excavator as the particular front members, even when just one control lever of the arm manipulation means is manipulated, the target pilot pressures corresponding to the modified target speed vector are calculated to control the manipulation means of hydraulic pilot type as mentioned above. Therefore, digging work along the boundary of the set region can be implemented by using just one arm control lever.

In the above region limiting excavation control system for a construction machine, preferably, the manipulation system includes a first pilot line for introducing a pilot pressure to the corresponding hydraulic control valve so that the front attachment is moved away from the set region, the fifth calculating means includes means for calculating the target pilot pressure in the first pilot line based on the modified target speed vector, and the pilot control means includes means for outputting a first electric signal corresponding to the target pilot pressure, electro-hydraulic converting means for converting the first electric signal into a hydraulic pressure and outputting a control pressure corresponding to the target pilot pressure, and higher pressure selecting means for selecting the higher one of the pilot pressure in the first pilot line and the control pressure output from the electro-hydraulic converting means, and introducing the selected pressure to the corresponding hydraulic control valve.

Preferably, the manipulation system includes second pilot lines for introducing pilot pressures to the corresponding hydraulic control valves so that the front attachment is moved toward the set region, the fifth calculating means includes means for calculating the target pilot pressures in the second pilot lines based on the modified target speed vector, and the pilot control means includes means for outputting second electric signals corresponding to the target pilot pressures and pressure reducing means disposed in the second pilot lines and operated in accordance with the second electric signals for reducing the pilot pressures in the second pilot lines to the target pilot pressures.

Preferably, the manipulation system includes a first pilot line for introducing a pilot pressure to the corresponding hydraulic control valve so that the front attachment is moved away from the set region, and second pilot lines for introducing pilot pressures to the corresponding hydraulic control valves so that the front attachment is moved toward the set region, the fifth calculating means includes means for calculating the target pilot pressures in the first and second pilot lines based on the modified target speed vector, and the pilot control means includes means for outputting first and second electric signals corresponding to the target pilot pressures, electro-hydraulic converting means for converting the first electric signal into a hydraulic pressure and outputting a control pressure corresponding to the target pilot pressure, higher pressure selecting means for selecting the higher one of the pilot pressure in the first pilot line and the control pressure output from the electro-hydraulic converting means and introducing the selected pressure to the corresponding hydraulic control valve, and pressure reducing means disposed in the second pilot lines and operated in accordance with the second electric signals for reducing the pilot pressures in the second pilot lines to the target pilot pressures.

In this respect, preferably, the particular front members include a boom and an arm of a hydraulic excavator, and the first pilot line is a boom-up side pilot line. Also, preferably, the second pilot lines are boom-down and arm-crowd side pilot lines. The second pilot lines may be boom-down, arm-crowd and arm-dump side pilot lines.

To achieve the above fourth object, according to the present invention, there is provided a region limiting excavation control system for a construction machine further comprising mode switching means capable of selecting any of plural work modes including a normal mode and a finish mode, wherein the first signal modifying means receives a selection signal from the mode switching means, and modifies the control signals from the manipulation means so that when the front attachment is within the set region near the boundary of the set region, the moving speed of the front attachment in the direction toward the boundary of the set region is reduced, and further when the mode switching means selects the finish mode, the moving speed of the front attachment in the direction along the boundary of the set region becomes smaller than in the case of selecting the normal mode.

By providing the mode switching means and modifying the control signals by the first signal modifying means as mentioned above, the working speed can be set in accordance with the mode selected by the mode switching means, making it possible to select the finishing work with great weight imposed on accuracy and the working speed. Accordingly, the work mode can optionally be set depending on the kind of work such that the front attachment is slowly moved when a high degree of finish accuracy is required, and it is moved fast when finish accuracy is not so required, but the working speed is important. As a result, working efficiency can be improved.

To achieve the above fourth object, according to the present invention, there is provided a region limiting excavation control system for a construction machine wherein the first signal modifying means recognizes a distance between the position of a particular location of the front attachment and a construction machine body based on the value calculated by the first calculating means, and modifies the control signals from the manipulation means so that when the front attachment is within the set region near the boundary of the set region, the moving speed of the front attachment in the direction toward the boundary of the set region is reduced, and further if the distance becomes large, the moving speed of the front attachment in the direction along the boundary of the set region is also reduced.

By modifying the control signals by the first signal modifying means as mentioned above, in such a working posture that change in rotational angle of the front attachment is large with respect to the amounts by which the hydraulic actuators for the front members are extended or contracted, as resulted when the front attachment is located near its maximum reach, the moving speed of the bucket end in the direction along the boundary of the set region is reduced and control accuracy is improved correspondingly.

BEST MODE FOR CARRYING OUT THE INVENTION

Hereinafter, several embodiments of the present invention when applied to a hydraulic excavator will be described with reference to the drawings.

First Embodiment

A first embodiment of the present invention will be described with reference to FIGS. 1 to 15.

Figure 1:
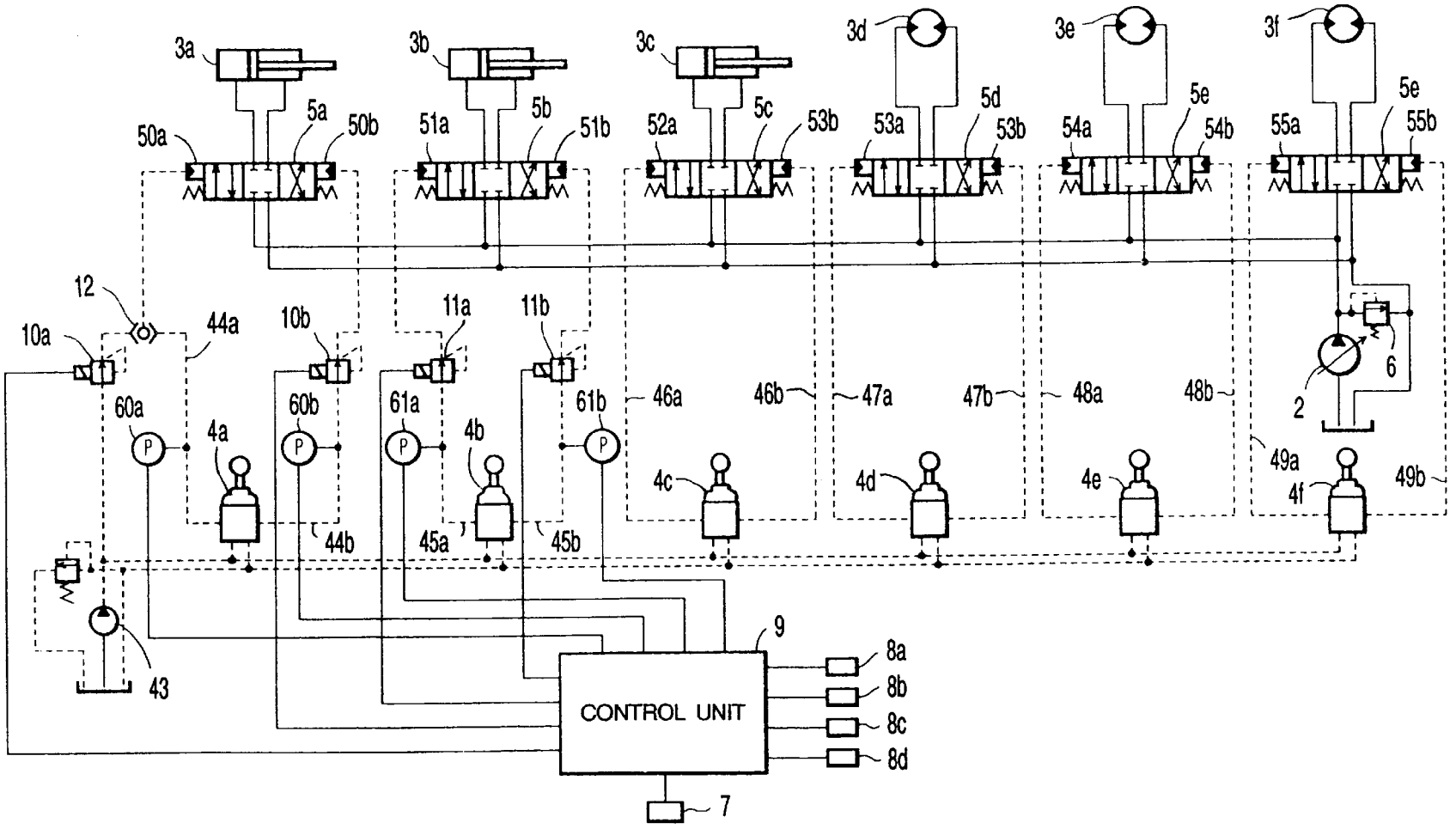
FIG. 1 is a diagram showing a region limiting excavation control system for a construction machine according to a first embodiment of the present invention, along with a hydraulic drive system for the control system.

In FIG. 1, a hydraulic excavator to which the present invention is applied comprises a hydraulic pump 2, a plurality of hydraulic actuators driven by a hydraulic fluid from the hydraulic pump 2, including a boom cylinder 3*a*, an arm cylinder 3*b*, a bucket cylinder 3*c*, a swing motor 3*d* and left and right track motors 3*e*, 3*f*, a plurality of control lever units 4*a* to 4*f* provided respectively corresponding to the hydraulic actuators 3*a* to 3*f*, a plurality of flow control valves 5*a* to 5*f* connected respectively between the hydraulic pump 2 and the plurality of hydraulic actuators 3*a* to 3*f* and controlled in accordance with respective control (input) signals from the control lever units 4*a* to 4*f* for controlling flow rates of the hydraulic fluid supplied to the hydraulic actuators 3*a* to 3*f*, and a relief valve 6 which is made open when the pressure between the hydraulic pump 2 and the flow control valves 5*a* to 5*f* exceeds a preset value. The above components cooperatively make up a hydraulic drive system for driving driven members of the hydraulic excavator.

Figure 2:
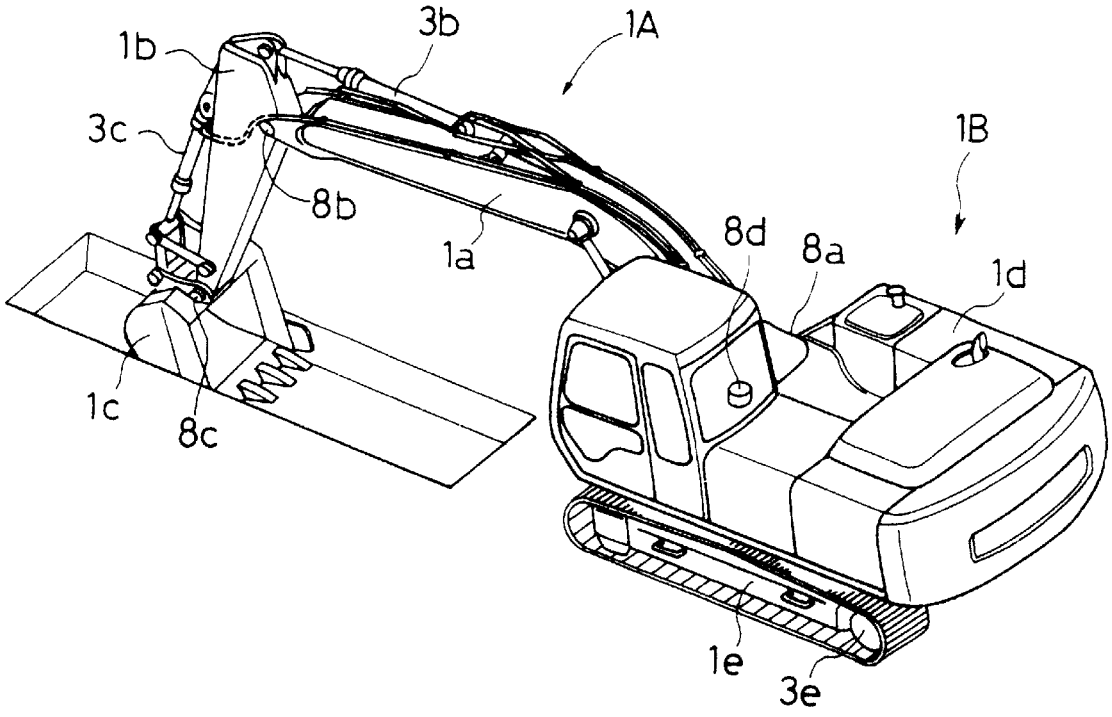
FIG. 2 is a view showing an appearance of a hydraulic excavator to which the present invention is applied, and a shape of a set region around the excavator.

Also, as shown in FIG. 2, the hydraulic excavator is made up by a multi-articulated front attachment 1A comprising a boom 1*a*, an arm 1*b* and a bucket 1*c* which are each rotatable in the vertical direction, and a body 1B comprising an upper structure 1*d* and an undercarriage 1*e*, the boom 1*a* of the front attachment 1A having its base end supported to a front portion of the upper structure 1*d*. The boom 1*a*, the arm 1*b*, the bucket 1*c*, the upper structure 1*d* and the undercarriage 1*e* serve as members driven respectively by the boom cylinder 3*a*, the arm cylinder 3*b*, the bucket cylinder 3*c*, the swing motor 3*d* and the left and right track motors 3*e*, 3*f*. The operations of these driven members are instructed from the control lever units 4*a* to 4*f*.

Figure 3:
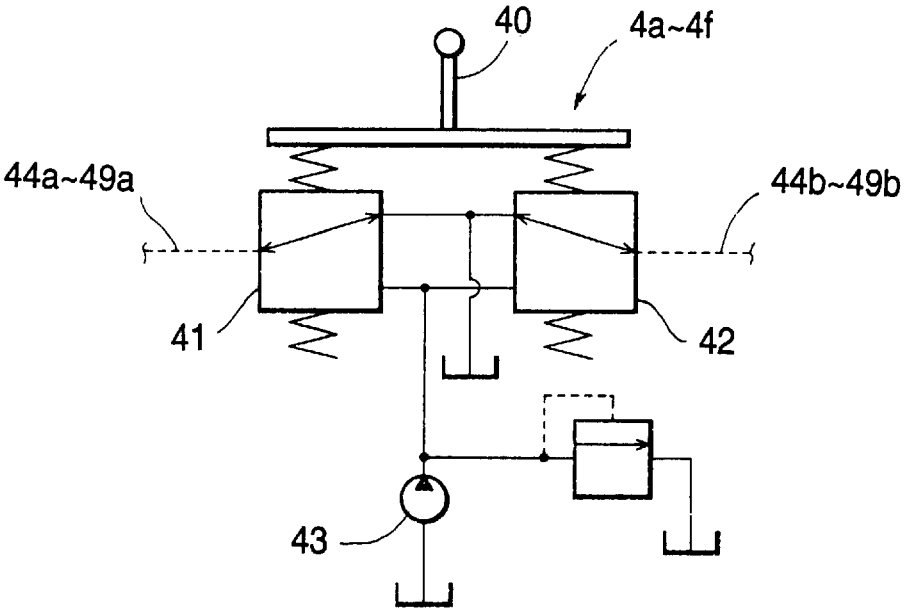
FIG. 3 is a view showing details of a control lever unit of a hydraulic pilot type.

The control lever units 4*a* to 4*f* are each of the hydraulic pilot type driving corresponding ones of the flow control valves 5*a* to 5*f* with a pilot pressure. As shown in FIG. 3, each of the control lever units 4*a* to 4*f* comprises a control lever 40 manipulated by the operator, and a pair of pressure reducing valves 41, 42 for generating a pilot pressure depending on the amount and the direction by and in which the control lever 40 is manipulated. The pressure reducing valves 41, 42 are connected at the primary port side to a pilot pump 43, and at the secondary port side to corresponding ones of hydraulic driving sectors 50*a*, 50*b*; 51*a*, 51*b*; 52*a*, 52*b*; 53*a*, 53*b*; 54*a*, 54*b*; 55*a*, 55*b* of the flow control valves through pilot lines 44*a*, 44*b*; 45*a*, 45*b*; 46*a*, 46*b*; 47*a*, 47*b*; 48*a*, 48*b*; 49*a*, 49*b*.

A region limiting excavation control system of this embodiment is mounted on the hydraulic excavator constructed as explained above. The control system comprises a setter 7 for providing an instruction to set an excavation region where a predetermined location of the front attachment, e.g., the end of the bucket 1*c*, is movable, depending on the scheduled work beforehand, angle sensors 8*a*, 8*b*, 8*c* disposed respectively at pivotal points of the boom 1*a*, the arm 1*b* and the bucket 1*c* for detecting respective rotational angles thereof as status variables with regard to the position and posture of the front attachment 1A, an inclination angle sensor 8*d* for detecting an inclination angle θ of the body 1B in the forth-and-back direction, pressure sensors 60*a*, 60*b*; 61*a*, 61*b* disposed in the pilot lines 44*a*, 44*b*; 45*a*, 45*b* connected to the boom and arm control lever units 4*a*, 4*b* for detecting respective pilot pressures representative of input amounts from the control lever units 4*a*, 4*b*, a control unit 9 for receiving a set signal of the setter 7, detection signals of the angle sensors 8*a*, 8*b*, 8*c* and the inclination angle sensor 8*d*, and detection signals of the pressure sensors 60*a*, 60*b*; 61*a*, 61*b*, setting the excavation region where the end of the bucket 1*c* is movable, and outputting electric signals to perform excavation control within the limited region, proportional solenoid valves 10*a*, 10*b*, 11*a*, 11*b* driven by the electric signals output from the control unit 9, and a shuttle valve 12. The proportional solenoid valve 10*a* is connected at the primary port side to the pilot pump 43, and at the secondary port side to the shuttle valve 12. The shuttle valve 12 is disposed in the pilot line 44*a* and selects the higher one of the pilot pressure in the pilot line 44*a* and the control pressure delivered from the proportional solenoid valve 10*a* and introduces the selected pressure to the hydraulic driving sector 50*a* of the flow control valve 5*a*. The proportional solenoid valves 10*b*, 11*a*, 11*b* are disposed in the pilot lines 44*b*, 45*a*, 45*b*, respectively, and reduce the pilot pressures in the pilot lines in accordance with the respective electric signals applied thereto and output the reduced pilot pressures.

The setter 7 comprises manipulation means, such as a switch, disposed on a control panel or grip for outputting a set signal to the control unit 9 to instruct setting of the excavation region. Other suitable aid means such as a display may be provided on the control panel. The setting of the excavation region may be instructed by any of other suitable methods such as using IC cards, bar codes, laser, and wireless communication.

Figure 4:
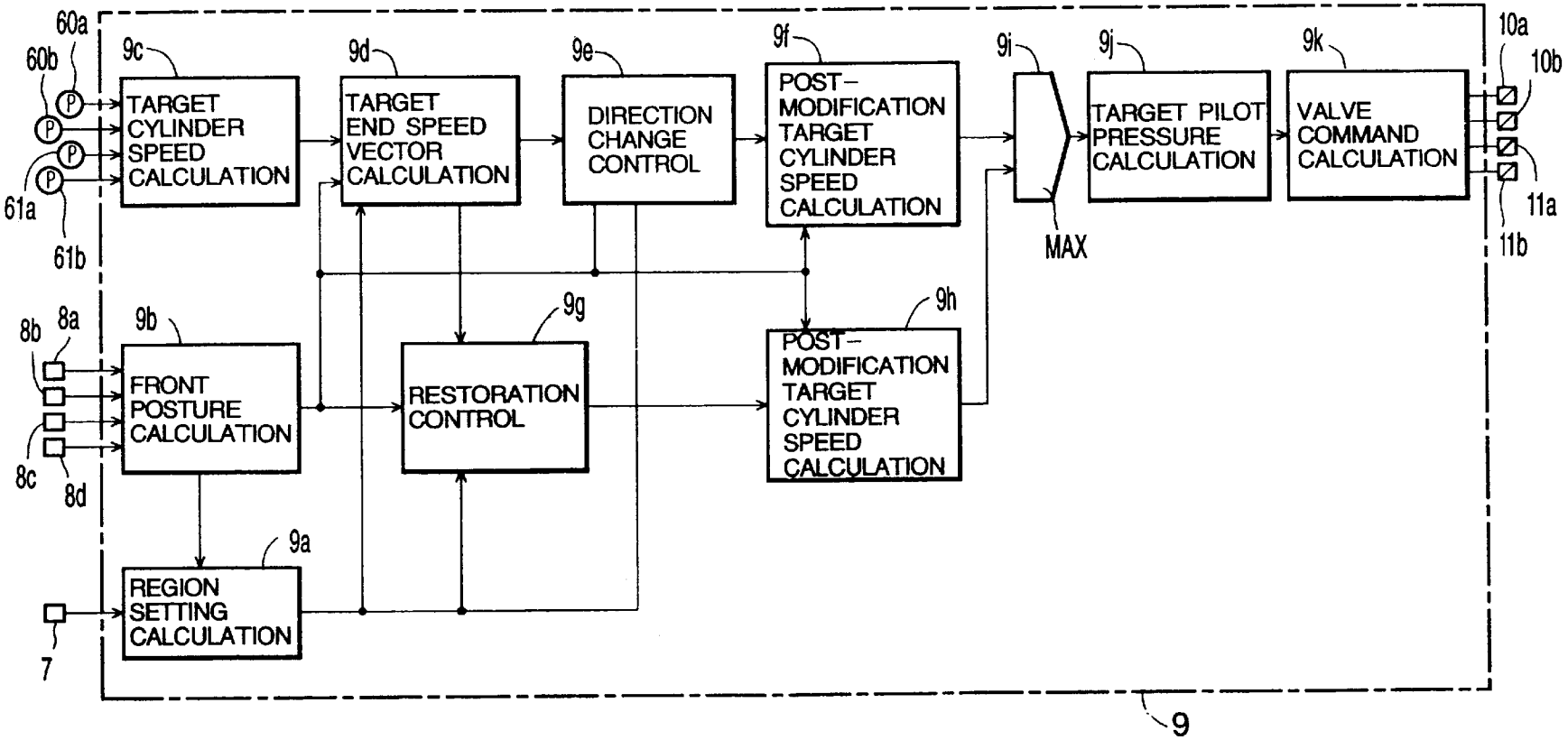
FIG. 4 is a functional block diagram showing control functions of a control unit.

Control functions of the control unit 9 are shown in FIG. 4. The control unit 9 includes functional portions of a region setting calculator 9*a*, a front posture calculator 9*b*, a target cylinder speed calculator 9*c*, a target end speed vector calculator 9*d*, a direction change controller 9*e*, a post-modification target cylinder speed calculator 9*f*, a restoration control calculator 9*g*, a post-modification target cylinder speed calculator 9*h*, a target cylinder speed selector 9*i*, a target pilot pressure calculator 9*j*, and a valve command calculator 9*k*.

The region setting calculator 9*a* executes calculation for setting of the excavation region where the end of the bucket 1*c* is movable, in accordance with an instruction from the setter 7. One example of a manner of setting the excavation region will be described with reference to FIG. 5. Note that, in this embodiment, the excavation region is set in a vertical plane.

Figure 5:
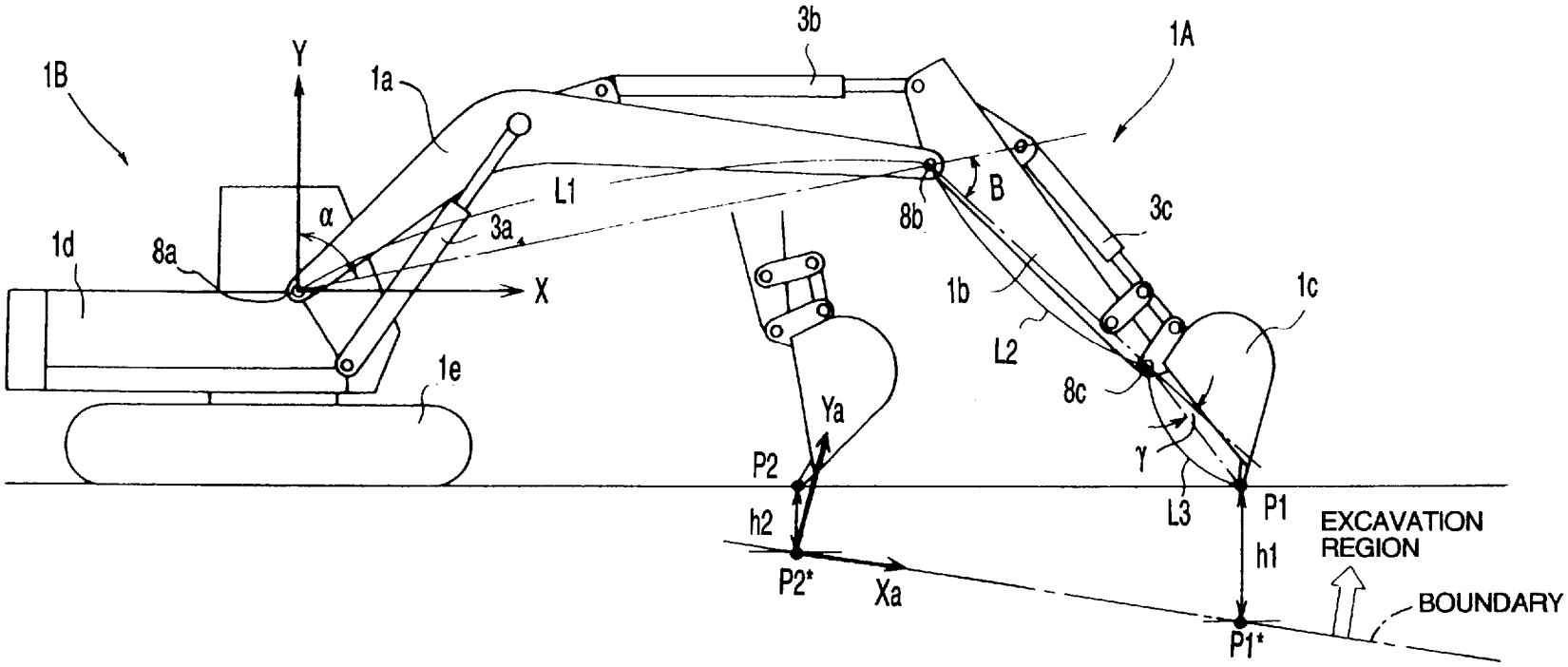
FIG. 5 is a view showing a coordinate system for use in region limiting excavation control of this embodiment and a method of setting a region.

In FIG. 5, after the end of the bucket 1*c* has been moved to the position of a point P1 upon the operator manipulating the front attachment, the end position of the bucket 1*c* at that time is calculated in response to an instruction from the setter 7, and the setter 7 is then operated to input a depth h1 from that position to designate a point P1* on the boundary of the excavation region to be set in terms of depth. Subsequently, after moving the end of the bucket 1*c* to the position of a point P2, in a like manner to the above, the end position of the bucket 1*c* at that time is calculated in response to an instruction from the setter 7, and the setter 7 is then operated to input a depth h2 from that position to designate a point P2* on the boundary of the excavation region to be set in terms of depth. Then, a formula expressing the straight line connecting the two points P1* and P2* is calculated and set as the boundary of the excavation region.

In the above process, the positions of the two points P1, P2 are calculated by the front posture calculator 9*b*, and the region setting calculator 9*a* calculates the formula of the straight line from information on the positions of those two points.

The control unit 9 stores various dimensions of the front attachment 1A and the body 1B, and the front posture calculator 9*b* calculates the positions of the two points P1, P2 based on the stored data and values of rotational angles α, β, γ detected respectively by the angle sensors 8*a*, 8*b*, 8*c*. At this time, the positions of the two points P1, P2 are determined, by way of example, as coordinate values (X1, Y1), (X2, Y2) on the XY-coordinate system with the origin defined as the pivotal point of the boom 1*a*. The XY-coordinate system is an orthogonal coordinate system fixed on the body 1B and is assumed to exist in a vertical plane. Given that the distance between the pivotal point of the boom 1*a* and the pivotal point of the arm 1*b* is L1, the distance between the pivotal point of the arm 1*b* and the pivotal point of the bucket 1*c* is L2, and the distance between the pivotal point of the bucket 1*c* and the end of the bucket 1*c* is L3, the coordinate values (X1, Y1), (X2, Y2) on the XY-coordinate system are determined from the rotational angles α, β, γ by using formulae below.

$$X=L1\ \sin\alpha+L2\ \sin(\alpha+\beta)+L3\ \sin(\alpha+\beta+\gamma)$$

$$Y=L1\ \cos\alpha+L2\ \cos(\alpha+\beta)+L3\ \cos(\alpha+\beta+\gamma)$$

The region setting calculator 9*a* determines the coordinate values of the two points P1*, P2* on the boundary of the excavation region by calculating the Y-coordinate values as follows.

$$Y1^*=Y1-h1$$

$$Y2^*=Y2-h2$$

The formula expressing the straight line connecting the two points P1* and P2* is calculated from the following equation.

$$Y=(Y2^*-Y1^*)X/(X2-X1)+(X2Y1^*-X1Y2^*)/(X2-X1)$$

Then, an orthogonal coordinate system having the origin on the above straight line and one axis defined by the above straight line, for example, an XaYa-coordinate system with the origin defined as the point P2*, is set and coordinate transform data from the XY-coordinate system into the XaYa-coordinate system is determined.

Figure 6:
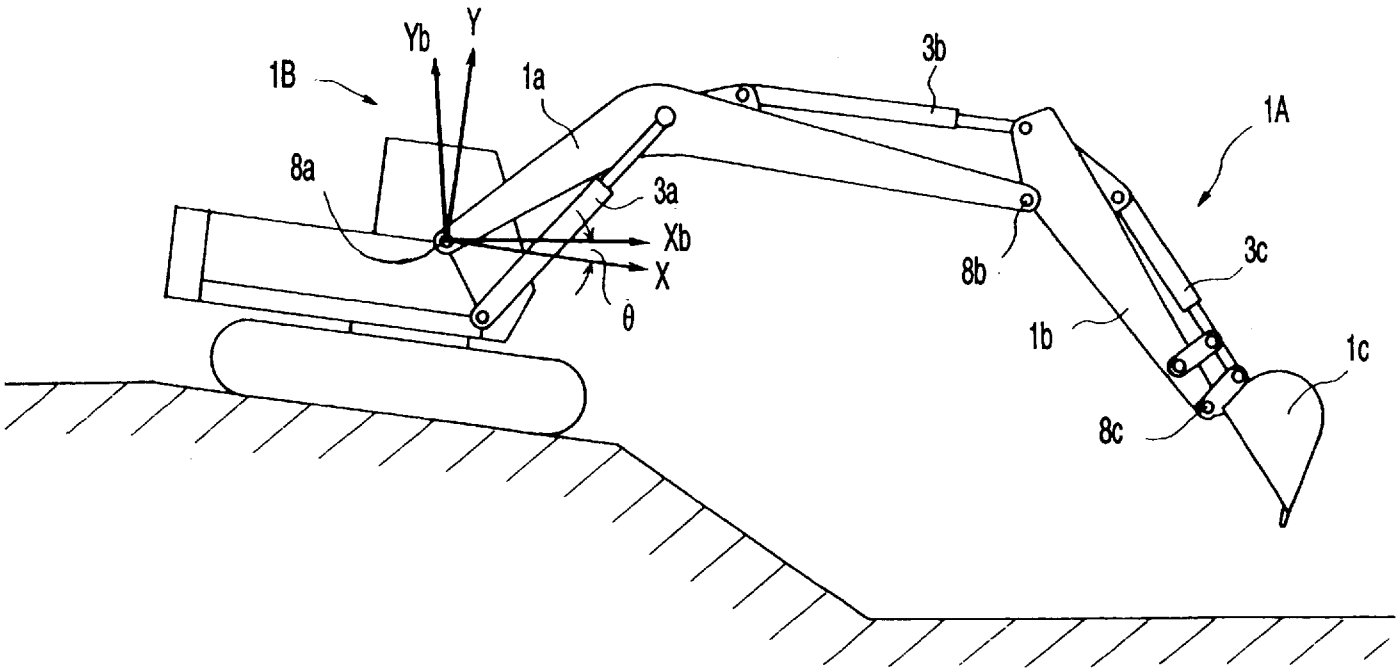
FIG. 6 is a view for explaining a method of modifying an inclination angle.

When the body 1B is inclined as shown in FIG. 6, the relative positional relationship between the bucket end and the ground is changed and the setting of the excavation region cannot correctly be performed. In this embodiment, therefore, the inclination angle θ of the body 1B is detected by the inclination angle sensor 8*d* and a detected value of the angle θ is input to the front posture calculator 9*b* which calculates the end position of the bucket in an XbYb-coordinate which is provided by rotating the XY-coordinate system through the angle θ. This enables the excavation region to be correctly set even if the body 1B is inclined. Note that the inclination angle sensor is not always required when work is started after correcting an inclination of the body if the body is inclined, or when excavation is performed in the work site where the body will not incline.

Figure 7:
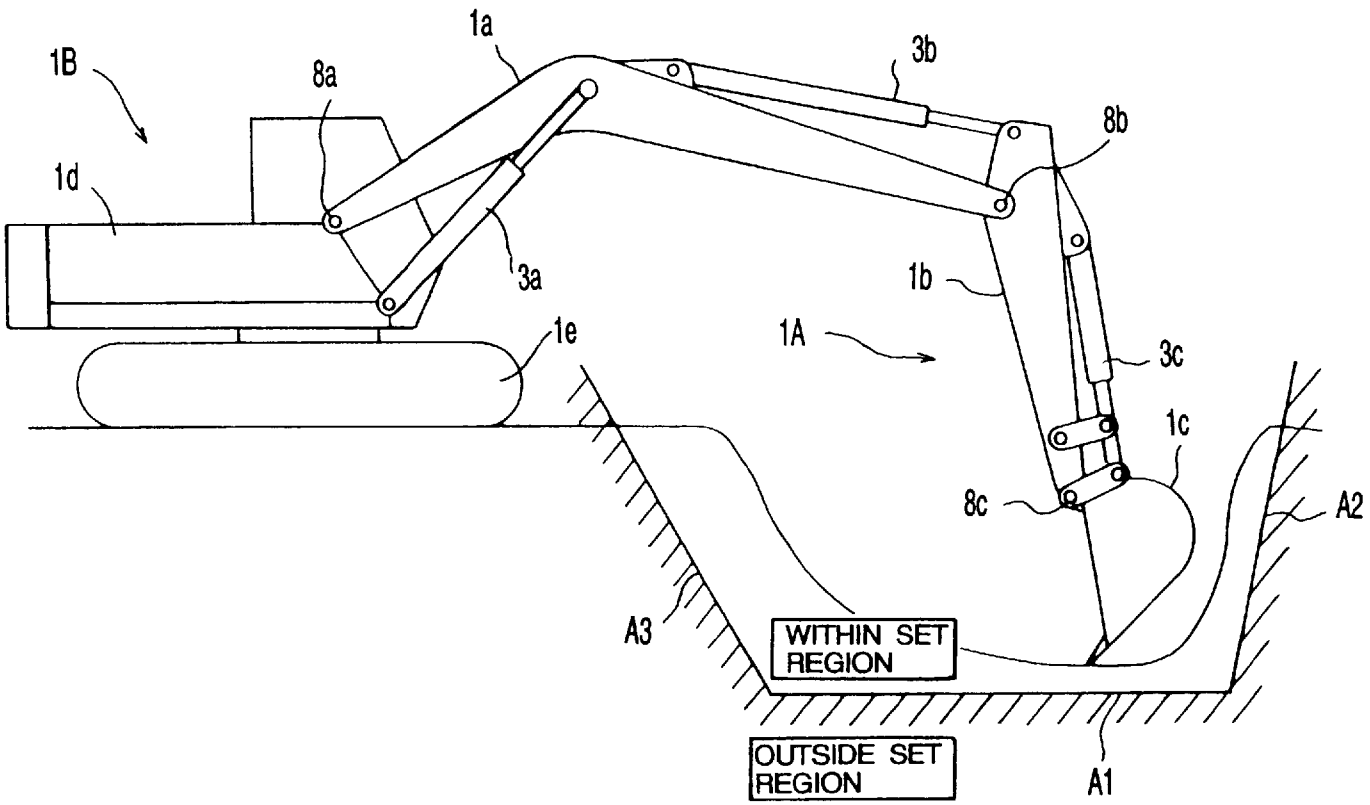
FIG. 7 is a view showing one example of the region set in this embodiment.

While the boundary of the excavation region is set by a single straight line in the above example, the excavation region having any desired shape in a vertical plane can be set by combining a plurality of straight lines with each other. FIG. 7 shows one example of the latter case in which the excavation region is set by using three straight lines A1, A2 and A3. In this case, the boundary of the excavation region can be set by carrying out the same operation and calculation as mentioned above for each of the straight lines A1, A2 and A3.

As explained above, the front posture calculator 9*b* calculates the position of a predetermined location of the front attachment 1A as the coordinate values on the XY-coordinate system based on the various dimensions of the front attachment 1A and the body 1B which are stored in a memory of the control unit 9, as well as the values of the rotational angles α, β, γ detected respectively by the angle sensors 8*a*, 8*b*, 8*c*.

Figure 8:
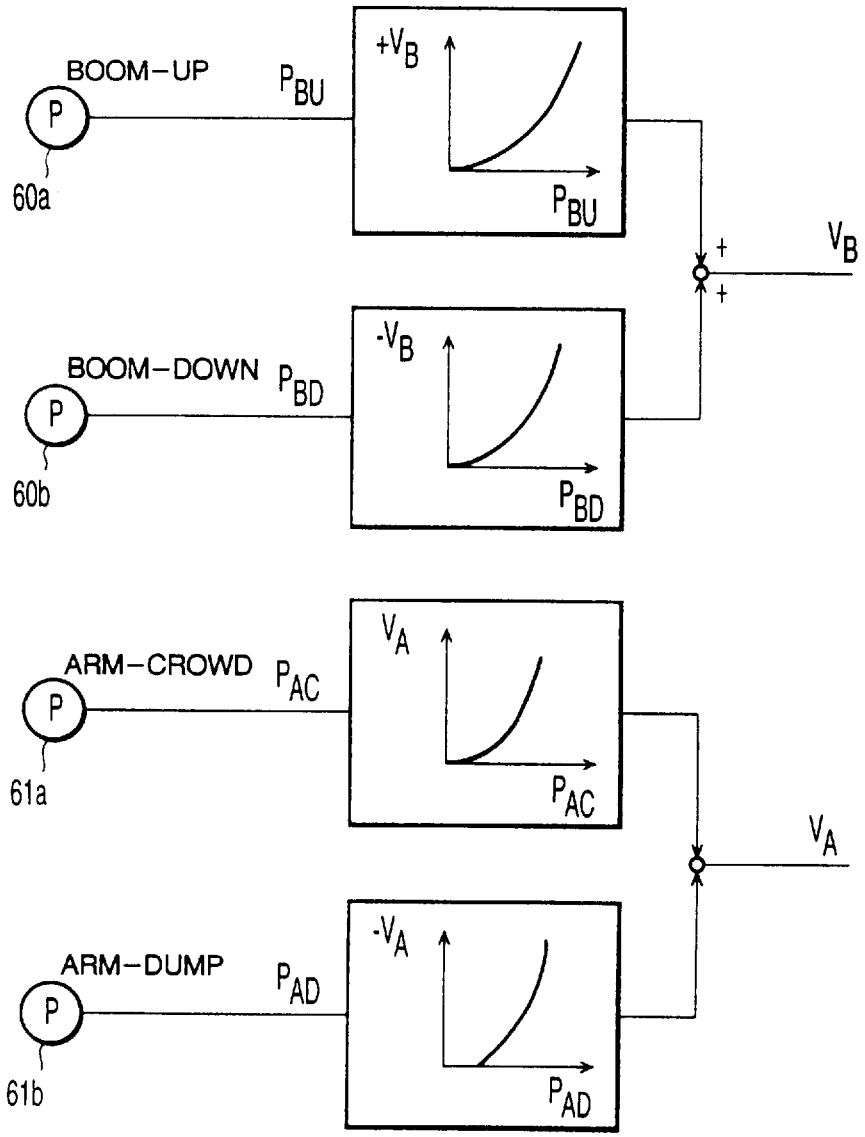
FIG. 8 is a diagram showing the relationship between a pilot pressure and a delivery flow rate of a flow control valve in a target cylinder speed calculator.

The target cylinder speed calculator 9*c* receives values of the pilot pressures detected by the pressure sensors 60*a*, 60*b*, 61*a*, 61*b*, determines delivery flow rates of the flow control valves 5*a*, 5*b*, and calculates target speeds of the boom cylinder 3*a* and the arm cylinder 3*b* from the determined delivery flow rates. The memory of the control unit 9 stores the relationships between pilot pressures PBU, PBD, PAC, PAD and delivery rates VB, VA of the flow control valves 5*a,* 5*b* as shown in FIG. 8. The target cylinder speed calculator 9*c* determines the delivery flow rates of the flow control valves 5*a,* 5*b* based on the plotted relationships. As an alternative, the target cylinder speed may be determined from the pilot pressure directly by storing calculated target cylinder speeds corresponding to respective pilot pressures in the memory of the control unit 9.

The target end speed vector calculator 9*d* determines a target speed vector Vc at the end of the bucket 1*c* from the position of the bucket end determined by the front posture calculator 9*b,* the target cylinder speed determined by the target cylinder speed calculator 9*c,* and the various dimensions, such as L1, L2 and L3, stored in the memory of the control unit 9. At this time, the target speed vector Vc is first determined as values on the XY-coordinate system shown in FIG. 5, and then determined as values on the XaYa-coordinate system by converting the values on the XY-coordinate system into the values on the XaYa-coordinate system using the transform data from the XY-coordinate system to the XaYa-coordinate system previously determined by the region setting calculator 9*a*. Here, an Xa-coordinate value Vcx of the target speed vector Vc on the XaYa-coordinate system represents a vector component in the direction parallel to the boundary of the set region, and a Ya-coordinate value Vcy of the target speed vector Vc on the XaYa-coordinate system represents a vector component in the direction vertical to the boundary of the set region.

When the end of the bucket 1*c* is positioned within the set region near the boundary thereof and the target speed vector Vc has a component in the direction toward the boundary of the set region, the direction change controller 9*e* modifies the vertical vector component such that it is gradually reduced as the bucket end comes closer to the boundary of the set region. In other words, to the vector component Vcy in the vertical direction, a vector (reversed vector) being smaller than the component Vcy and orienting away from the set region is added.

Figure 9:
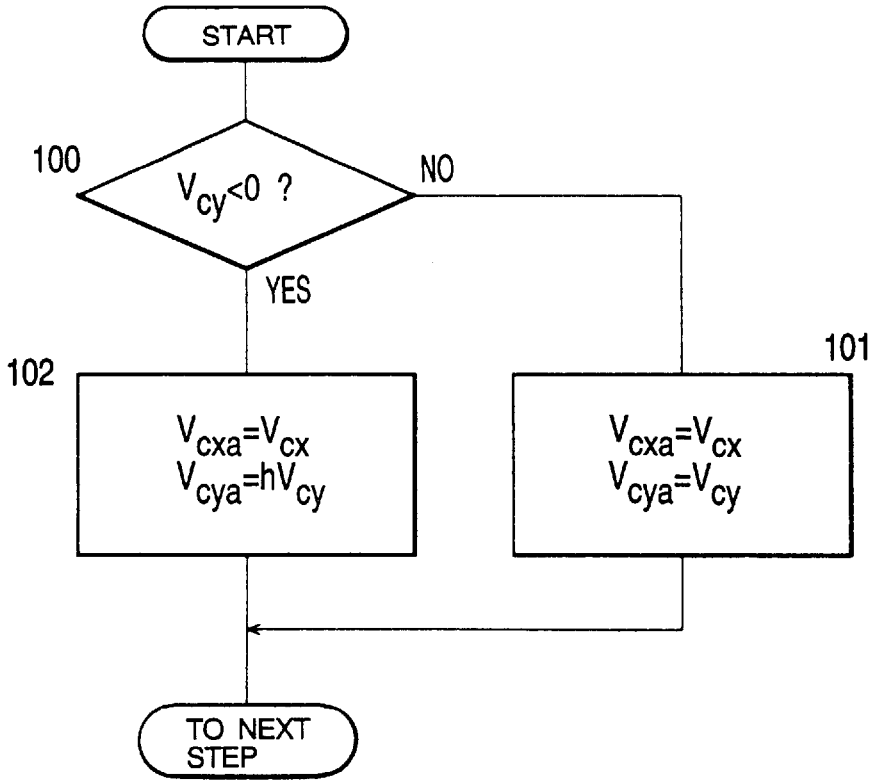
FIG. 9 is a flowchart showing processing procedures executed in a direction change controller.

FIG. 9 is a flowchart showing control procedures executed in the direction change controller 9*e*. First, in step 100, whether the component of the target speed vector Vc vertical to the boundary of the set region, i.e., the Ya-coordinate value Vcy on the XaYa-coordinate system, is positive or negative is determined. If the Ya-coordinate value Vcy is positive, this means the speed vector being oriented such that the bucket end moves away from the boundary of the set region. Therefore, the control procedure goes to step 101 where the Xa-coordinate value Vcx and the Ya-coordinate value Vcy of the target speed vector Vc are set, as they are, to vector components Vcxa, Vcya after modification. If the Ya-coordinate value Vcy is negative, this means the speed vector being oriented such that the bucket end moves closer to the boundary of the set region. Therefore, the control procedure goes to step 102 where, for the direction change control, the Xa-coordinate value Vcx of the target speed vector Vc is set, as it is, to the vector component Vcxa after modification, and a value obtained by multiplying the Ya-coordinate value Vcy by a coefficient h is set to the vector component Vcya after modification.

Figure 10:
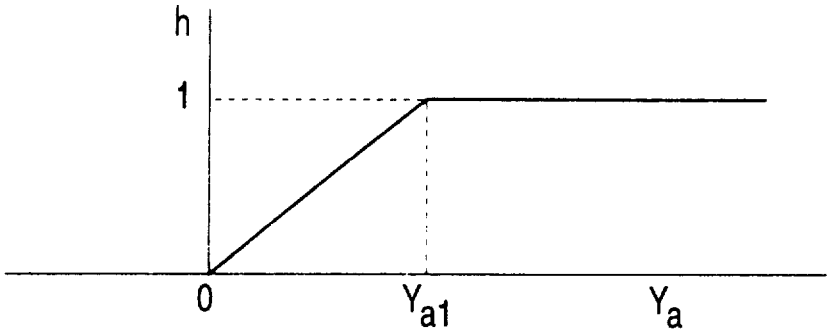
FIG. 10 is a graph showing the relationship between a distance Ya from the bucket end to the boundary of the set region and a coefficient h in the direction change controller.

Here, as shown in FIG. 10, the coefficient h is a value which takes 1 when the distance Ya between the end of the bucket 1*c* and the boundary of the set region is larger than a preset value Ya1, which is gradually reduced from 1 as the distance Ya decreases when the distance Ya is smaller than the preset value Ya1, and which takes 0 when the distance Ya becomes zero, i.e., when the bucket end reaches the boundary of the set region. Such a relationship between h and Ya is stored in the memory of the control unit 9.

In the direction change controller 9*e,* the end position of the bucket 1*c* determined by the front posture calculator 9*b* is converted into coordinate values on the XaYa-coordinate system by using the transform data from the XY-coordinate system to the XaYa-coordinate system previously calculated by the region setting calculator 9*a*. Then, the distance Ya between the end of the bucket 1*c* and the boundary of the set region is determined from the converted Ya-coordinate value, and the coefficient h is determined from the distance Ya based on the relationship of FIG. 10.

By modifying the vertical vector component Vcy of the target speed vector Vc as described above, the vertical vector component Vcy is reduced such that the amount of reduction in the vertical vector component Vcy is increased as the distance Ya decreases. Thus, the target speed vector Vc is modified into a target speed vector Vca. Here, the range of the distance Ya1 from the boundary of the set region can be called a direction change region or a deceleration region.

Figure 11:
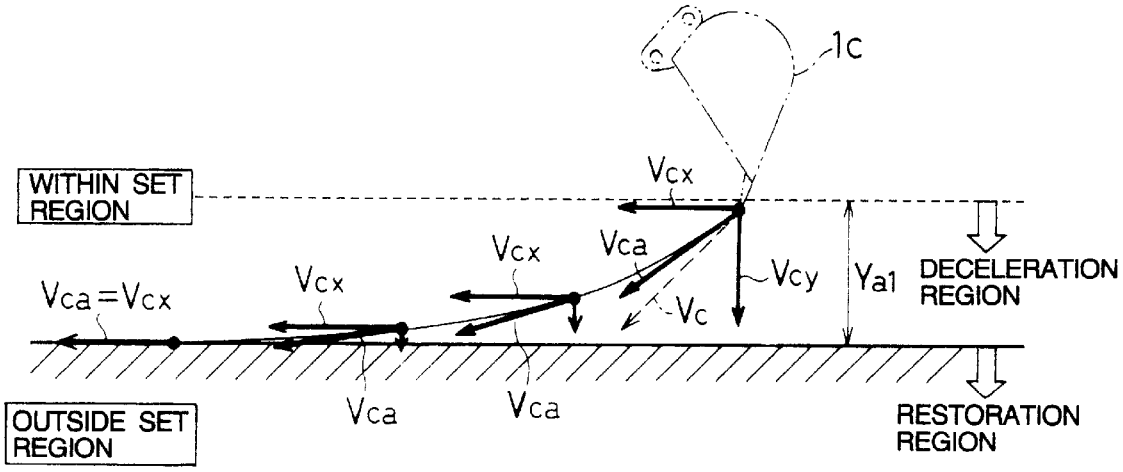
FIG. 11 is a diagram showing one example of a path along which the bucket end is moved when direction change control is performed as per calculation.

FIG. 11 shows one example of a path along which the end of the bucket 1*c* is moved when the direction change control is performed as per the above-described target speed vector Vca after modification. Given that the target speed vector Vc is oriented downward obliquely and constant, its parallel component Vcx remains the same and its vertical component Vcy is gradually reduced as the end of the bucket 1*c* comes closer to the boundary of the set region (i.e., as the distance Ya decreases). Because the target speed vector Vca after modification is a resultant of both the parallel and vertical components, the path is in the form of a curved line which is curved to come closer to a parallel line while approaching the boundary of the set region, as shown in FIG. 10. Also, given that h=0 holds at Ya=0, the target speed vector Vca after modification on the boundary of the set region coincides with the parallel component Vcx.

Figure 12:
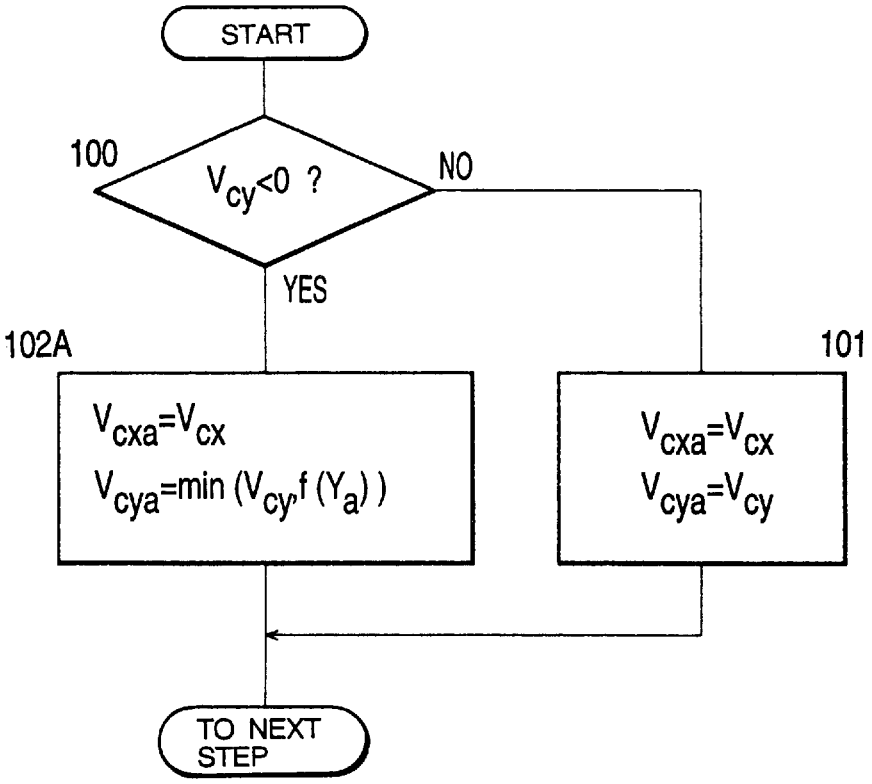
FIG. 12 is a flowchart showing other processing procedures executed in the direction change controller.
Figure 13:
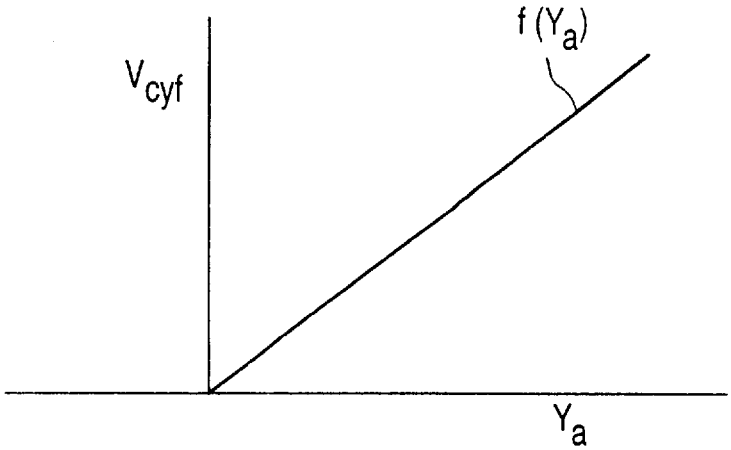
FIG. 13 is a graph showing the relationship between the distance Ya and a function Vcyf in the direction change controller.

FIG. 12 is a flowchart showing another example of control procedures executed in the direction change controller 9*e*. In this example, if the component Vcy of the target speed vector Vc vertical to the boundary of the set region (i.e., the Ya-coordinate value of the target speed vector Vc) is determined to be negative in step 100, the control procedure goes to step 102A where a decelerated Ya-coordinate value Vcyf corresponding to the distance Ya between the end of the bucket 1*c* and the boundary of the set region is determined from the functional relationship of Vcyf=f(Ya), shown in FIG. 13, stored in the memory of the control unit 9 and smaller one of the Ya-coordinate values Vcyf and Vcy is then set to the vector component Vcya after modification. This provides an advantage that when the end of the bucket 1*c* is slowly moved, the bucket speed is not reduced any longer even if the bucket end comes closer to the boundary of the set region, allowing the operator to carry out the operation as per manipulation of the control lever.

In spite of that the vertical component of the target speed vector at the bucket end is reduced as explained above, it is very difficult to make the vertical vector component zero at the vertical distance Ya=0 due to variations caused by manufacture tolerances of the flow control valves and other hydraulic equipment, causing the bucket end to often go out of the set region. In this embodiment, however, since restoration control described later is also effected, the bucket end is controlled to operate almost on the boundary of the set region. Because of the restoration control being thus effected in a combined manner, the relationships shown in FIGS. 10 and 11 may be set such that the coefficient h or the Ya-coordinate value Vchf after deceleration may be somewhat above zero at the vertical distance Ya=0.

While the horizontal component (Xa-coordinate value) of the target speed vector remains the same in the above-explained control, it is not always required to remain the same. The horizontal component may be increased to speed up the bucket end, or decreased to speed down the bucket end. The latter case will be described below as another embodiment.

The post-modification target cylinder speed calculator 9*f* calculates target cylinder speeds of the boom cylinder 3*a* and the arm cylinder 3*b* from the target speed vector after modification determined by the direction change controller 9*e*. This process is a reversal of the calculation executed by the target end speed vector calculator 9*d*.

When the direction change control (deceleration control) is performed in step 102 or 102A in the flowchart of FIG. 9 or 12, the directions in which the boom cylinder and the arm cylinder are required to be operated to achieve the direction change control are selected and the target cylinder speeds in the selected operating directions are calculated. A description will now be made of, by way of example, the case of crowding the arm with an intention of digging the ground toward the body (i.e., the arm-crowd operation) and the case of operating the bucket end in the direction to push it by the combined operation of boom-down and arm-dump (i.e., the arm-dump combined operation).

In the arm-crowd operation, the vertical component Vcy of the target speed vector Vc can be reduced in three ways below;

(1) raising the boom 1*a;*

(2) decelerating the operating to crowd the arm 1*b;* and (3) combining the methods (1) and (2).

In the combined method (3), proportions of the two methods are dependent on the posture of the front attachment, the horizontal vector component, etc. at that time. Anyway, the proportions are determined in accordance with the control software. Since this embodiment includes the restoration control as well, the method (1) or (3) including raise-up of the boom 1*a* is preferable. Taking into account smoothness of the operation, the method (3) is most preferable.

In the arm-dump combined operation, when the arm is dumped from the position near the body (nearby position), the target vector in the direction of going out of the set region is given. To reduce the vertical component Vcy of the target speed vector Vc, therefore, the arm-dumping is required to be sped down by switching the boom operation mode from boom-down to boom-up. The combination of boom-up and arm-dump is also determined in accordance with the control software.

In the restoration controller 9*g,* when the end of the bucket 1*c* goes out of the set region, the target speed vector is modified depending on the distance from the boundary of the set region so that the bucket end is returned to the set region. In other words, to the vector component Vcy in the vertical direction, a vector (reversed vector) being larger than the component Vcy and orienting toward the set region is added.

Figure 14:
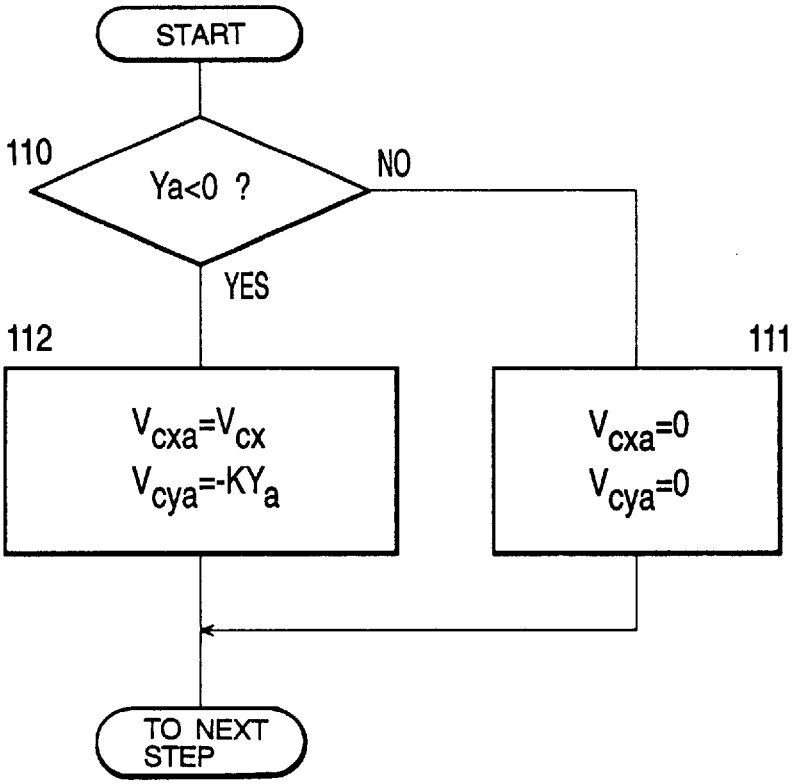
FIG. 14 is a flowchart showing processing procedures executed in a restoration controller.

FIG. 14 is a flowchart showing control procedures executed in the restoration controller 9*g*. First, in step 110, whether the distance Ya between the end of the bucket 1*c* and the boundary of the set region is positive or negative is determined. Here, the distance Ya is determined by converting the position of the front end determined by the front posture calculator 9*b* into coordinate values on the XaYa-coordinate system by using the transform data from the XY-coordinate system to the XaYa-coordinate system, as described above, and then extracting the converted Ya-coordinate value. If the distance Ya is positive, this means that the bucket end is still within the set region. Therefore, the control procedure goes to step 111 where the Xa-coordinate value Vcx and the Ya-coordinate value Vcy of the target speed vector Vc are each set to 0 to carry out the direction change control explained above with priority. If the distance Ya is negative, this means that the bucket end has moved out of the boundary of the set region. Therefore, the control procedure goes to step 112 where, for the restoration control, the Xa-coordinate value Vcx of the target speed vector Vc is set, as it is, to the vector component Vcxa after modification, and a value obtained by multiplying the Ya-coordinate value Vcy by a coefficient—K is set to the vector component Vcya after modification. The coefficient K is an arbitrary value determined from the viewpoint of control characteristics, and—KVcy represents a speed vector in the reversed direction which becomes smaller as the distance Ya decreases. Incidentally, K may be a function of which value is reduced as the distance Ya decreases. In this case,—KVcy is reduced at a greater rate as the distance Ya decreases.

By modifying the vertical vector component Vcy of the target speed vector Vc as described above, the target speed vector Vc is modified into a target speed vector Vca so that the vertical vector component Vcy is reduced as the distance Ya decreases.

Figure 15:
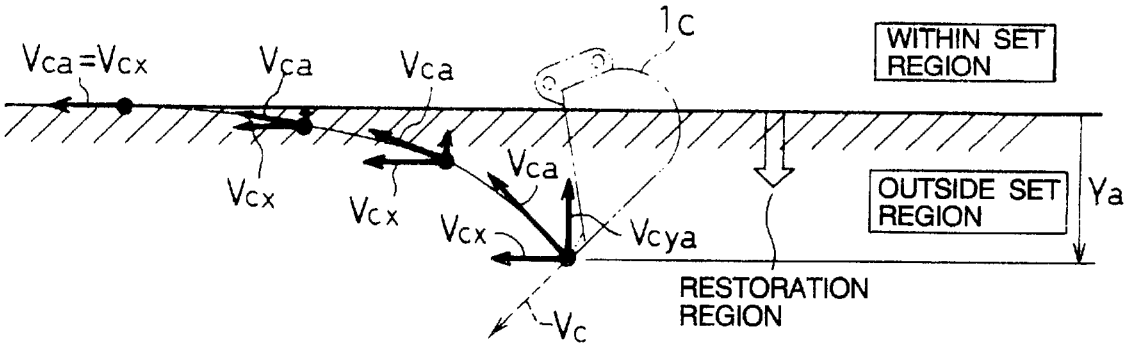
FIG. 15 is a diagram showing one example of a path along which the bucket end is moved when its restoration is controlled as per calculation.

FIG. 15 shows one example of a path along which the end of the bucket 1*c* is moved when the restoration control is performed as per the above-described target speed vector Vca after modification. Given that the target speed vector Vc is oriented downward obliquely and constant, its parallel component Vcx remains the same and its vertical component is gradually reduced as the end of the bucket 1*c* comes closer to the boundary of the set region (i.e., as the distance Ya decreases), for a restoration vector Vcya (=−KYa) is proportional to the distance Ya. Because the target speed vector Vca after modification is a resultant of both the parallel and vertical components, the path is in the form of a curved line which is curved to come closer to a parallel line while approaching the boundary of the set region, as shown in FIG. 15.

Thus, since the end of the bucket 1*c* is controlled to return to the set region by the restoration controller 9*g,* a restoration region is defined outside the set region. In the restoration control, the movement of the end of the bucket 1*c* toward the boundary of the set region is also slowed down and, eventually, the direction in which the end of the bucket 1*c* is moving is converted into the direction along the boundary of the set region. In this meaning, the restoration control can also be called direction change control.

The post-modification target cylinder speed calculator 9*h* calculates target cylinder speeds of the boom cylinder 3*a* and the arm cylinder 3*b* from the target speed vector after modification determined by the restoration controller 9*g*. This process is a reversal of the calculation executed by the target end speed vector calculator 9*d*.

When the restoration control is performed in step 112 in the flowchart of FIG. 14, the directions in which the boom cylinder and the arm cylinder are required to be operated to achieve the restoration control are selected and the target cylinder speeds in the selected operating directions are calculated. Since the bucket end is returned to the set region by raising the boom 1*a* in the restoration control, the direction of raising the boom 1*a* is always included. The combination of boom-up and any other mode is also determined in accordance with the control software.

The target cylinder speed selector 9*i* selects the larger one (maximum value) of a value of the target cylinder speed determined by the target cylinder speed calculator 9*f* for the direction change control and a value of the target cylinder speed determined by the target cylinder speed calculator 9*h* for the restoration control, and then sets the selected value as a target cylinder speed to be output.

Here, when the distance Ya between the bucket end and the boundary of the set region is positive, the target speed vector components are both set to 0 in step 111 of FIG. 14 and the target speed vector components set in step 101 or 102 of FIG. 9 always have greater values. Accordingly, the target cylinder speed determined by the target cylinder speed calculator 9*f* for the direction change control is selected. When the distance Ya is negative and the vertical component Vcy of the target speed vector is negative, the vertical component Vcya after modification is set to 0 in step 102 of FIG. 9 because of h=0 and the vertical component set in step 112 of FIG. 14 always has a greater value. Accordingly, the target cylinder speed determined by the target cylinder speed calculator 9*h* for the restoration control is selected. When the distance Ya is negative and the vertical component Vcy of the target speed vector is positive, the target cylinder speed determined by the target cylinder speed calculator of or 9*h* is selected depending on which one of the vertical component Vcy of the target speed vector Vc set in step 101 of FIG. 9 and the vertical component KYa in step 112 of FIG. 14 is larger. Incidentally, as an alternative, the selector 9*i* may be arranged to take the sum of both the components, for example, rather than selecting the maximum value.

The target pilot pressure calculator 9*j* calculates target pilot pressures for the pilot lines 44*a*, 44*b*, 45*a*, 45*b* from the respective target cylinder speeds to be output which are selected by the target cylinder speed selector 9*i*. This process is a reversal of the calculation executed by the target cylinder speed calculator 9*c*.

The valve command calculator 9*k* calculates, from the target pilot pressures calculated by the target pilot pressure calculator 9*j*, command values for the proportional solenoid valves 10*a*, 10*b*, 11*a*, 11*b* necessary to establish those target pilot pressures. The command values are amplified by amplifiers and output as electric signals to the proportional solenoid valves.

When the direction change control (deceleration control) in step 102 or 102A in the flowchart of FIG. 9 or 12 is carried out, the control in the arm-crowd operation includes boom-up motion and deceleration of arm-crowd motion as explained above. The boom-up motion is effected by outputting an electric signal to the proportional solenoid valve 10*a* associated with the boom-up pilot line 44*a*, and the deceleration of arm-crowd motion is effected by outputting an electric signal to the proportional solenoid valve 11*a* disposed in the arm-crowd side pilot line 45*a*. In the case of the boom-down and arm-dump combined operation, the boom operation mode is switched from boom-down to boom-up and the arm-dump motion is slowed down. The switching from boom-down to boom-up is effected by nulling the electric signal output to the proportional solenoid valve 10*b* disposed in the boom-down pilot line 44*b*, and outputting an electric signal to the proportional solenoid valve 10*a*. The deceleration of the arm-dump motion is effected by outputting an electric signal to the proportional solenoid valve 11*b* disposed in the arm-dump side pilot line 45*b*. In other cases, output to the proportional solenoid valves 10*b*, 11*a*, 11*b* are electric signals corresponding respectively to the pilot pressures in the associated pilot lines so that those pilot pressures are delivered as they are.

In the above arrangement, the control lever units 4*a* to 4*f* make up manipulation means of hydraulic pilot type for instructing operations of the plurality of driven members, i.e., the boom 1*a*, the arm 1*b*, the bucket 1*c*, the upper structure 1*d* and the undercarriage 1*e*. The setter 7 and the front region setting calculator 9*a* make up region setting means for setting a region where the front attachment 1*a* is movable. The angle sensors 8*a* to 8*c* and the inclination angle sensor 8*d* make up first detecting means for detecting status variables with regard to the position and posture of the front attachment 1A. The front posture calculator 9*b* constitutes first calculating means for calculating the position and posture of the front attachment 1A based on signals from the first detecting means.

The target cylinder speed calculator 9*c*, the target end speed vector calculator 9*d*, the direction change controller 9*e*, the post-modification target cylinder speed calculator 9*f*, the target cylinder speed selector 9*i*, the target pilot pressure calculator 9*j*, the valve command calculator 9*k*, and the proportional solenoid valves 10*a* to 11*b* make up first signal modifying means for, based on the control signals from those manipulation means 4*a*, 4*b* of the plurality of manipulation means 4*a* to 4*f* which are associated with the particular front members 1*a*, 1*b* and the values calculated by the first calculating means 9*b*, modifying the control signals from those manipulation means 4*a*, 4*b* for the front attachment 1A so that, when the front attachment 1A is within the set region near the boundary of the set region, the front attachment 1A is moved in the direction along the boundary of the set region while a moving speed of the front attachment 1A in the direction toward the boundary of the set region is reduced.

The target cylinder speed calculator 9*c* and the target end speed vector calculator 9*d* make up second calculating means for calculating the target speed vector of the front attachment 1A based on the control signals from the manipulation means 4*a*, 4*b* associated with the particular front members 1*a*, 1*b*. The direction change controller 9*e* constitutes third calculating means for receiving the values calculated by the first and second calculating means and modifying the target speed vector Vc so that, when the front attachment 1A is within the set region near the boundary of the set region, the vector component Vcx of the target speed vector Vc in the direction along the boundary of the set region remains and the vector component Vcy of the target speed vector Vc in the direction toward the boundary of the set region is reduced. The post-modification target cylinder speed calculators 9*f*, 9*h*, the target cylinder speed selector 9*i*, the target pilot pressure calculator 9*j*, the valve command calculator 9*k*, and the proportional solenoid valves 10*a* to 11*b* make up valve control means for driving the associated hydraulic control valves 5*a*, 5*b* so that the front attachment 1A is moved in accordance with the target speed vector Vc.

The target cylinder speed calculator 9*c*, the target end speed vector calculator 9*d*, the restoration controller 9*g*, the post-modification target cylinder speed calculator 9*h*, the target cylinder speed selector 9*i*, the target pilot pressure calculator 9*j*, the valve command calculator 9*k*, and the proportional solenoid valves 10*a* to 11*b* make up second signal modifying means for, based on the control signals from those manipulation means 4*a*, 4*b* of the plurality of manipulation means 4*a* to 4*f* which are associated with the particular front members 1*a*, 1*b* and the values calculated by the first calculating means 9*b*, modifying the control signals from those manipulation means 4*a*, 4*b* for the front attachment 1A so that, when the front attachment 1A is outside the set region, the front attachment 1A is returned to the set region.

The restoration controller 9*g* constitutes fourth calculating means for receiving the values calculated by the first and second calculating means and modifying the target speed vector Vc so that, when the front attachment 1A is outside the set region, the front attachment 1A is returned to the set region.

The control lever units 4*a* to 4*f* and the pilot lines 44*a* to 49*b* make up a manipulation system for driving the hydraulic control valves 5*a* to 5*f*. The pressure sensors 60*a* to 61*b* constitute second detecting means for detecting respective input amounts from the manipulation means for the front attachment. The target cylinder speed calculator 9*c* and the target end speed vector calculator 9*d* making up the second calculating means are means for calculating the target speed vector of the front attachment 1A based on signals from the second detecting means. Of the components making up the valve control means, the post-modification target cylinder speed calculators 9*f*, 9*h*, the target cylinder speed selector 9*i*, and the target pilot pressure calculator 9*j* make up fifth calculating means for calculating target pilot pressures for driving the corresponding hydraulic control valves 5*a*, 5*b* based on the modified target speed vector. The valve command calculator 9*k* and the proportional solenoid valves 10*a* to 11*b* make up pilot control means for controlling the manipulation system so that the calculated target pilot pressures are established.

The pilot line 44*a* constitutes a first pilot line for introducing a pilot pressure to the corresponding hydraulic control valve 5*a* so that the front attachment 1A is moved away from the set region. The post-modification target cylinder speed calculators 9*f*, 9*h*, the target cylinder speed selector 9*i*, and the target pilot pressure calculator 9*j* make up means for calculating the target pilot pressure in the first pilot line based on the modified target speed vector. The valve command calculator 9*k* constitutes means for outputting a first electric signal corresponding to that target pilot pressure. The proportional solenoid valve 10*a* constitutes electro-hydraulic converting means for converting the first electric signal into a hydraulic pressure and outputting a control pressure corresponding to the target pilot pressure. The shuttle valve 12 constitutes higher pressure selecting means for selecting higher one of the pilot pressure in the first pilot line and the control pressure output from the electro-hydraulic converting means, and introducing the selected pressure to the corresponding hydraulic control valve 5*a*.

The pilot lines 44*b*, 45*a*, 45*b* constitute second pilot lines for introducing pilot pressures to the corresponding hydraulic control valves 5*a*, 5*b* so that the front attachment 1A is moved toward the set region. The post-modification target cylinder speed calculators 9*f*, 9*h*, the target cylinder speed selector 9*i*, and the target pilot pressure calculator 9*j* make up means for calculating the target pilot pressures in the second pilot lines based on the modified target speed vector. The valve command calculator 9*k* constitutes means for outputting second electric signals corresponding to the target pilot pressures. The proportional solenoid valves 10*b*, 11*a*, 11*b* constitute pressure reducing means disposed in the second pilot lines and operated in accordance with the second electric signals for reducing the pilot pressures in the second pilot lines to the target pilot pressures.

Operation of this embodiment having the above-explained arrangement will be described below. The following description will be made, by way of example, of the case of crowding the arm with an intention of digging the ground toward the body (i.e., the arm-crowd operation) and the case of operating the bucket end in the direction to push it by the combined operation of boom-down and arm-dump (i.e., the arm-dump combined operation).

When the arm is crowded with an intention of digging the ground toward the body, the end of the bucket 1*c* gradually comes closer to the boundary of the set region. When the distance between the bucket end and the boundary of the set region becomes smaller than Ya1, the direction change controller 9*e* makes modification to reduce the vector component of the target speed vector Vc at the bucket end in the direction toward the boundary of the set region (i.e., the vector component vertical to the boundary), thereby carrying out the direction change control (deceleration control) for the bucket end. At this time, if the software is designed to perform the direction change control in a combination of boom-up motion and deceleration of arm-crowd motion in the post-modification target cylinder speed calculators 9*f*, the calculator 9*f* calculates a cylinder speed in the direction of extending the boom cylinder 3*a* and a cylinder speed in the direction of extending the arm cylinder 3*b*, the target pilot pressure calculator 9*j* calculates a target pilot pressure in the boom-up side pilot line 44*a* and a target pilot pressure in the arm-crowd side pilot line 45*a*, and the valve command calculator 9*k* outputs electric signals to the proportional solenoid valves 10*a*, 11*a*. Therefore, the proportional solenoid valve 10*a* outputs a control pressure corresponding to the target pilot pressure calculated by the calculator 9*j*, and the control pressure is selected by the shuttle valve 12 and introduced to the boom-up side hydraulic driving sector 50*a* of the boom flow control valve 5*a*. On the other hand, the proportional solenoid valve 11*a* reduces the pilot pressure in the pilot line 45*a* to the target pilot pressure calculated by the calculator 9*j* in accordance with the electric signal, and outputs the reduced pilot pressure to the arm-crowd side hydraulic driving sector 51*a* of the arm flow control valve 5*b*. With such operations of the proportional solenoid valves 10*a*, 11*a*, the movement of the bucket end in the direction vertical to the boundary of the set region is controlled to slow down, but the speed component in the direction along the boundary of the set region is not reduced. Accordingly, the end of the bucket 1*c* can be moved along the boundary of the set region as shown in FIG. 11. It is thus possible to efficiently perform excavation while limiting a region where the end of the bucket 1*c* is movable.

If the movement of the front attachment 1A is fast when the end of the bucket 1*c* is controlled to speed down near the boundary of the set region within it as described above, the end of the bucket 1*c* may go out of the set region to some extent due to a delay in control response and the inertia of the front attachment 1A. In this embodiment, when such an event occurs, the restoration controller 9*g* implements the restoration control by modifying the target speed vector Vc so that the end of the bucket 1*c* is returned to the set region. At this time, if the software is designed to perform the restoration control in a combination of boom-up motion and deceleration of arm-crowd motion in the post-modification target cylinder speed calculator 9*h*, as with the above case of the direction change control, the calculator 9*h* calculates a cylinder speed in the direction of extending the boom cylinder 3*a* and a cylinder speed in the direction of extending the arm cylinder 3*b*, the target pilot pressure calculator 9*j* calculates a target pilot pressure in the boom-up side pilot line 44*a* and a target pilot pressure in the arm-crowd side pilot line 45*a*, and the valve command calculator 9*k* outputs electric signals to the proportional solenoid valves 10*a*, 11*a*. As a result, the proportional solenoid valves 10*a*, 11*a* are operated as explained above so that the bucket end is controlled to quickly return to the set region, allowing excavation to be carried out on the boundary of the set region. Therefore, even if the front attachment 1A is moved fast, the bucket end can be moved along the boundary of the set region and the excavation within a limited region can precisely be implemented.

Also, in the restoration control, since the movement of the bucket end is already slowed down through the direction change control as explained above, the amount by which the bucket end goes out of the set region is so reduced that the shock occurred upon returning to the set region is greatly alleviated. Therefore, even if the front attachment 1A is moved fast, the end of the bucket 1*c* can smoothly be moved along the boundary of the set region and the excavation within a limited region can smoothly be implemented.

Further, in the restoration control of this embodiment, since the vector component of the target speed vector Vc vertical to the boundary of the set region is modified so as to leave the speed component in the direction along the boundary of the set region, the end of the bucket 1*c* can also smoothly be moved outside the set region along the boundary of the set region. In this connection, since the vector component in the direction toward the boundary of the set region is modified to become smaller as the distance Ya between the end of the bucket 1*c* and the boundary of the set region decreases, the path along which the bucket end is moved under the restoration control based on the target speed vector Vca after modification is in the form of a curved line which is curved to come closer to a parallel line while approaching the boundary of the set region, as shown in FIG. 15. This enables the bucket end to be returned to the set region in a smoother manner.

When digging work is performed while moving the bucket end along a predetermined path, e.g., the boundary of the set region, it is usually required for the operator to control the movement of the bucket end in the hydraulic pilot type system by manipulating at least two control levers of the boom control lever unit 4*a* and the arm control l ever unit 4*b*. In this embodiment, the operator may of course manipulate both the control levers of the boom and arm control lever units 4*a*, 4*b* simultaneously, but if the operator manipulates one arm control lever, the cylinder speeds of the hydraulic cylinders necessary for the direction change control or the restoration control are calculated by the calculator 9*f* or 9*h* as explained above, causing the bucket end to move along the boundary of the set region. Accordingly, the digging work along the boundary of the set region can be implemented by manipulating just one arm control lever.

During the digging work along the boundary of the set region, it is often required to manually raise the boom 1*a* in such an case as that a lot of earth has entered the bucket 1*c*, or there is an obstacle in the movement path of the bucket end, or digging resistance is to be reduced because the front attachment has stalled due to large digging resistance. In that case, the boom can be raised by manipulating the boom control lever unit 4*a* in the boom-up direction. Specifically, by so operating, a pilot pressure is established in the boom-up side pilot line 44*a* and, if the pilot pressure exceeds the control pressure produced from the proportional solenoid valve 10*a*, the pilot pressure is selected by the shuttle valve 12 to move up the boom.

When the arm is dumped from the position near the body (nearby position) in the combined operation of boom-down and arm-dump for moving the bucket end in the direction to put it, the target vector in the direction of going out of the set region is given. In this case, too, when the distance between the bucket end and the boundary of the set region becomes smaller than Ya1, the direction change controller 9*e* makes modification of the target speed vector Vc in a like manner to the above for carrying out the direction change control (deceleration control) for the bucket end. At this time, if the software is designed to perform the direction change control in a combination of boom-up motion and deceleration of arm-dump motion in the post-modification target cylinder speed calculators 9*f*, the calculator 9*f* calculates a cylinder speed in the direction of extending the boom cylinder 3*a* and a cylinder speed in the direction of contracting the arm cylinder 3*b*, the target pilot pressure calculator 9*j* calculates a target pilot pressure in the boom-up side pilot line 44*a* and a target pilot pressure in the arm-dump side pilot line 45*b* while setting the target pilot pressure in the boom-down side pilot line 44*b* to 0, and the valve command calculator 9*k* turns off the output the proportional solenoid valve 10*b* and outputs electric signals to the proportional solenoid valves 10*a*, 11*b*. Therefore, the proportional solenoid valve 10*b* reduces the pilot pressure in the pilot line 44*b* to 0, the proportional solenoid valve 10*a* outputs a control pressure corresponding to the target pilot pressure as the pilot pressure in the pilot line 44*a*, and the proportional solenoid valve 11*b* reduces the pilot pressure in the pilot line 45*b* to the target pilot pressure. With such operations of the proportional solenoid valves 10*a*, 11*a*, 11*b*, the direction change control is performed as with the above case of the arm-crowd operation. It is thus possible to quickly move the end of the bucket 1*c* along the boundary of the set region and to efficiently perform excavation while limiting a region where the end of the bucket 1*c* is movable.

If the end of the bucket 1*c* may go out of the set region to some extent, the restoration controller 9*g* implements the restoration control by modifying the target speed vector Vc. At this time, if the software is designed to perform the restoration control in a combination of boom-up motion and deceleration of arm-dump motion in the post-modification target cylinder speed calculator 9*h*, as with the above case of the direction change control, the calculator 9*h* calculates a cylinder speed in the direction of extending the boom cylinder 3*a* and a cylinder speed in the direction of contracting the arm cylinder 3*b*, the target pilot pressure calculator 9*j* calculates a target pilot pressure in the boom-up side pilot line 44*a* and a target pilot pressure in the arm-dump side pilot line 45*b*, and the valve command calculator 9*k* outputs electric signals to the proportional solenoid valves 10*a*, 11*b*. As a result, the bucket end is controlled to quickly return to the set region, allowing excavation to be carried out on the boundary of the set region. As with the above case of the arm-crowd operation, therefore, even if the front attachment 1A is moved fast, the bucket end can smoothly be moved along the boundary of the set region and the excavation within a limited region can be implemented smoothly and precisely.

Further, if the control lever is manipulated to raise the boom during the control process, the boom can be moved up as with the above case of the arm-crowd operation.

With this embodiment, as described above, when the end of the bucket 1*c* is away from the boundary of the set region, the target speed vector Vc is not modified and the work can be implemented in a normal manner. When the end of the bucket 1*c* comes closer to the boundary of the set region within it, the direction change control is performed so that the end of the bucket 1*c* can be moved along the boundary of the set region. It is therefore possible to efficiently perform excavation while limiting a region where the end of the bucket 1*c* is movable.

If the movement of the front attachment 1A is fast and the end of the bucket 1*c* goes out of the set region, since the restoration control is effected to control the end of the bucket 1*c* to quickly return to the set region, the bucket end can precisely be moved along the boundary of the set region and the excavation within a limited region can precisely be implemented.

Since the direction change control (deceleration control) is effected prior to entering the restoration control, the shock occurred upon returning to the set region is greatly alleviated. Therefore, even if the front attachment 1A is moved fast, the end of the bucket 1*c* can smoothly be moved along the boundary of the set region and the excavation within a limited region can smoothly be implemented.

Further, since the speed component in the direction along the boundary of the set region is not reduced in the restoration control, the end of the bucket 1*c* can also smoothly be moved outside the set region along the boundary of the set region. In addition, since the vector component in the direction toward the boundary of the set region is modified to become smaller as the distance Ya between the end of the bucket 1*c* and the boundary of the set region decreases, the bucket end can be returned to the set region in a smoother manner.

As a result of enabling the end of the bucket 1*c* to be smoothly moved along the boundary of the set region, by operating the bucket 1*c* to move toward the body, it is possible to implement the excavation as if the path control along the boundary of the set region is performed.

Since the direction change control and the restoration control are performed by incorporating the proportional solenoid valves 10*a,* 10*b,* 11*a,* 11*b* and the shuttle valve 12 in the pilot lines 44*a,* 44*b,* 45*a,* 45*b* and controlling the pilot pressures, the function of efficiently implementing the excavation within a limited region can easily be added to any system having the control lever units 4*a,* 4*b* of hydraulic pilot type.

Additionally, in a hydraulic excavator having the control lever units 4*a,* 4*b* of hydraulic pilot type, the digging work along the boundary of the set region can be implemented by manipulating just one arm control lever.

Second Embodiment

Figure 16:
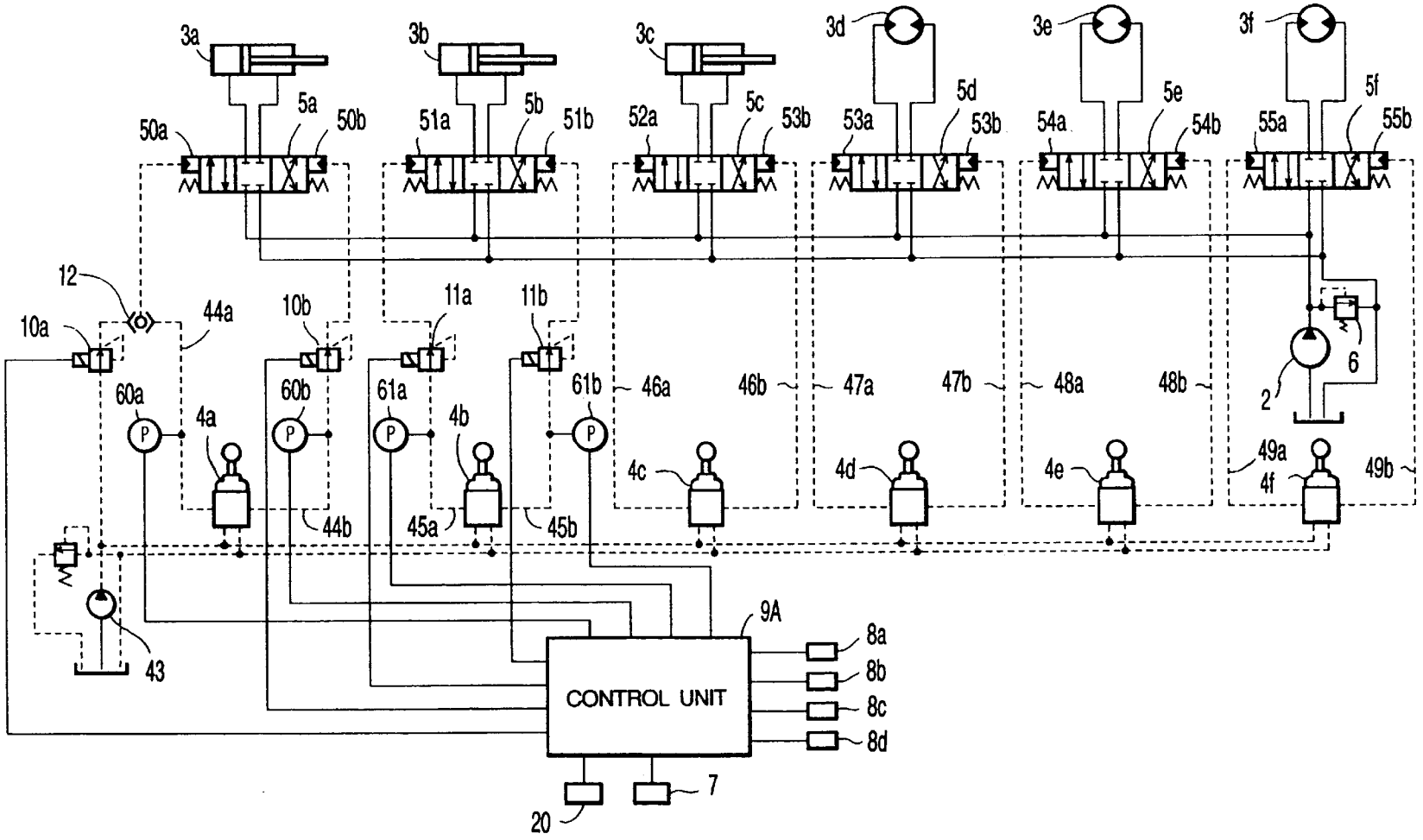
FIG. 16 is a diagram showing a region limiting excavation control system for a construction machine according to a second embodiment of the present invention, along with a hydraulic drive system for the control system.
Figure 17:
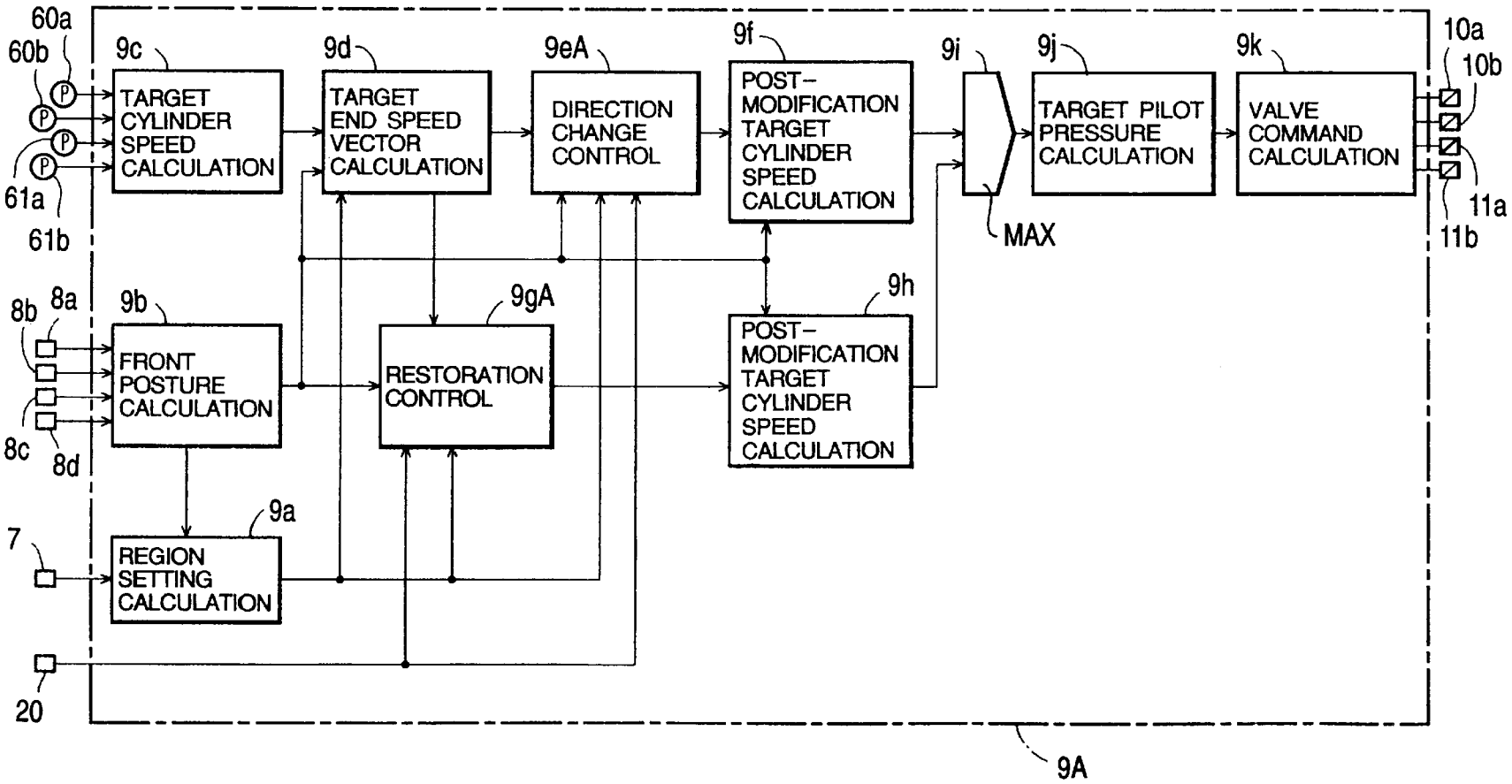
FIG. 17 is a functional block diagram showing control functions of a control unit.

A second embodiment of the present invention will be described with reference to FIGS. 16 to 23. This embodiment intends to switch a work mode so that the bucket end can slowly be moved if a high degree of finish accuracy is needed. In FIGS. 16 and 17, identical members and functions to those shown in FIGS. 1 and 4 are denoted by the same reference numerals.

Referring to FIG. 16, a region limiting excavation control system of this embodiment includes, in addition to the arrangement of the first embodiment, a mode switch 20 for selecting a work mode. There are two work modes, i.e., a normal mode which is selected in the normal work, and a finish mode which is selected when the work requires a high degree of finish accuracy. Any of the two modes can be selected by the operator manipulating the mode switch 20. A selection signal from the mode switch 20 is input to a control unit 9A.

As shown in FIG. 17, the control unit 9A modifies the target speed vector by using the selection signal from the mode switch 20 as well as in a direction change controller 9eA and a restoration controller 9gA.

When the end of the bucket 1*c* is positioned within the set region near the boundary thereof and the target speed vector Vc has a component in the direction toward the boundary of the set region, the direction change controller 9eA makes a modification such that the vertical vector component of the target speed vector is gradually reduced as the bucket end comes closer to the boundary of the set region, and that when the mode switch 20 selects the finish mode, the vector component of the target speed vector in the direction along the boundary of the set region becomes smaller than in the case of selecting the normal mode.

Figure 18:
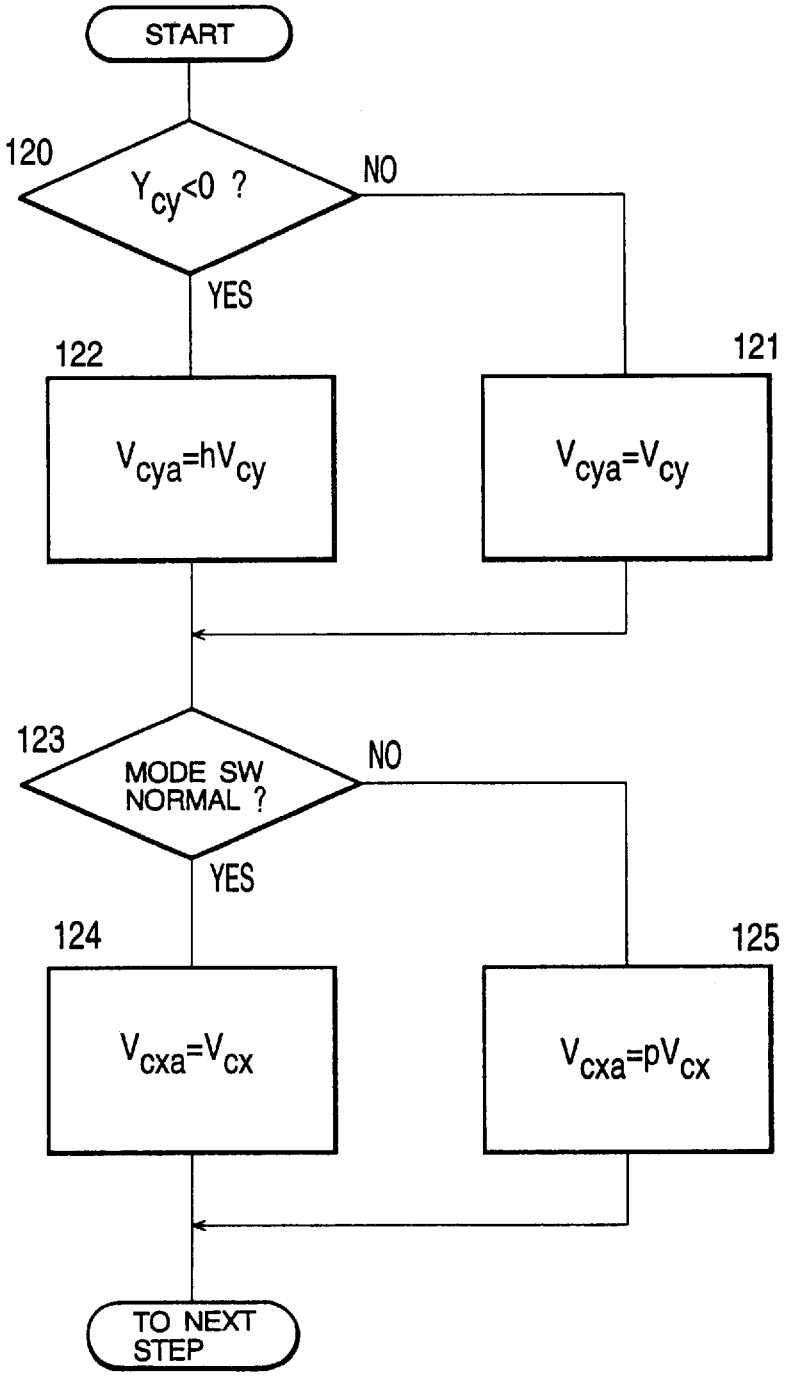
FIG. 18 is a flowchart showing processing procedures executed in a direction change controller.

FIG. 18 is a flowchart showing control procedures executed in the direction change controller 9eA. First, in step 120, whether the component of the target speed vector Vc vertical to the boundary of the set region, i.e., the Ya-coordinate value Vcy on the XaYa-coordinate system, is positive or negative is determined. If the Ya-coordinate value Vcy is positive, this means the speed vector being oriented such that the bucket end moves away from the boundary of the set region. Therefore, the control procedure goes to step 121 where the Ya-coordinate value Vcy of the target speed vector Vc is set, as it is, to a vector component Vcya after modification. If the Ya-coordinate value Vcy is negative, this means the speed vector being oriented such that the bucket end moves closer to the boundary of the set region. Therefore, the control procedure goes to step 122 where, for the direction change control, a value obtained by multiplying the Ya-coordinate value Vcy of the target speed vector Vc by the coefficient h is set to the vector component Vcya after modification as with the first embodiment.

Then, it is determined in step 123 whether the mode switch 20 selects the normal mode or not. If the normal mode is selected, the control procedure goes to step 124 where the Xa-coordinate value Vcx of the target speed vector Vc is set, as it is, to a vector component Vcxa after modification. If the normal mode is not selected, this means that the finish mode is selected and, therefore, the control procedure goes to step 125 where, for the finish control, a value obtained by multiplying the Xa-coordinate value Vcx of the target speed vector Vc by a coefficient p is set to the vector component Vcxa after modification.

Figure 19:
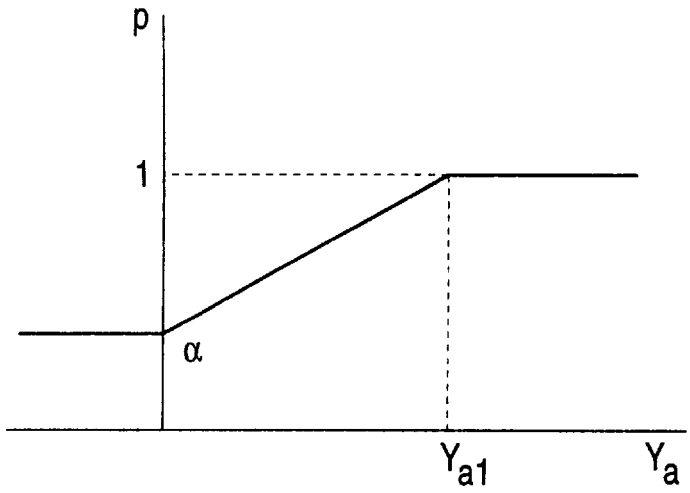
FIG. 19 is a graph showing the relationship between a distance Ya from the bucket end to the boundary of the set region and a coefficient p in the direction change controller.

Here, as shown in FIG. 19, the coefficient p is a value which takes 1 when the distance Ya between the end of the bucket 1*c* and the boundary of the set region is larger than the preset value Ya1, which is gradually reduced from 1 as the distance Ya decreases when the distance Ya is smaller than the preset value Ya1, and which takes a predetermined value $\alpha$ less than 1 when the distance Ya becomes zero, i.e., when the bucket end reaches the boundary of the set region. Such a relationship between p and Ya is stored in a memory of the control unit 9A.

In the direction change controller 9eA, the end position of the bucket 1*c* determined by the front posture calculator 9*b* is converted into coordinate values on the XaYa-coordinate system by using the transform data from the XY-coordinate system to the XaYa-coordinate system previously calculated by the region setting calculator 9*a*. Then, the distance Ya between the end of the bucket 1*c* and the boundary of the set region is determined from the converted Ya-coordinate value, and the coefficient p is determined from the distance Ya based on the relationship of FIG. 19.

Thus, when the finish mode is selected, the movement of the bucket end along the boundary of the set region is also slowed down depending on the distance Ya by modifying not only the vertical vector component Vcy of the target speed vector Vc but also the parallel vector component Vcx thereof as described above. Therefore, the bucket end can slowly be moved along the boundary of the set region and the finishing work can be implemented with high accuracy. Also, regardless of whether the bucket end moves toward or away from the boundary of the set region, since the vertical vector component Vcy of the target speed vector Vc is always reduced, speed change of the bucket end along the boundary of the set region is small when the boom is moved in either vertical direction, i.e., up and down, during the combined operation of the boom and the arm. As a result, operability is much improved.

Figure 20:
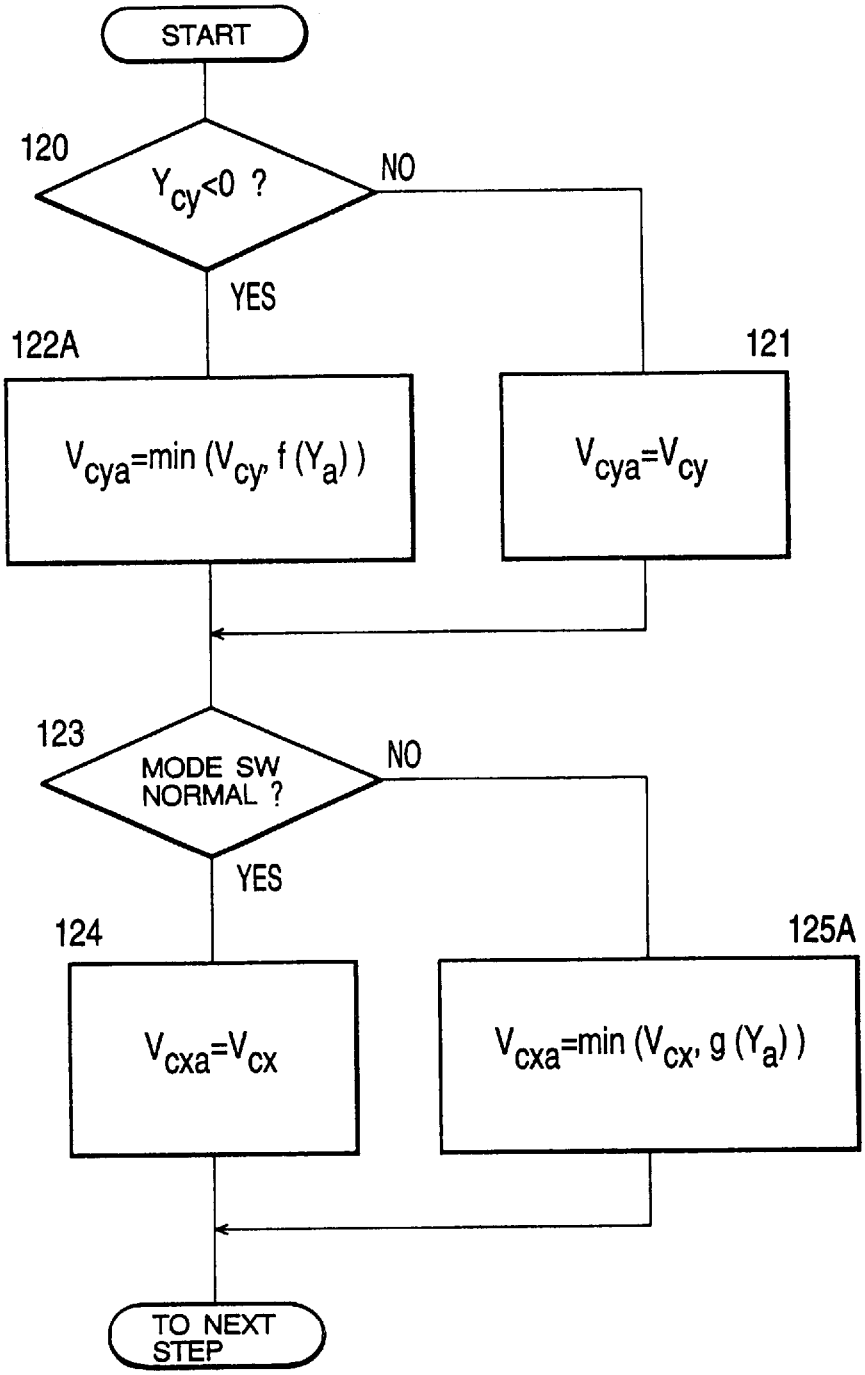
FIG. 20 is a flowchart showing other processing procedures executed in the direction change controller.

FIG. 20 is a flowchart showing another example of control procedures executed in the direction change controller 9eA. In this example, if the component Vcy of the target speed vector Vc vertical to the boundary of the set region (i.e., the Ya-coordinate value of the target speed vector Vc) is determined to be negative in step 120, the control procedure goes to step 122A where the smaller one of Vcy and f(Ya) is set to the vector component Vcya after modification similarly to step 102A in FIG. 12 for the first embodiment.

Figure 21:
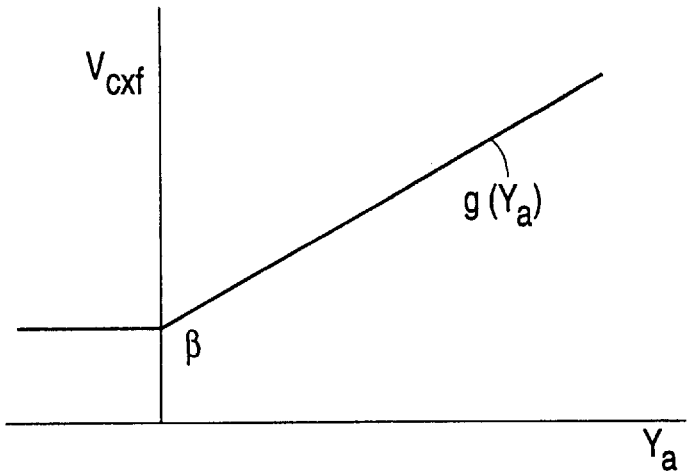
FIG. 21 is a graph showing the relationship between the distance Ya and a function Vcyx=F(ya) in the direction change controller.

Further, if it is determined in step 123 that the mode switch 20 does not select the normal mode, the control procedure goes to step 125A where a decelerated Xa-coordinate value Vcxf corresponding to the distance Ya between the end of the bucket 1*c* and the boundary of the set region is determined from the functional relationship of Vcxf=g(Ya), shown in FIG. 21, stored in the memory of the control unit 9A and the smaller one of the Xa-coordinate values Vcxf and Vcx is then set to the vector component Vcxa after modification. This provides an advantage that when the end of the bucket 1*c* is slowly moved, the bucket speed is not reduced any longer even if the bucket end comes closer to the boundary of the set region, allowing the operator to carry out the operation as per manipulation of the control lever.

In the restoration controller 9gA, when the end of the bucket 1*c* goes out of the set region, the target speed vector is modified depending on the distance from the boundary of the set region so that the bucket end is returned to the set region and, when the mode switch 20 is manipulated to select the finish mode, the vector component of the target speed vector in the direction along the boundary of the set region is modified to become smaller than in the case of selecting the normal mode.

Figure 22:
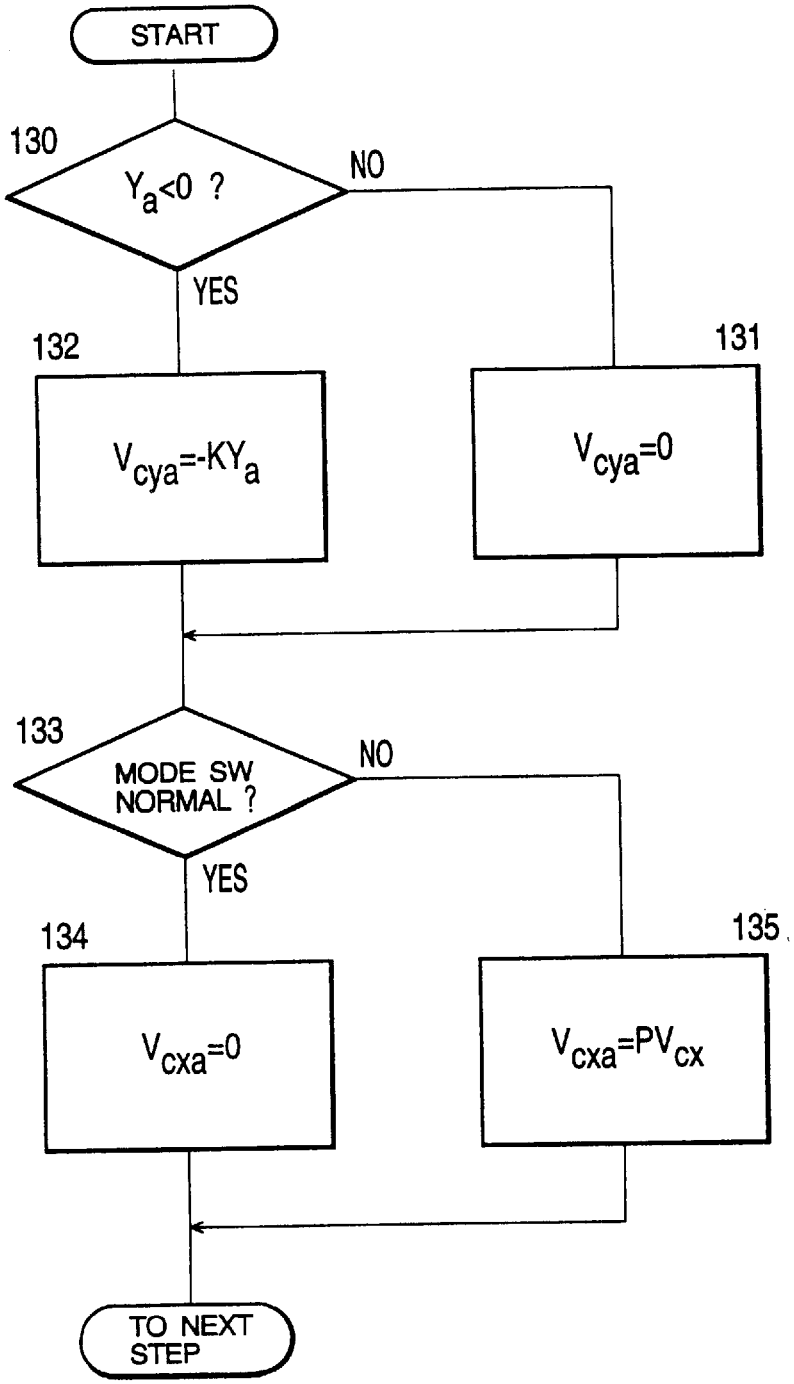
FIG. 22 is a flowchart showing processing procedures executed in a restoration controller.

FIG. 22 is a flowchart showing control procedures executed in the restoration controller 9gA. First, in step 130, whether the distance Ya between the end of the bucket 1*c* and the boundary of the set region is positive or negative is determined. If the distance Ya is positive, this means that the bucket end is still within the set region. Therefore, the control procedure goes to step 131 where the Ya-coordinate value Vcya of the target speed vector Vc is set to 0 to carry out the direction change control explained above with priority. If the distance Ya is negative, this means that the bucket end has moved out of the boundary of the set region. Therefore, the control procedure goes to step 132 where, for the restoration control, a value obtained by multiplying the distance Ya between the bucket end and the boundary of the set region by the coefficient—K is set to the vector component Vcya after modification as with the first embodiment.

Then, it is determined in step 133 whether the mode switch 20 selects the normal mode or not. If the normal mode is selected, the control procedure goes to step 134 where the Xa-coordinate value Vcxa of the target speed vector Vc is set to 0 to carry out the direction change control with priority. If the normal mode is not selected, this means that the finish mode is selected and, therefore, the control procedure goes to step 135 where a value obtained by multiplying the Xa-coordinate value Vcx by a coefficient P is set to the vector component Vcxa after modification.

Figure 23:
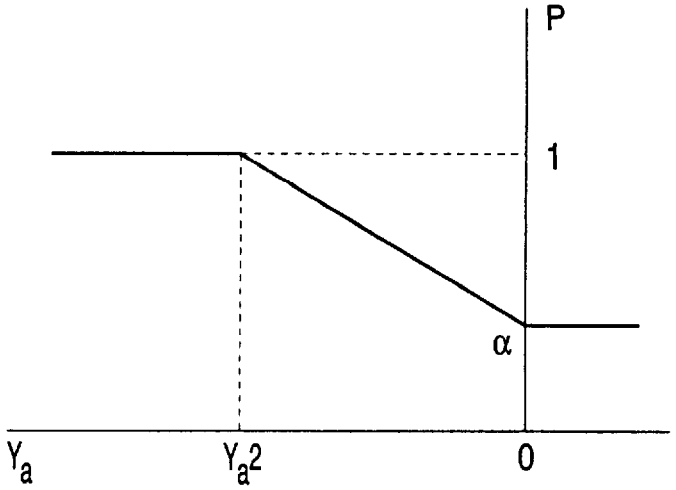
FIG. 23 is a graph showing the relationship between the distance Ya and the coefficient P in the restoration controller.

Here, the coefficient P may be a constant not greater than 1, but it is preferably a value, as shown in FIG. 23, which takes 1 when the distance Ya between the end of the bucket 1*c* and the boundary of the set region is larger than a preset value Ya2, which is gradually reduced from 1 as the distance Ya decreases when the distance Ya is smaller than the preset value Ya2, and which takes a predetermined value $\alpha$ less than 1 when the distance Ya becomes zero, i.e., when the bucket end reaches the boundary of the set region. Such a relationship between P and Ya is stored in the memory of the control unit 9A.

Thus, in the restoration control, too, when the finish mode is selected, the movement of the bucket end along the boundary of the set region is also slowed down depending on the distance Ya by modifying not only the vertical vector component Vcy of the target speed vector Vc but also the parallel vector component Vcx thereof as described above. Therefore, the bucket end can slowly be moved along the boundary of the set region and the finishing work can be implemented with high accuracy.

With this embodiment, since the working speed can be set in accordance with the mode selected by the mode switch 20, it is possible to select the finishing work with great weight imposed on accuracy and the working speed. Accordingly, the work mode can optionally be set depending on the kind of work such that the bucket end is slowly moved when a high degree of finish accuracy is required, and it is moved fast when finish accuracy is not so required, but the working speed is important. As a result, working efficiency can be improved.

Third Embodiment

Figure 24:
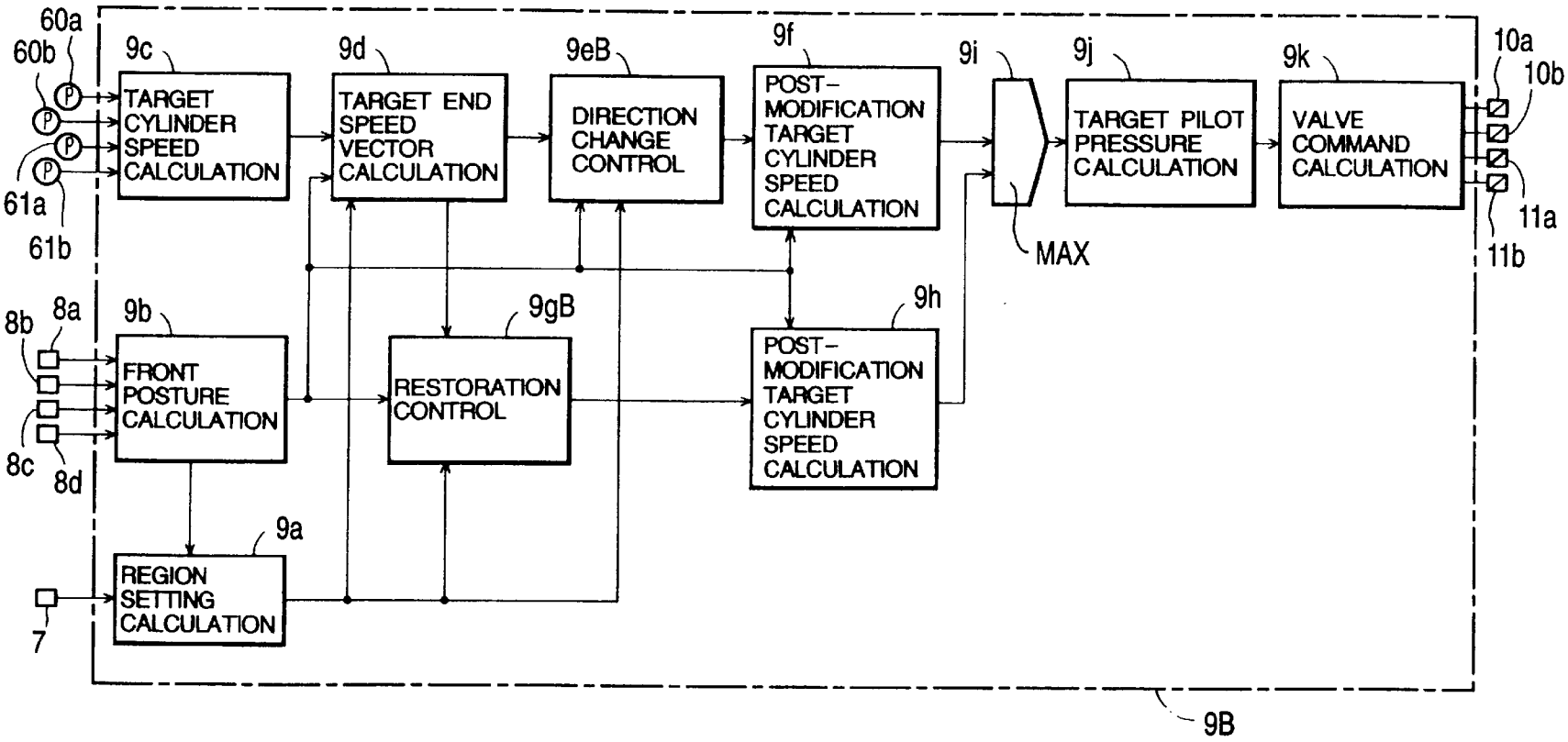
FIG. 24 is a functional block diagram showing control functions of a control unit in a region limiting excavation control system for a construction machine according to a third embodiment of the present invention.

A third embodiment of the present invention will be described with reference to FIGS. 24 to 27. This embodiment intends to improve control accuracy in a working posture where the front attachment has a long reach. In FIG. 24, identical functions to those shown in FIG. 4 are denoted by the same reference numerals.

A hardware configuration of a region limiting excavation control system of this embodiment is the same as in the first embodiment shown in FIG. 1. In a control unit 9B, a direction change controller 9eB and a restoration controller 9gb shown in FIG. 24 have different functions from those in the first embodiment.

When the end of the bucket 1*c* is positioned within the set region near the boundary thereof and the target speed vector Vc has a component in the direction toward the boundary of the set region, the direction change controller 9eB makes modification such that the vertical vector component of the target speed vector is gradually reduced as the bucket end comes closer to the boundary of the set region, and that if the distance between a particular location of the front attachment, e.g., the bucket end, and the body becomes large, the vector component of the target speed vector in the direction along the boundary of the set region is also reduced.

Figure 25:
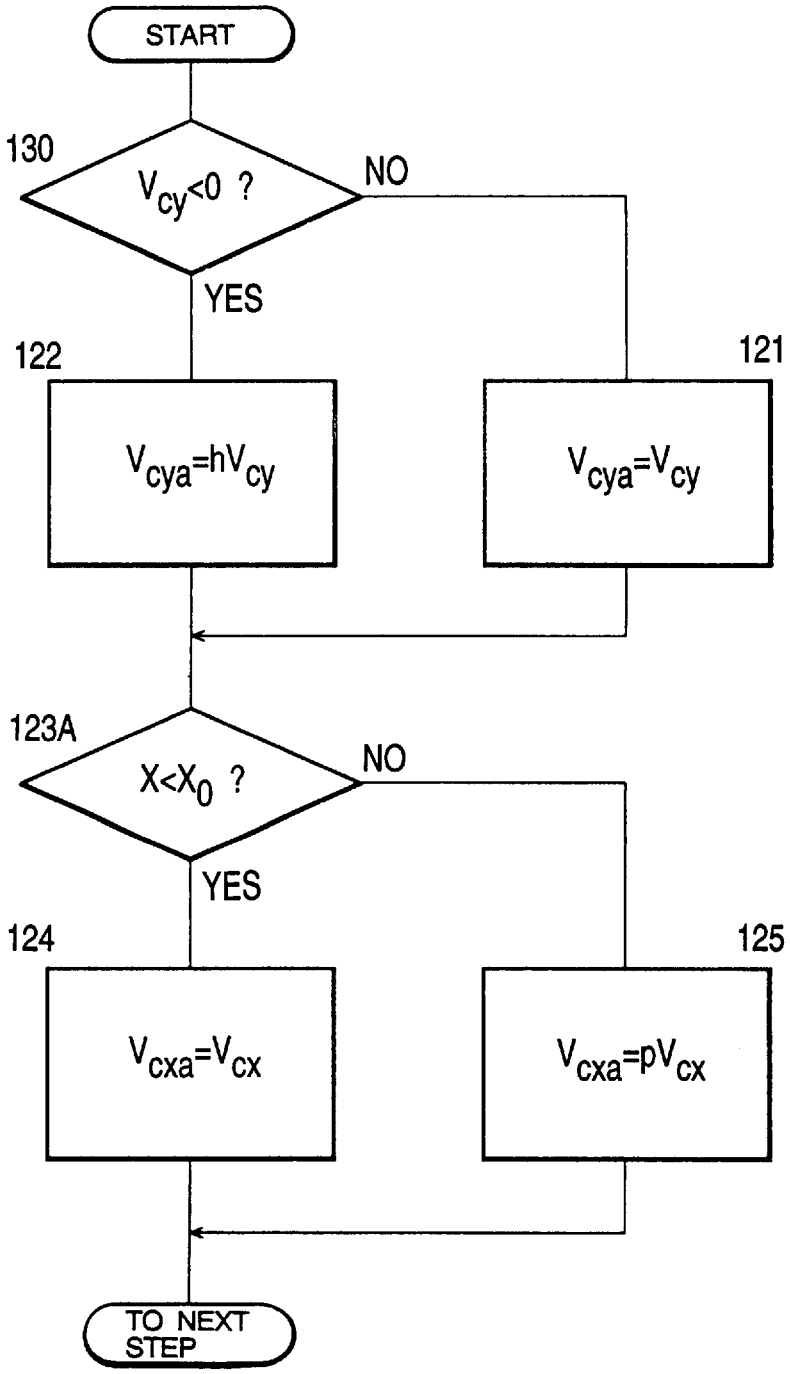
FIG. 25 is a flowchart showing processing procedures executed in a direction change controller.

FIG. 25 is a flowchart showing control procedures executed in the direction change controller 9eB. As seen from comparing FIG. 25 and FIG. 18, only step 123A is different from the flowchart for the second embodiment, and other steps are all the same as in the second embodiment. In step 123A, whether a position X of the bucket end in the X-direction of the XY-coordinate system (see FIG. 5) is smaller than a predetermined value Xo or not is determined. If so (X<Xo), this means the front attachment being in a working posture in which the front reach is not long. Therefore, the control procedure goes to step 124 where the Xa-coordinate value Vcx of the target speed vector Vc is set, as it is, to a vector component Vcya after modification. If the position X exceeds the predetermined value X (X≧Xo), this means the front attachment being in a working posture in which the front reach is long. Therefore, the control procedure goes to step 125 where, for improving working accuracy, a value obtained by multiplying the Xa-coordinate value Vcx of the target speed vector Vc by a coefficient p is set to the vector component Vcxa after modification. Here, the component p is the same as shown in FIG. 19 for the second embodiment.

Thus, when the front attachment takes a long reach working posture, the movement of the bucket end along the boundary of the set region is also slowed down depending on the distance Ya by modifying not only the vertical vector component Vcy of the target speed vector Vc but also the parallel vector component Vcx thereof as described above. Therefore, the bucket end can slowly be moved along the boundary of the set region even with the front attachment having a long reach, and the finishing work can be implemented with high accuracy. Also, regardless of whether the bucket end moves toward or away from the boundary of the set region, since the vertical vector component Vcy of the target speed vector Vc is always reduced, speed change of the bucket end along the boundary of the set region is small when the boom is moved in either vertical direction, i.e., up and down, during the combined operation of the boom and the arm. As a result, operability is much improved.

Figure 26:
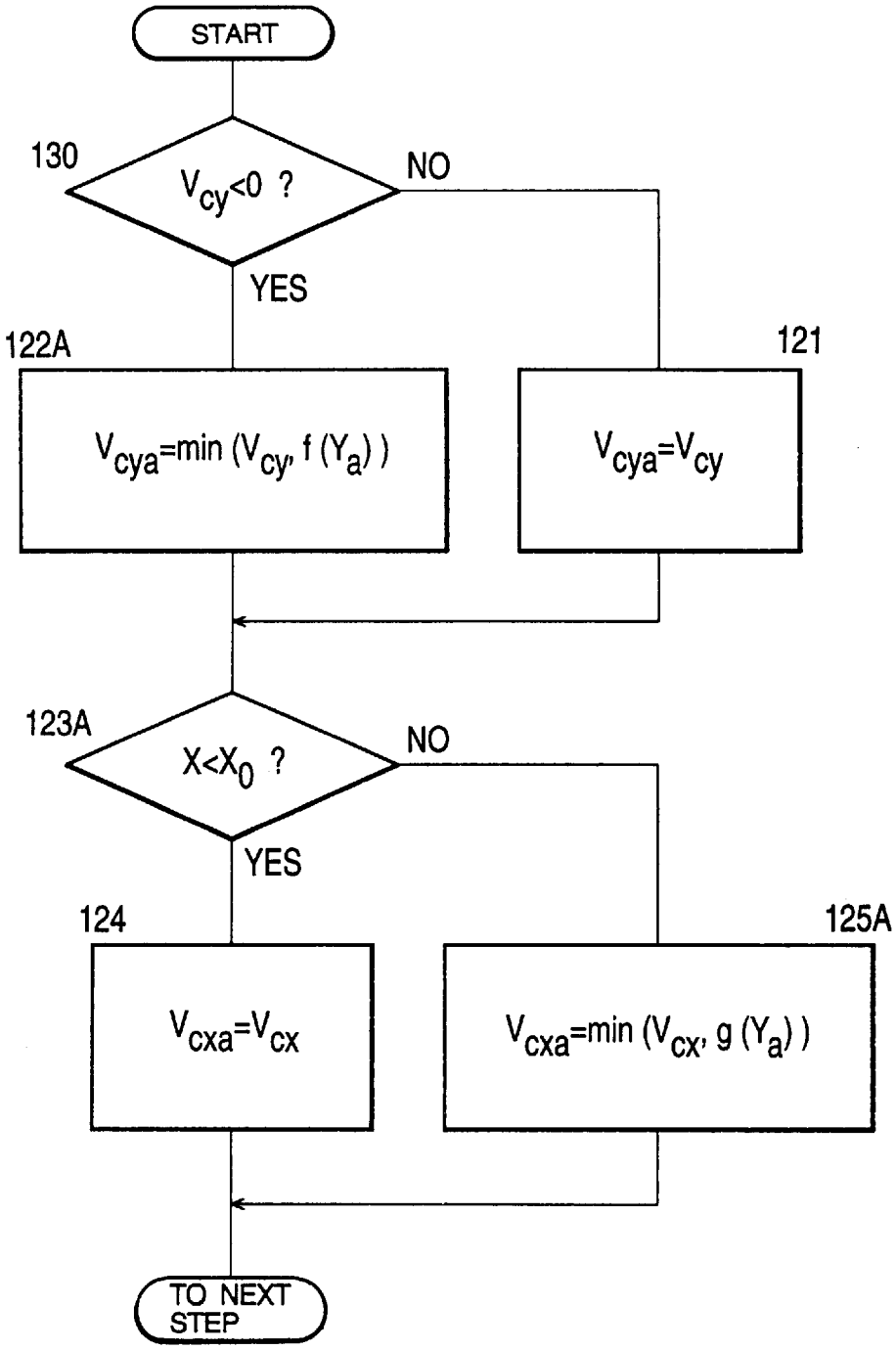
FIG. 26 is a flowchart showing other processing procedures executed in the direction change controller.

FIG. 26 is a flowchart showing another example of control procedures executed in the direction change controller 9eB. In this example, step 123 in FIG. 20 is replaced by step 123A in FIG. 25, and other steps are all the same as in FIG. 20. According to this example, if X≧Xo is satisfied, the control procedure goes to step 125A where smaller one of an Xa-coordinate value g(Ya) and Vcx is set to the vector component Vcxa after modification. This provides an advantage that when the end of the bucket 1*c* is slowly moved, the bucket speed is not reduced any longer even if the bucket end comes closer to the boundary of the set region, allowing the operator to carry out the operation as per manipulation of the control lever.

In the restoration controller 9gB, when the end of the bucket 1*c* goes out of the set region, the target speed vector is modified depending on the distance from the boundary of the set region so that the bucket end is returned to the set region and, when a particular variable of the front attachment, e.g., the distance between the bucket end and the body, increased, the vector component of the target speed vector in the direction along the boundary of the set region is modified to become smaller.

Figure 27:
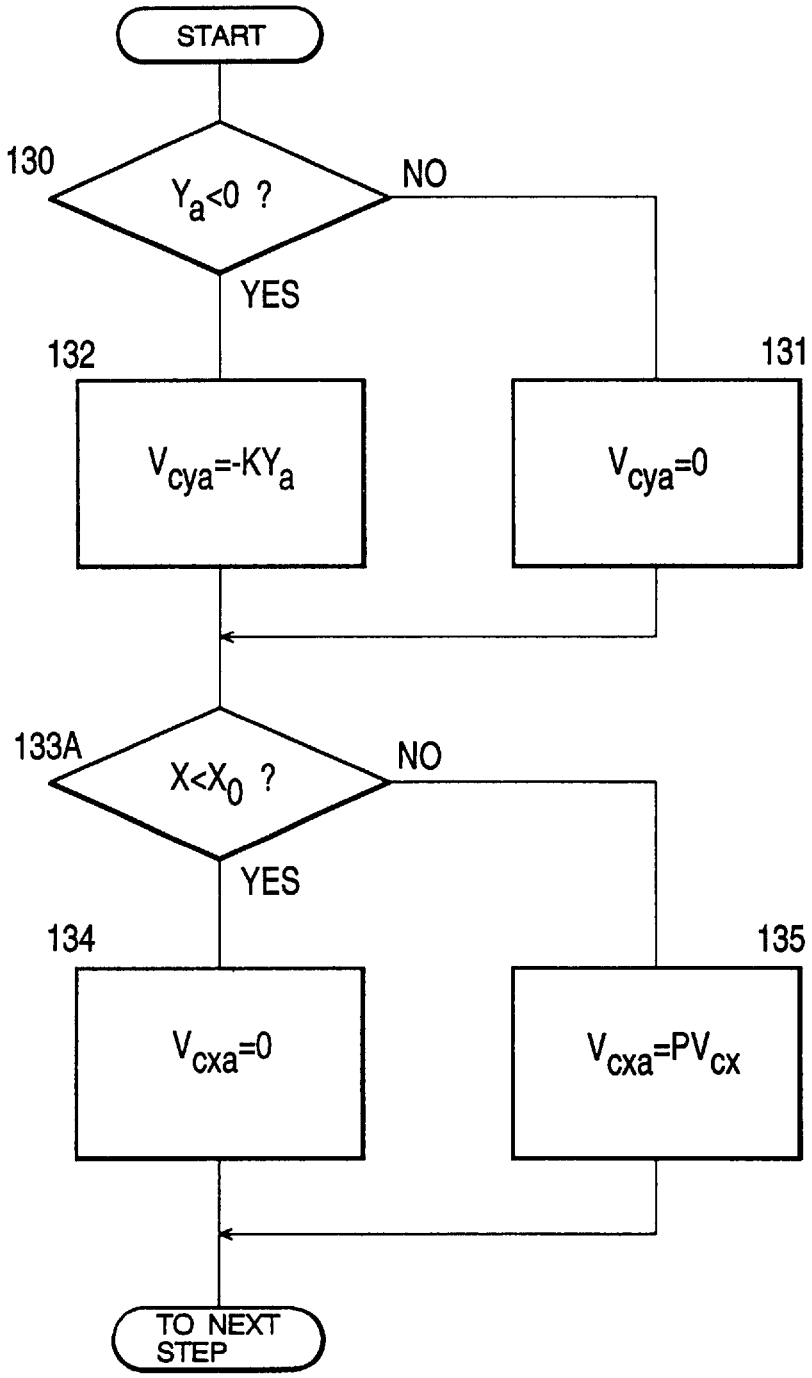
FIG. 27 is a flowchart showing processing procedures executed in a restoration controller.

FIG. 27 is a flowchart showing control procedures executed in the restoration controller 9gB. As seen from comparing FIG. 27 and FIG. 22, only step 133A is different from the flowchart for the second embodiment, and other steps are all the same as in the second embodiment. In step 133A, as with step 123A in FIG. 25, whether the position X of the bucket end in the X-direction of the XY-coordinate system (see FIG. 5) is smaller than the predetermined value Xo or not is determined. If so (X<Xo), the control procedure goes to step 134 where the Xa-coordinate value Vcx of the target speed vector Vc is set to 0. If X≧Xo is satisfied, the control procedure goes to step 135 where, for improving working accuracy, a value obtained by multiplying the Xa-coordinate value Vcx of the target speed vector Vc by the coefficient P is set to the vector component Vcxa after modification.

Thus, in the restoration control, too, when the front attachment takes a long reach working posture, the movement of the bucket end along the boundary of the set region is also slowed down depending on the distance Ya by modifying not only the vertical vector component Vcy of the target speed vector Vc but also the parallel vector component Vcx thereof as described above. Therefore, the bucket end can slowly be moved along the boundary of the set region and the finishing work can be implemented with high accuracy.

With this embodiment, the moving speed of the bucket end along the boundary of the set region is reduced in such a working posture that change in rotational angle of the front attachment 1A (i.e., displacement of the bucket end) is increased with respect to the amounts by which the boom cylinder 3*a* and the arm cylinder 3*b* are extended or contracted, as resulted when the front attachment is located near its maximum reach. As a result, control accuracy is improved correspondingly.

Fourth Embodiment

A fourth embodiment of the present invention will be described with reference to FIGS. 28 to 32. In this embodiment, the present invention is applied to a hydraulic excavator employing electric lever units as the control lever units. In the drawings, identical members to those shown in FIG. 1 are denoted by the same reference numerals.

Figure 28:
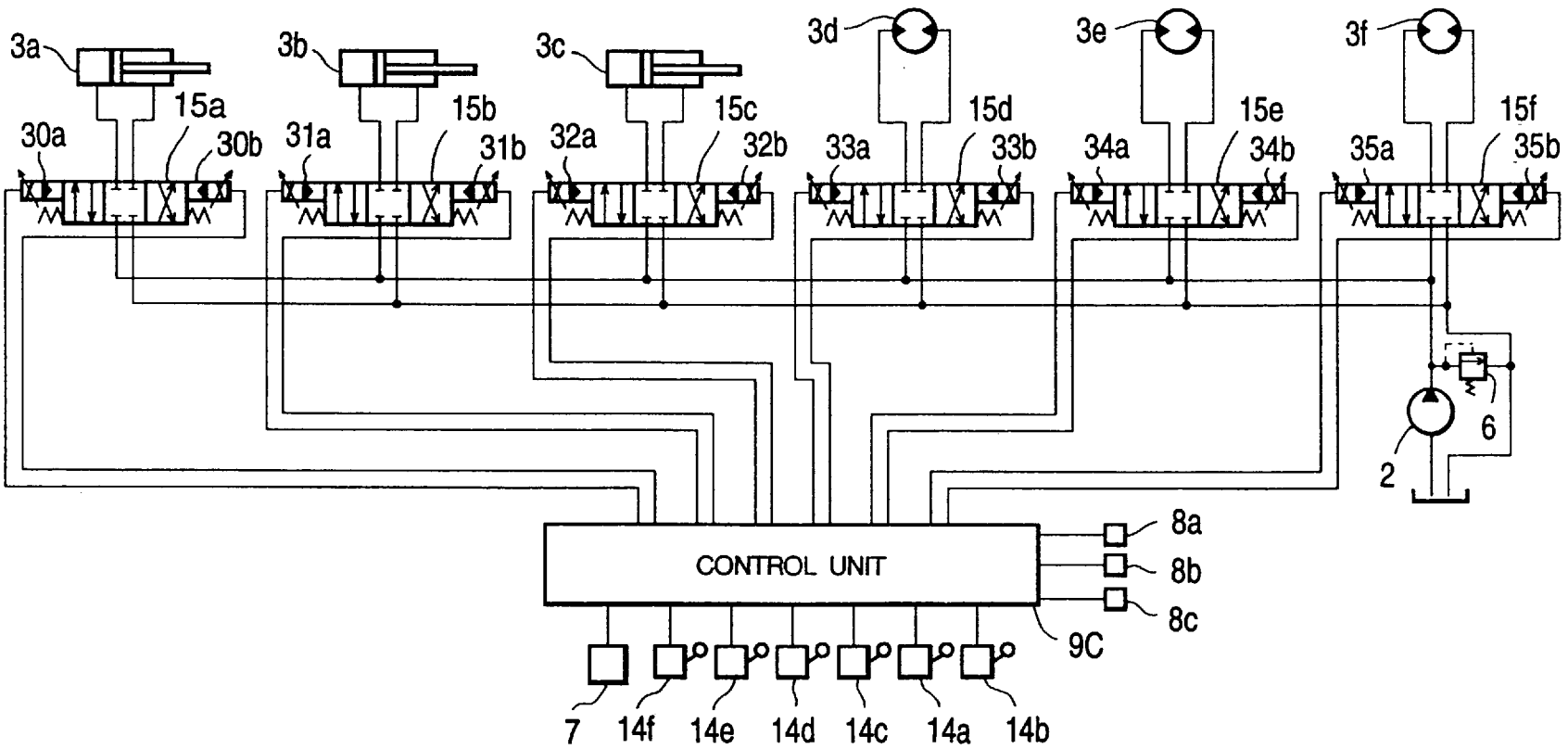
FIG. 28 is a diagram showing a region limiting excavation control system for a construction machine according to a fourth embodiment of the present invention, along with a hydraulic drive system for the control system.

Referring to FIG. 28, a hydraulic drive system for a hydraulic excavator comprises a plurality of control lever units 14*a* to 14*f* provided respectively corresponding to a boom cylinder 3*a*, an arm cylinder 3*b*, a bucket cylinder 3*c*, a swing motor 3*d*, and left and right track motors 3*e*, 3*f* (i.e., a plurality of hydraulic actuators), and a plurality of flow control valves 15*a* to 15*f* connected between a hydraulic pump 2 and the plurality of hydraulic actuators 3*a* to 3*f* and controlled in accordance with respective control signals from the control lever units 14*a* to 14*f* for controlling flow rates of a hydraulic fluid supplied to the hydraulic actuators 3*a* to 3*f*. The control lever units 14*a* to 14*f* are of electric lever type outputting an electric signal (voltage) as the control signal. The flow control valves 15*a* to 15*f* have at opposite ends electro-hydraulic converting means, e.g., solenoid driving sectors 30*a*, 30*b*–35*a*, 35*b* including proportional solenoid valves, respectively, and electric signals depending on the amounts and directions by and in which the control lever units 14*a* to 14*f* are manipulated by the operator are supplied to the solenoid driving sectors 30*a*, 30*b*–35*a*, 35*b* of the flow control valves 15*a* to 15*f*.

A region limiting excavation control system of this embodiment comprises a control unit 9C for receiving the control signals (electric signals) from the control lever units 14*a* to 14*f*, a setting signal from a setter 7 and detection signals from angle sensors 8*a*, 8*b*, 8*c*, setting an excavation region where the end of a bucket 1*c* is movable, and modifying the control signals.

The control unit 9C includes a region setting section and a region limiting excavation control section. The region setting section executes, in accordance with an instruction from the setter 7, calculation for setting the excavation region where the end of the bucket 1*c* is movable. The calculation procedures are the same as executed in the region setting calculator 9*a* in the first embodiment described above referring to FIG. 5. Thus, transform data from the XY-coordinate system into the XaYa-coordinate system is determined.

Figure 29:
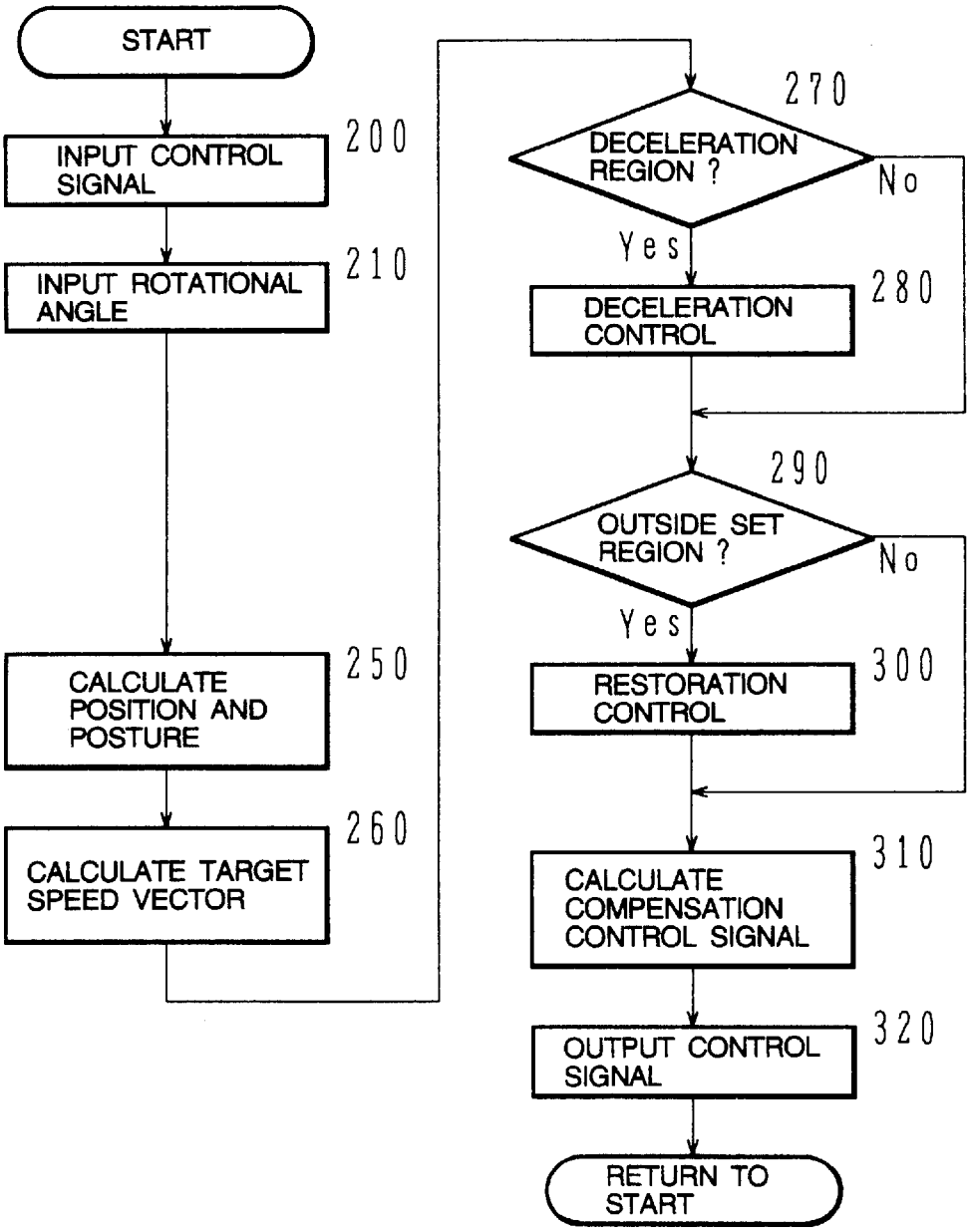
FIG. 29 is a flowchart showing control procedures executed in a control unit.

The region limiting excavation control section in the control unit 9C executes, based on the region set by the region setting section, control for limiting the region where a front attachment 1A is movable, in accordance with a flowchart shown in FIG. 29. A description will now be made of operation of this embodiment while explaining control functions of the region limiting excavation control section with reference to the flowchart of FIG. 29.

First, the control signals from the control lever units 14*a* to 14*f* are input in step 200, and the rotational angles of the boom 1*a*, the arm 1*b* and the bucket 1*c* detected by the angle sensors 8*a*, 8*b*, 8*c* are input in step 210.

Then, in step 250, the position of a predetermined location of the front attachment 1A, e.g., the end position of the bucket 1*c*, is calculated based on the detected rotational angles α, β, γ and the various dimensions of the front attachment 1A which are stored in a memory of the control unit 9*c*. At this time, similarly to the process executed by the region setting calculator 9*a* in the first embodiment, the end position of the bucket 1*c* is first calculated as coordinate values on the XY-coordinate system (see FIG. 5). These values on the XY-coordinate system are then converted into values on the XaYa-coordinate system (see FIG. 5) by using the transform data determined in the region setting section. Thus, the end position of the bucket 1*c* is finally calculated as coordinate values on the XaYa-coordinate system.

Next, in step 260, a target speed vector Vc at the end of the bucket 1*c* instructed by the control signals from the control lever units 14*a* to 14*c* for the front attachment 1A is calculated. The memory of the control unit 9C also stores the relationships between the control signals from the control lever units 14*a* to 14*c* and supply flow rates through the flow control valves 15*a* to 15*c*. Corresponding values of the supply flow rates through the flow control valves 15*a* to 15*c* are determined from the control signals from the control lever units 14*a* to 14*c*, target driving speeds of the hydraulic cylinders 3*a* to 3*c* are determined from those values of the supply flow rates, and the target speed vector Vc at the bucket end is calculated based on those target driving speeds and the various dimensions of the front attachment 1A. At this time, as with the calculation of the bucket end position in step 250, the target speed vector Vc is calculated as coordinate values on the XaYa-coordinate system by first calculating the vector Vc as values on the XY-coordinate system and then converting those values into values on the XaYa-coordinate system by using the transform data determined in the region setting section. Here, an Xa-coordinate value Vcx of the target speed vector Vc on the XaYa-coordinate system represents a vector component of the target speed vector Vc in the direction parallel to the boundary of the set region, and a Ya-coordinate value Vcy represents a vector component of the target speed vector Vc in the direction vertical to the boundary of the set region.

Figure 30:
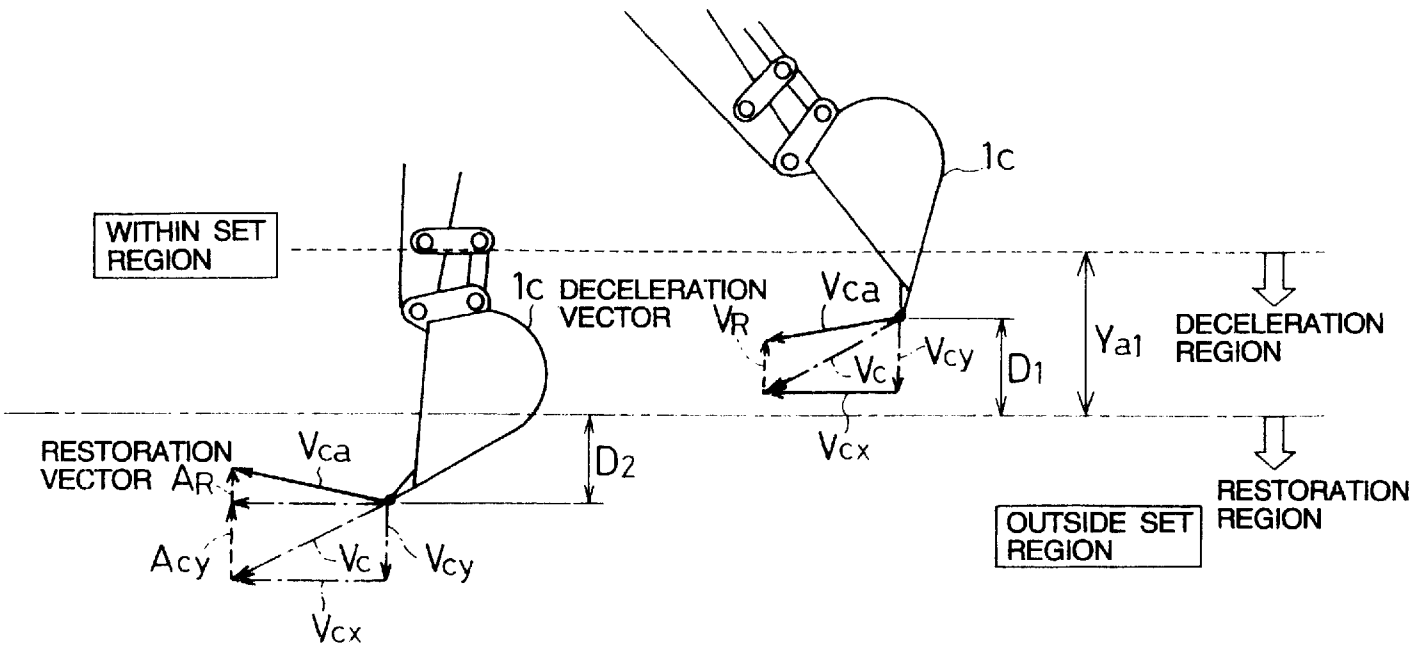
FIG. 30 is a view for explaining a method of modifying target speed vectors in a deceleration region and a restoration region set in the fourth embodiment.

Then, it is determined in step 270 whether or not the end of the bucket 1*c* is within a deceleration region (direction change region) which locates within the set region, shown in FIG. 30, set as explained above and near the boundary thereof. If the bucket end is within the deceleration region, the control procedure goes to step 280 where the target speed vector Vc is modified so as to slow down the front attachment 1A. If the bucket end is not within the deceleration region, the control procedure goes to step 290. Then, it is determined in step 290 whether or not the end of the bucket 1*c* is outside the set region set, shown in FIG. 30, as explained above. If the bucket end is outside the set region, the control procedure goes to step 300 where the target speed vector Vc is modified so as to return the end of the bucket 1*c* to the set region. If the bucket end is not outside the set region, the control procedure goes to step 310.

Then, in step 310, control signals for the flow control valves 15*a* to 15*c* corresponding to the target speed vector Vca after modification obtained in step 280 or 300 are calculated. This process is a reversal of the calculation of the target speed vector Vc executed in step 260.

Then, the control signal input in step 200 or the control signal calculated in step 310 is output in step 320, followed by returning to the start.

A description will now be made of the determination in step 270 as to whether the bucket end is within the deceleration region (direction change region) or not, and the modification of the target speed vector Vc for deceleration control.

The memory of the control unit 9C stores, as a value for setting a range of the deceleration region, the distance Ya1 from the boundary of the set region as shown in FIG. 30. In step 270, from the Ya-coordinate value of the end position of the bucket 1*c* determined in step 250, a distance D1 between the bucket end position and the boundary of the set region is determined. Then, if the distance D1 becomes smaller then the distance Ya1, it is determined that the bucket end has entered the deceleration region.

Figure 31:
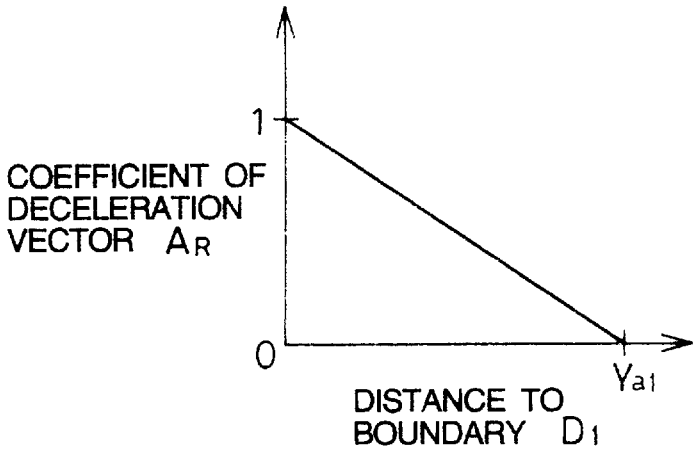
FIG. 31 is a graph showing the relationship between a distance from the bucket end to the boundary of the set region and a deceleration vector.

The memory of the control unit 9C also stores the relationship between the distance D1 from the end of the bucket 1*c* to the boundary of the set region and a deceleration vector coefficient h as shown in FIG. 31. The relationship between the distance D1 and the coefficient h is set such that h is equal to 0 when the distance D1 is larger than the distance Ya1, is gradually increased as the distance D1 decreases when D1 becomes smaller than Ya1, and is equal to 1 at the distance D1=0.

In step 280, the target speed vector Vc is modified so as to reduce the vector component of the target speed vector Vc at the end of the bucket 1*c* in the direction toward the boundary of the set region which is calculated in step 260, i.e., the Ya-coordinate value Vcy on the XaYa-coordinate system. More specifically, the deceleration vector coefficient h corresponding to the distance D1 determined in step 270 is calculated from the relationship shown in FIG. 31 and stored in the memory. The Ya-coordinate value (vertical vector component) Vcy of the target speed vector Vc is multiplied by the calculated deceleration vector coefficient h and further multiplied by −1 to obtain a deceleration vector VR (=−hVcy). VR is then added to Vcy. Here, the deceleration vector VR is a speed vector which orients in opposed relation to Vcy and which is gradually increased as the distance D1 from the end of the bucket 1*c* to the boundary of the set region decreases from Ya1 and then becomes equal to −Vcy at D1=0. By adding the deceleration vector VR to the vertical vector component Vcy of the target speed vector Vc, therefore, the vertical vector component Vcy is reduced such that the amount of reduction in the vertical vector component Vcy is gradually increased as the distance D1 becomes even smaller than Ya1. Thus, the target speed vector Vc is modified into a target speed vector Vca.

A path along which the end of the bucket 1*c* is moved when the deceleration control is performed as per the above-described target speed vector Vca after modification is the same as described above in the first embodiment referring to FIG. 11. More specifically, given that the target speed vector Vc is oriented downward obliquely and constant, its parallel component Vcx remains the same and its vertical component Vcy is gradually reduced as the end of the bucket 1*c* comes closer to the boundary of the set region (i.e., as the distance D1 becomes even smaller than Ya1). Because the target speed vector Vca after modification is a resultant of both the parallel and vertical components, the path is in the form of a curved line which is curved to come closer to a parallel line while approaching the boundary of the set region, as shown in FIG. 11. Also, given that h=1 and VR=−Vcy hold at D1=0, the target speed vector Vca after modification on the boundary of the set region coincides with the parallel component Vcx.

Thus, in the deceleration control in step 280, since the movement of the end of the bucket 1*c* toward the boundary of the set region is slowed down, the direction in which the end of the bucket 1*c* is moving is eventually converted into the direction along the boundary of the set region.

A description will now be made of the determination in step 290 as to whether the bucket end is outside the set region or not, and the modification of the target speed vector Vc for restoration control outside the set region.

In step 290, from the Ya-coordinate value of the end position of the bucket 1*c* determined in step 250, a distance D2 between the bucket end position outside the set region and the boundary of the set region is determined. If a value of the distance D2 changes from negative to positive, it is determined that the bucket end has moved out of the set region.

Figure 32:
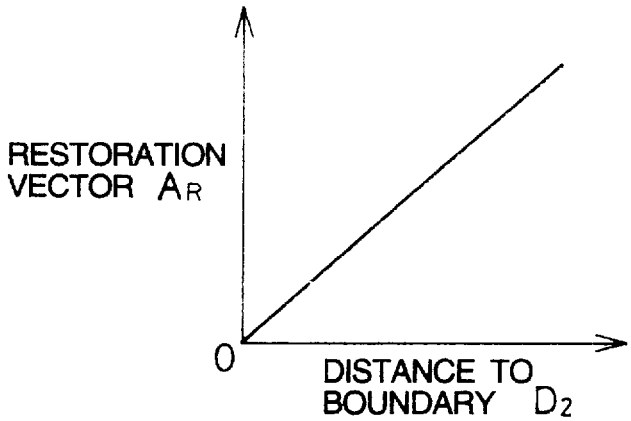
FIG. 32 is a graph showing the relationship between a distance from the bucket end to the boundary of the set region and a restoration vector.

Further, the memory of the control unit 9C stores the relationship between the distance D2 from the end of the bucket 1*c* to the boundary of the set region and a restoration vector AR as shown in FIG. 32. The relationship between the distance D2 and the restoration vector AR is set such that the restoration vector AR is gradually increased as the distance D2 decreases. In step 300, the target speed vector Vc is modified such that the vector component of the target speed vector Vc at the end of the bucket 1*c* in the direction vertical to the boundary of the set region which is calculated in step 260, i.e., the Ya-coordinate value Vcy on the XaYa-coordinate system, is changed to a vertical component in the direction toward the boundary of the set region. More specifically, a reversed vector Acy of Vcy is added to the vertical vector component Vcy to cancel it, whereas the parallel component Vcx is extracted. With this modification, the end of the bucket 1*c* is prevented from further moving out of the set region. Then, the restoration vector AR corresponding to the distance D2 between the end of the bucket 1*c* and the boundary of the set region at that time is calculated from the relationship shown in FIG. 32 and stored in the memory. The calculated restoration vector AR is set to a vertical vector Vcya of the target speed vector Vc. Here, the restoration vector AR is a reversed speed vector which is gradually reduced as the distance D2 between the end of the bucket 1*c* to the boundary of the set region decreases. By setting the restoration vector VR to the vertical vector component Vcy of the target speed vector Vc, therefore, the target speed vector Vc is modified into a target speed vector Vca of which vertical vector component Vcya is gradually reduced as the distance D2 decreases.

A path along which the end of the bucket 1*c* is moved when the restoration control is performed as per the above-described target speed vector Vca after modification is the same as described above in the first embodiment referring to FIG. 15. More specifically, given that the target speed vector Vc is oriented downward obliquely and constant, its parallel component Vcx remains the same and its vertical component is gradually reduced as the end of the bucket 1*c* comes closer to the boundary of the set region (i.e., as the distance D2 decreases) for the restoration vector AR is proportional to the distance D2. Because the target speed vector Vca after modification is a resultant of both the parallel and vertical components, the path is in the form of a curved line which is curved to come closer to a parallel line while approaching the boundary of the set region, as shown in FIG. 15.

Thus, in the restoration control in step 300, since the end of the bucket 1*c* is controlled to return to the set region, a restoration region is defined outside the set region. Further, in the restoration control, the movement of the end of the bucket 1*c* toward the boundary of the set region is also slowed down and, eventually, the direction in which the end of the bucket 1*c* is moving is converted into the direction along the boundary of the set region.

With this embodiment arranged as described above, the following advantages are obtained as with the first embodiment. When the end of the bucket 1*c* is away from the boundary of the set region, the target speed vector Vc is not modified and the work can be implemented in a normal manner. When the end of the bucket 1*c* comes closer to the boundary of the set region within it, the target speed vector Vc is modified so as to reduce its vector component in the direction toward the boundary of the set region (i.e., the vector component vertical to the boundary of the set region). Therefore, the movement of the bucket end in the direction vertical to the boundary of the set region is sped down, but the speed component in the direction along the boundary of the set region is not reduced. As a result, the end of the bucket 1*c* can be moved along the boundary of the set region as shown in FIG. 11. It is hence possible to efficiently perform excavation while limiting a region where the end of the bucket 1*c* is movable.

If the movement of the front attachment 1A is fast when the end of the bucket 1*c* is controlled to slow down near the boundary of the set region within it as described above, the end of the bucket 1*c* may go out of the set region to some extent due to a delay in control response and the inertia of the front attachment 1A. In this embodiment, when such an event occurs, the target speed vector Vc is modified so that the end of the bucket 1*c* is returned to the set region, enabling the bucket end to quickly return to the set region after going out of the set region. Therefore, even if the front attachment 1A is moved fast, the bucket end can be moved along the boundary of the set region and the excavation within a limited region can precisely be implemented.

In this connection, since the bucket end is already slowed down through the deceleration control as explained above, the amount by which the bucket end goes out of the set region is so reduced that the shock occurred upon returning to the set region is greatly alleviated. Therefore, even if the front attachment 1A is moved fast, the end of the bucket 1*c* can smoothly be moved along the boundary of the set region and the excavation within a limited region can smoothly be implemented. Further, in this embodiment, when the end of the bucket 1*c* is controlled to return to the boundary of the set region, the vector component of the target speed vector Vc vertical to the boundary of the set region is modified for change into a vector component in the direction toward the boundary of the set region. Therefore, the speed component in the direction along the boundary of the set region is not reduced, and the end of the bucket 1*c* can also smoothly be moved outside the set region along the boundary of the set region. In addition, since the vector component in the direction toward the boundary of the set region is modified to become smaller as the distance D2 between the end of the bucket 1*c* and the boundary of the set region decreases, the path along which the bucket end is moved under the restoration control based on the target speed vector Vca after modification is in the form of a curved line which is curved to come closer to a parallel line while approaching the boundary of the set region, as shown in FIG. 15. This enables the bucket end to be returned to the set region in a smoother manner.

As a result of enabling the end of the bucket 1*c* to be smoothly moved along the boundary of the set region, by operating the bucket 1*c* to move toward the body, it is possible to implement the excavation as if the path control along the boundary of the set region is performed.

Additionally, since the target speed vector is modified and the control signals are modified so as to provide the modified target speed vector, even if just one arm control lever unit 14*b* is manipulated, all the associated control signals are modified when the end of the bucket 1*c* comes closer to the boundary of the set region, and the end of the bucket 1*c* can be moved along the boundary of the set region.

Fifth Embodiment

A fifth embodiment of the present invention will be described with reference to FIGS. 33 and 34. This embodiment employs detecting means other than the angle sensors as means for detecting status variables with regard to the position and posture of the front attachment 1A.

Figure 33:
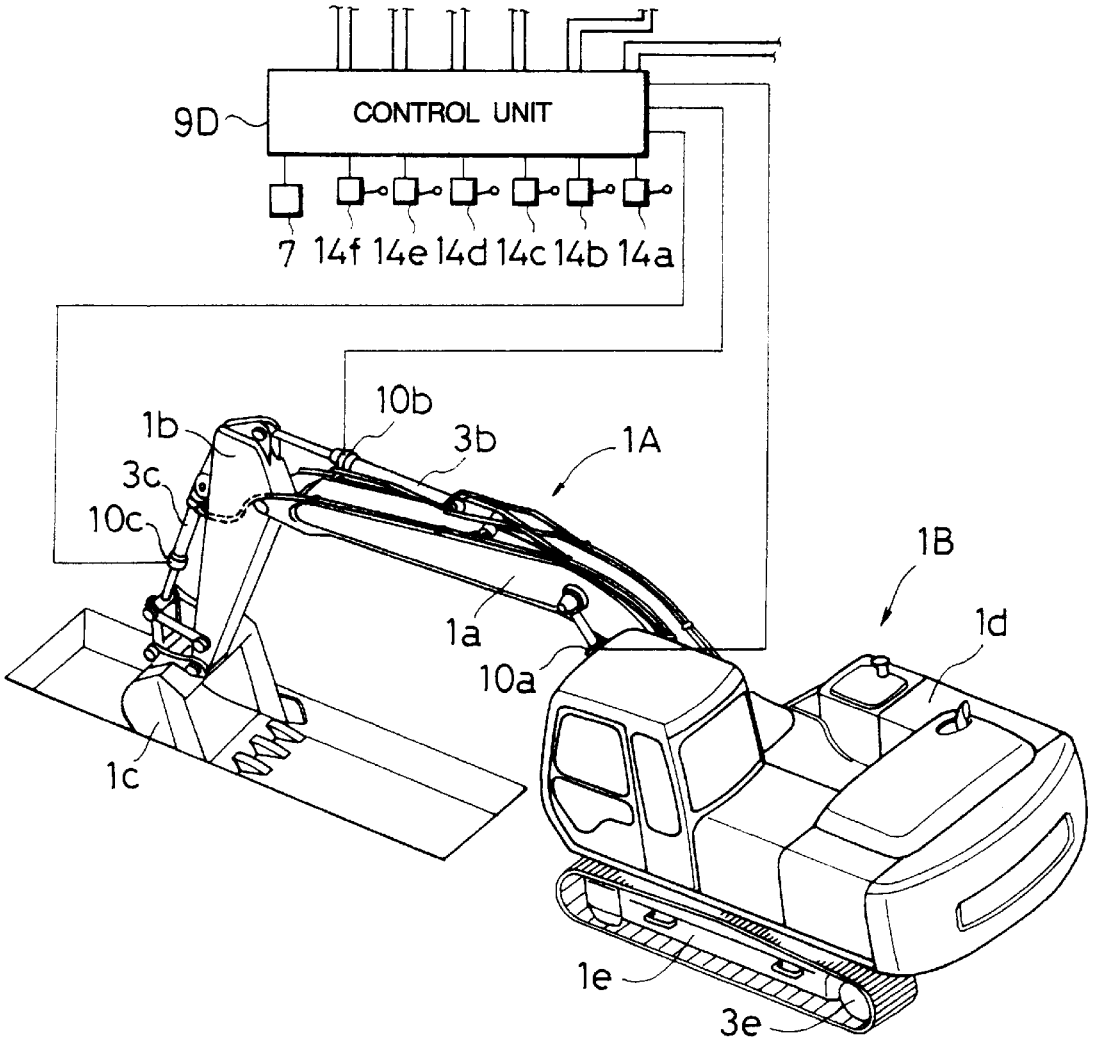
FIG. 33 is a diagram showing a region limiting excavation control system for a construction machine according to a fifth embodiment of the present invention, along with a hydraulic excavator to which the present invention is applied.
Figure 34:
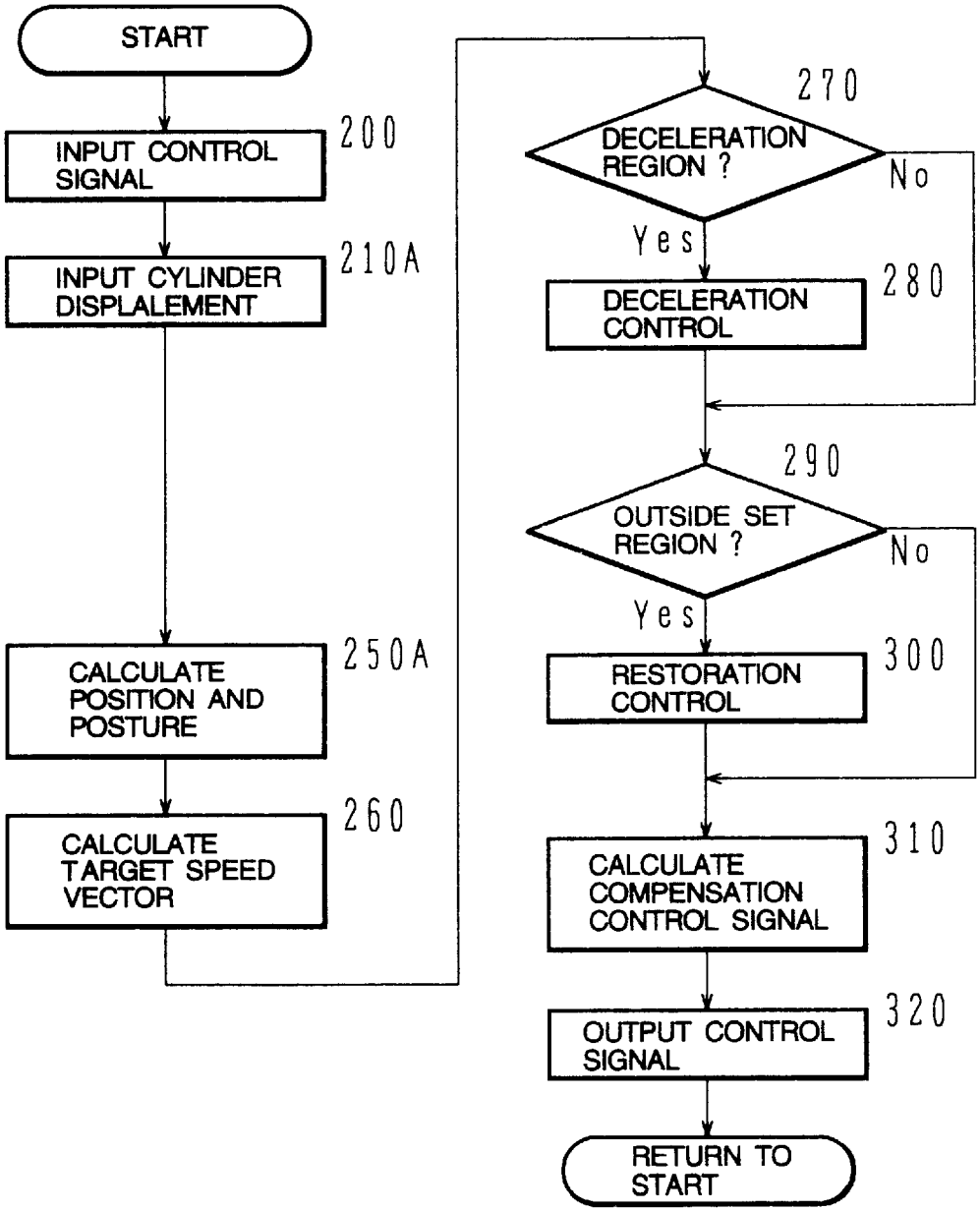
FIG. 34 is a flowchart showing control procedures executed in a control unit.

In FIG. 33, a control system of this embodiment includes displacement sensors 10*a*, 10*b*, 10*c* for detecting strokes (displacements) of the hydraulic cylinders 3*a*, 3*b*, 3*c*, in place of the angle sensors 8*a* to 8*c* for detecting the rotational angles of the boom 1*a*, the arm 1*b* and the bucket 1*c*. A control unit 9D is arranged to, in step 210A of FIG. 34, receive the displacements of the hydraulic cylinders 3*a*, 3*b*, 3*c* detected by the displacement sensors 10*a* to 10*c* and, in step 250A, calculate the rotational angles $\alpha$, $\beta$, $\gamma$ of the boom 1*a*, the arm 1*b* and the bucket 1*c* based on the displacements of the hydraulic cylinders 3*a*, 3*b*, 3*c* and the various dimensions of the front attachment 1A stored beforehand, thereby calculating the position and posture of the front attachment 1A as with the first embodiment.

This embodiment can also perform the deceleration control (direction change control) and the restoration control in a like manner to in the fourth embodiment, and hence provide similar advantages as in the fourth embodiment.

Sixth Embodiment

A sixth embodiment of the present invention will be described with reference to FIGS. 35 and 36. This embodiment further includes an inclination angle sensor for detecting an inclination angle of the body as means for detecting status variables with regard to the position and posture of the front attachment 1A in the fourth embodiment.

Figure 35:
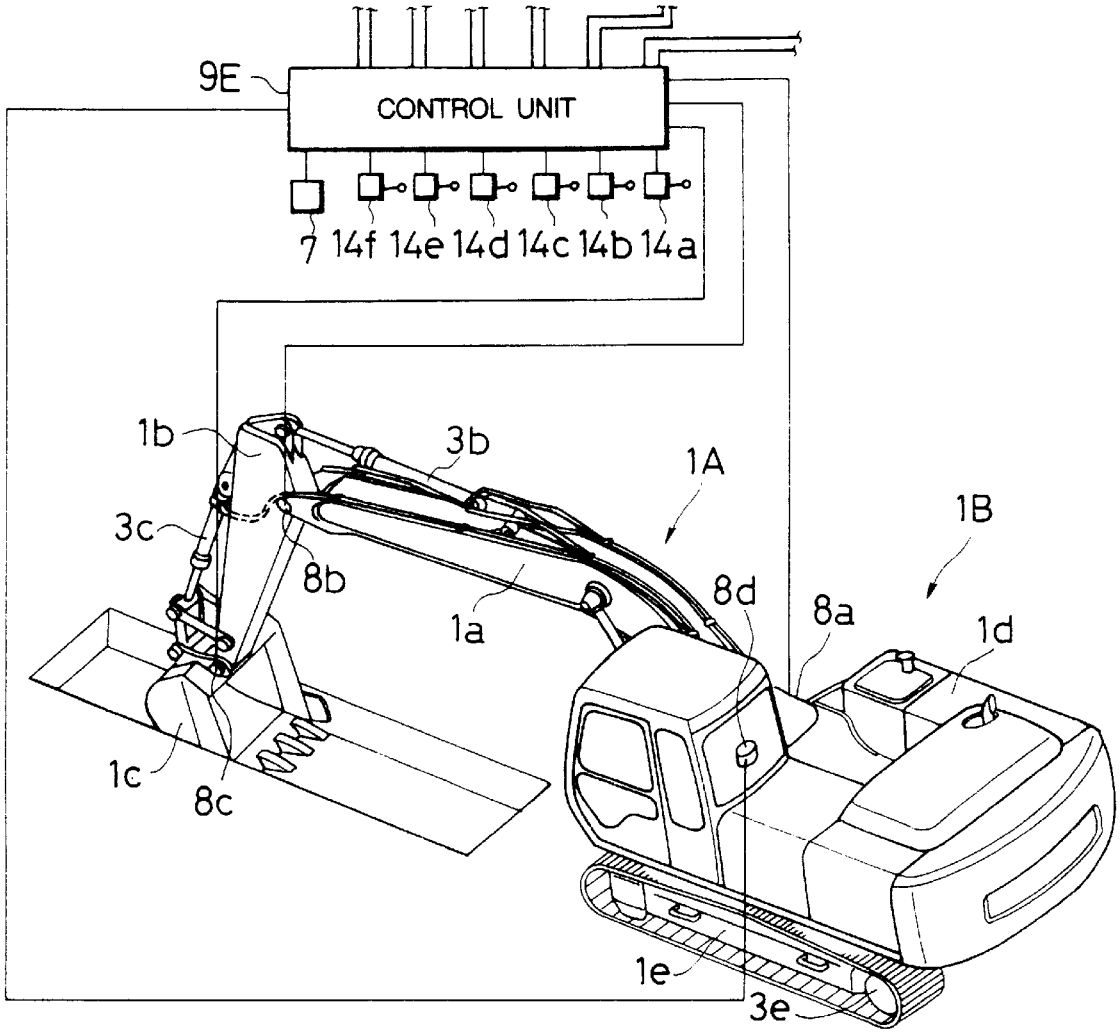
FIG. 35 is a diagram showing a region limiting excavation control system for a construction machine according to a sixth embodiment of the present invention, along with a hydraulic excavator to which the present invention is applied.
Figure 36:
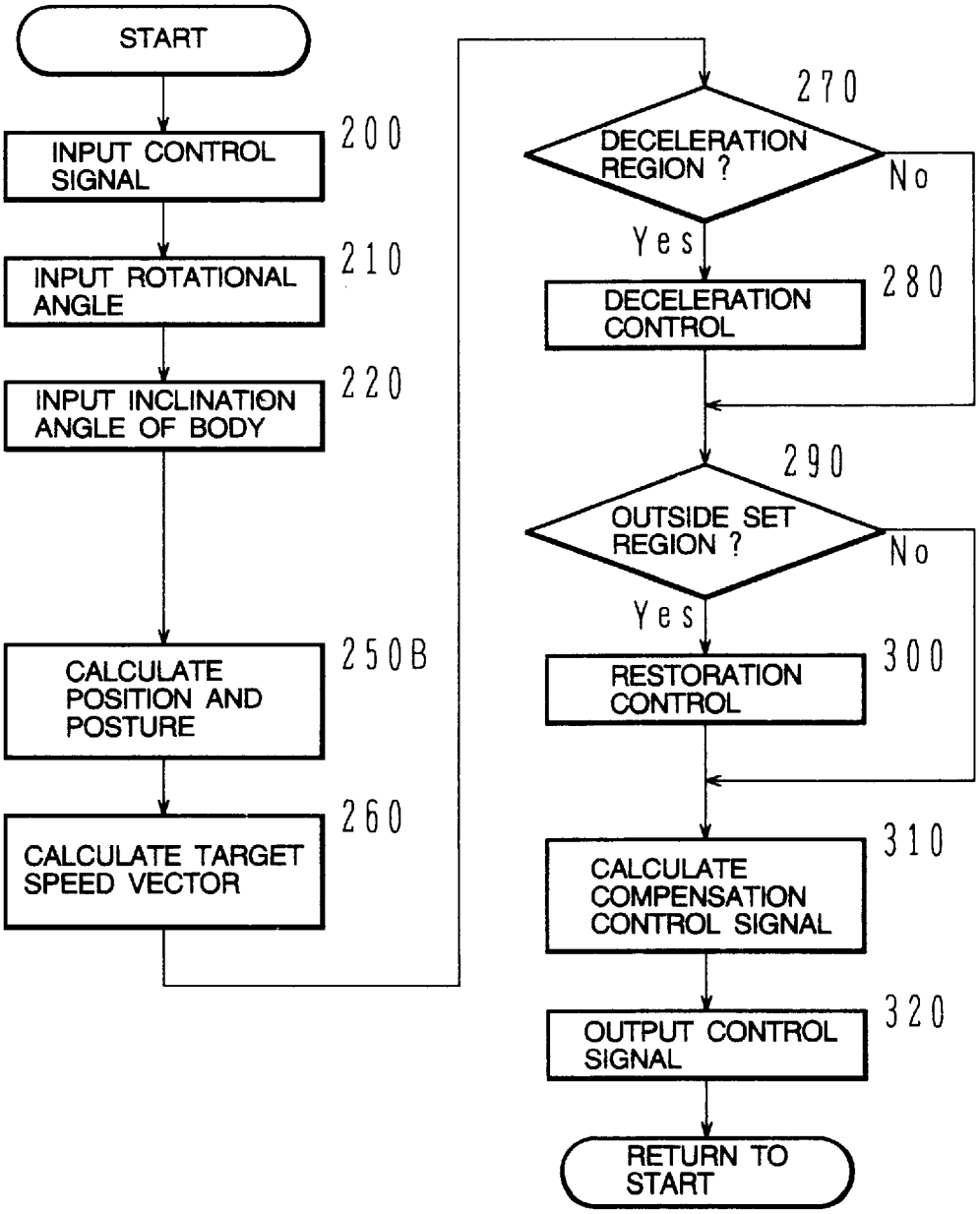
FIG. 36 is a flowchart showing control procedures executed in a control unit.

In FIG. 35, a control system of this embodiment includes an inclination angle sensor 8*d* for detecting a longitudinal inclination angle $\theta$ of the body 1B, in addition to the angle sensors 8*a* to 8*c* for detecting the rotational angles of the boom 1*a*, the arm 1*b* and the bucket 1*c*. A control unit 9E is arranged to, in step 220 of FIG. 36, receive the inclination angle $\theta$ of the body 1B detected by the inclination angle sensor 8*d* and, in step 250B, calculate the position and posture of the front attachment 1A based on the rotational angles of the boom 1*a*, the arm 1*b* and the bucket 1*c* and the inclination angle of the body 1B.

More specifically, as explained above in connection with the first embodiment referring to FIG. 6, if the posture of the body 1B during region setting and the posture of the body 1B during excavation are both horizontal, the relative positional relationship between the XY-coordinate system fixed on the body 1B and the ground is not changed and the region limiting excavation can be implemented as per setting. However, the body may incline longitudinally during excavation depending on working environment. In such a case, the relative positional relationship between the XY-coordinate system fixed on the body 1B and the ground is changed and the region limiting excavation cannot be implemented as per setting. In this embodiment, therefore, the inclination angle $\theta$ is detected to carry out control calculation using an XbYb-coordinate system (see FIG. 6) which is obtained by rotating the XY-coordinate system through the angle $\theta$. As a result, the XbYb-coordinate system has the same orientation as the XY-coordinate system and the region limiting excavation can be implemented as per setting without being affected by any inclination of the body.

According to this embodiment, with the provision of the inclination angle sensor 8*d*, the excavation within a limited region can be implemented efficiently and smoothly regardless of any inclination of the body.

Seventh Embodiment

A seventh embodiment of the present invention will be described with reference to FIGS. 37 and 38. This embodiment further employs an angle sensor for detecting a swing angle of the upper structure as means for detecting status variables with regard to the position and posture of the front attachment 1A.

Figure 37:
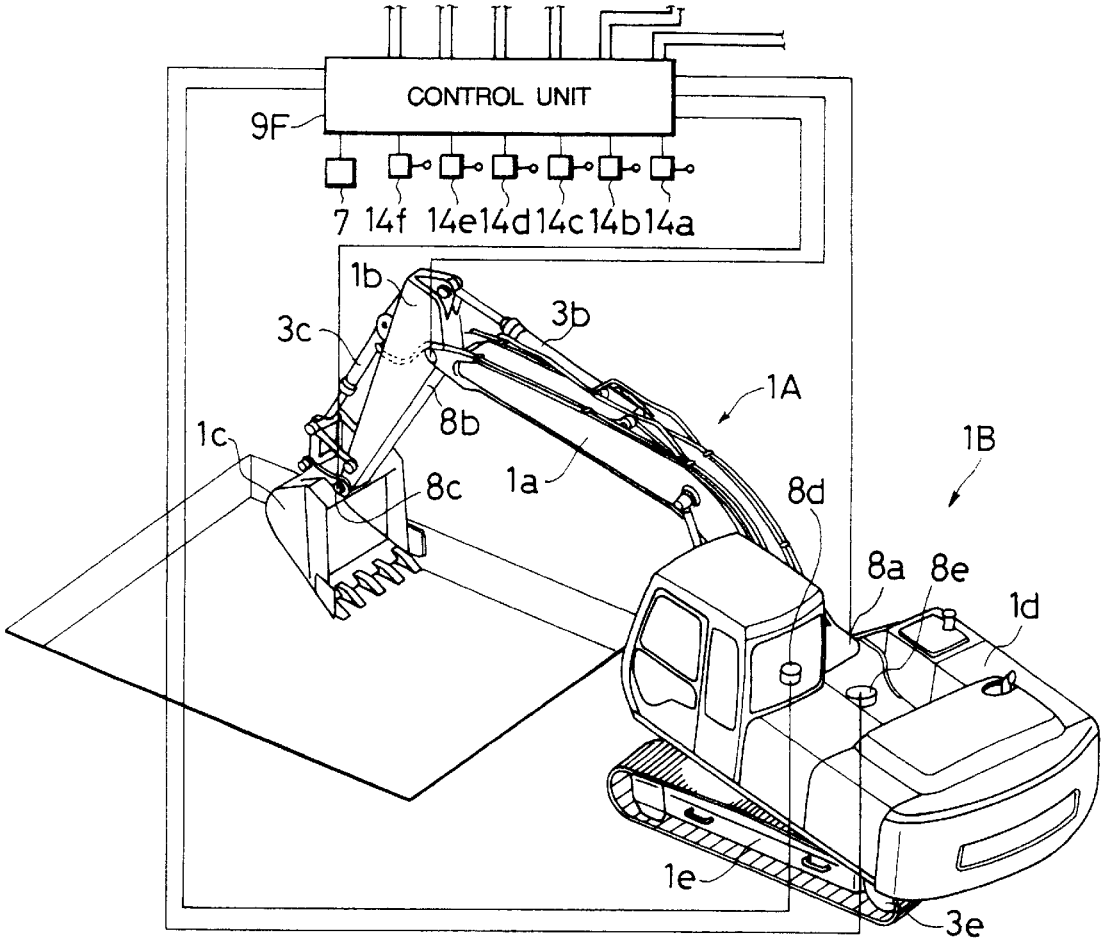
FIG. 37 is a diagram showing a region limiting excavation control system for a construction machine according to a seventh embodiment of the present invention, along with a hydraulic excavator to which the present invention is applied.

In FIG. 37, a control system of this embodiment includes an inclination angle sensor 8*d* for detecting an inclination angle $\theta$ of the body 1B and an angle sensor 8*e* for detecting a swing angle of the upper structure 1*d*, in addition to the angle sensors 8*a* to 8*c* for detecting the rotational angles of the boom 1*a*, the arm 1*b* and the bucket 1*c*. Further, the setter 7 is designed to additionally set the boundary of the excavation region in the Z-direction, i.e., the transverse direction of the body 1B, by using an XYZ-coordinate system.

Figure 38:
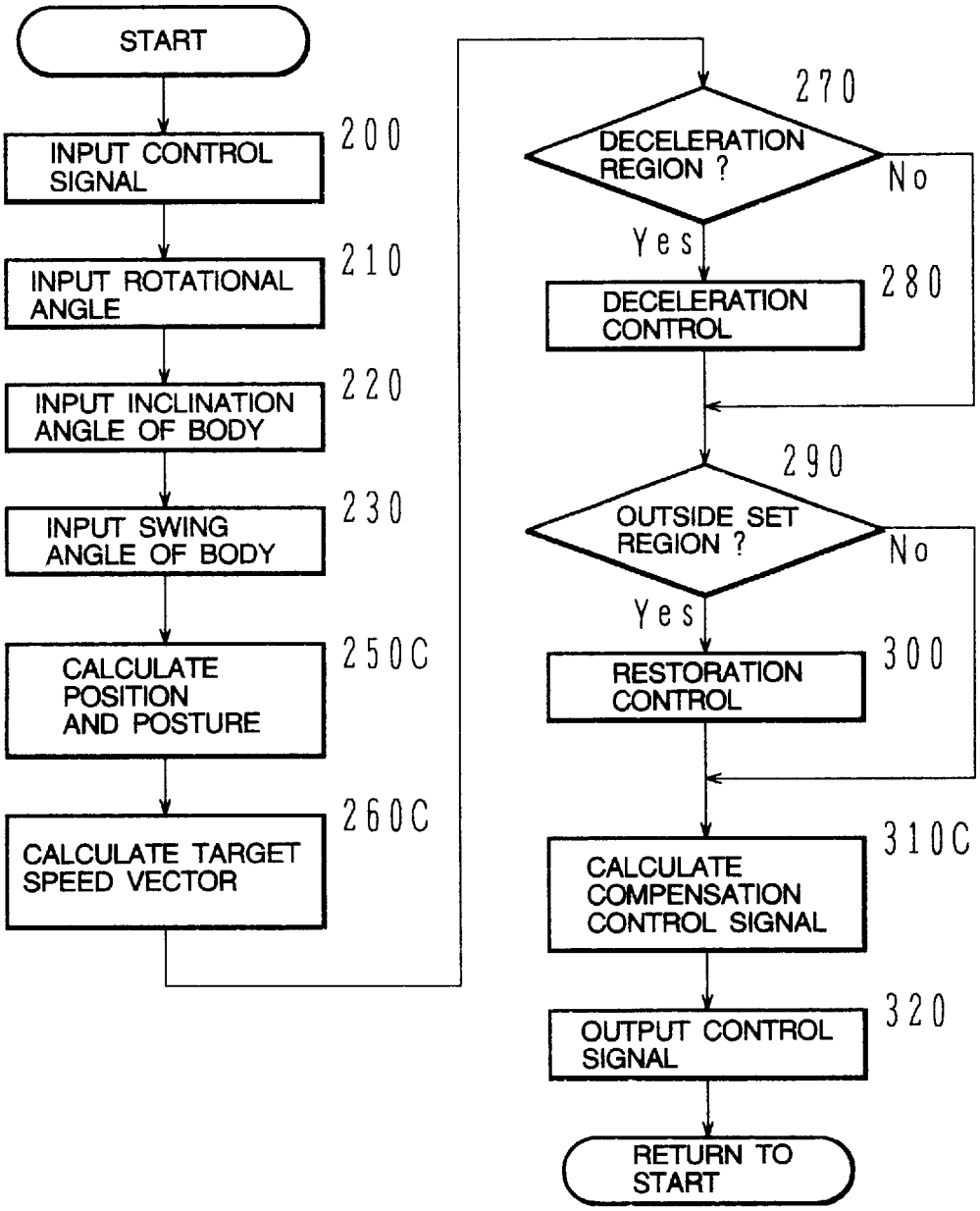
FIG. 38 is a flowchart showing control procedures executed in a control unit.

A control unit 9F is arranged to, in step 220 of FIG. 38, receive the inclination angle $\theta$ of the body 1B detected by the inclination angle sensor 8*d*, in step 230, receive the swing angle of the upper structure 1*d* detected by the angle sensor 8*e*, and in step 250C, calculate the position and posture of the front attachment 1A based on the rotational angles of the boom 1*a*, the arm 1*b* and the bucket 1*c*, the inclination angle of the body 1B and the swing angle of the upper structure 1*d*.

Then, in step 260C, a target speed vector Vcs at the end of the bucket 1*c* instructed by the control signals from the control lever units 14*a* to 14*c* for the front attachment 1A and the swing control lever unit 14*d* is calculated. A memory of the control unit 9F stores in advance the relationships between the control signals from the control lever units 14*a* to 14*d* and supply flow rates through the flow control valves 15*a* to 15*d*, the various dimensions of the front attachment 1A, and the distance between the swing center and the front attachment 1A. Corresponding values of the supply flow rates through the flow control valves 15*a* to 15*d* are determined from the control signals from the control lever units 14*a* to 14*d*, target driving speeds of the hydraulic cylinders 3*a* to 3*c* and the swing motor 3*d* are determined from those values of the supply flow rates, and the target speed vector Vc at the bucket end is calculated based on those target driving speeds and the aforesaid various dimensions.

Further, in step 310C, control signals for the flow control valves 15*a* to 15*d* corresponding to the target speed vector Vcsa after modification obtained in step 280 or 300 are calculated. This process is a reversal of the calculation of the target speed vector Vcs executed in step 260C.

With this embodiment, since the angle sensor 8*e* for detecting the swing angle of the upper structure 1*d* is further provided, the excavation can be implemented efficiently and smoothly while limiting the region where the front attachment 1A is movable, not only in a vertical plane but also in the transverse direction of the body within the swing radius.

Eighth Embodiment

An eighth embodiment of the present invention will be described with reference to FIGS. 39 and 40. This embodiment further employs a sensor for detecting a position and posture of the body as means for detecting status variables with regard to the position and posture of the front attachment 1A.

Figure 39:
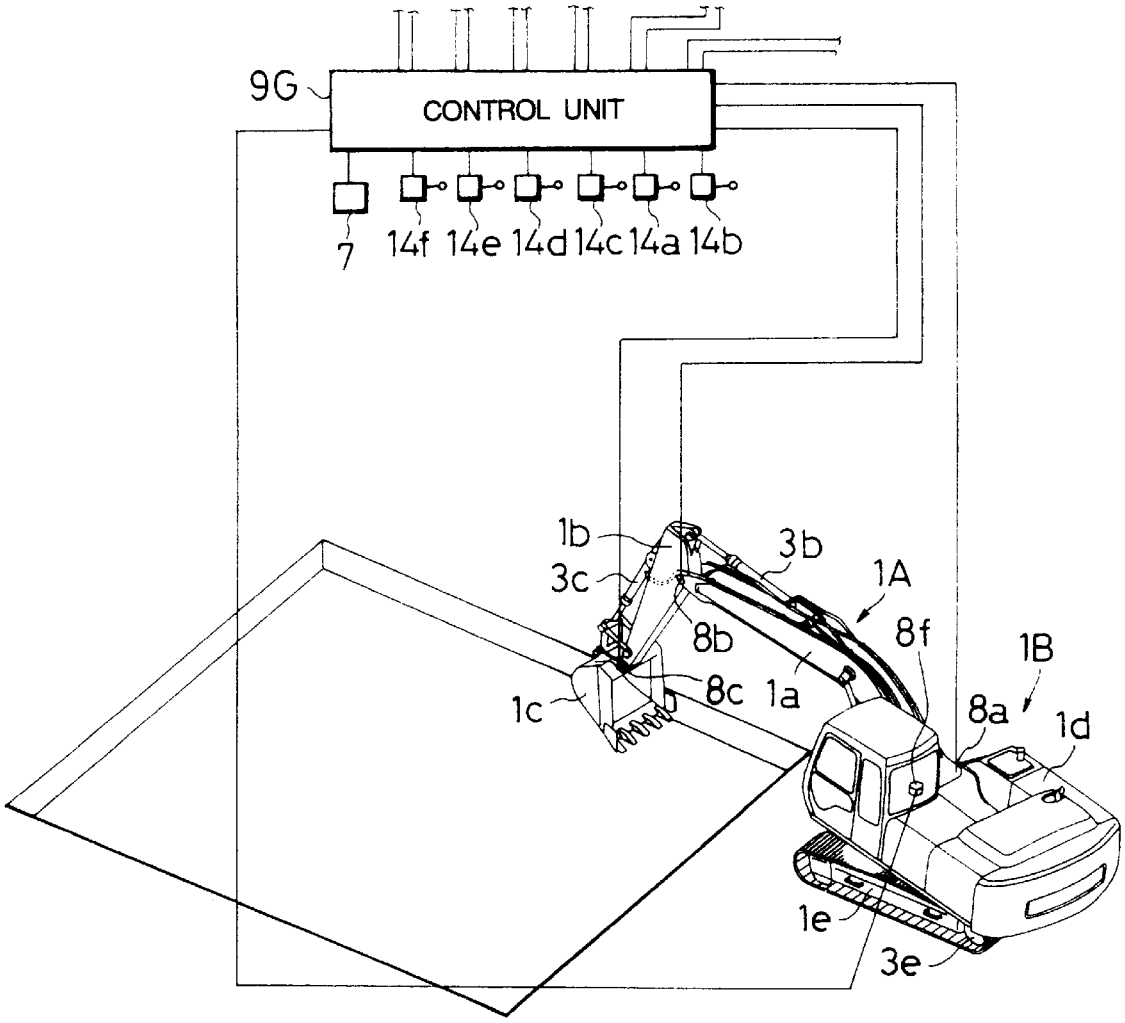
FIG. 39 is a diagram showing a region limiting excavation control system for a construction machine according to an eighth embodiment of the present invention, along with a hydraulic excavator to which the present invention is applied.

In FIG. 39, a control system of this embodiment includes a position/posture sensor 8*f* such as a gyroscope for detecting an inclination angle of the body 1B, a swing angle of the upper structure 1*d* and a position of the body 1B, in addition to the angle sensors 8*a* to 8*c* for detecting the rotational angles of the boom 1*a,* the arm 1*b* and the bucket 1*c*. Further, the setter 7 is designed to set the boundary of the excavation region over any desired range of the ground by using an XYZ-coordinate system fixed on the ground.

Figure 40:
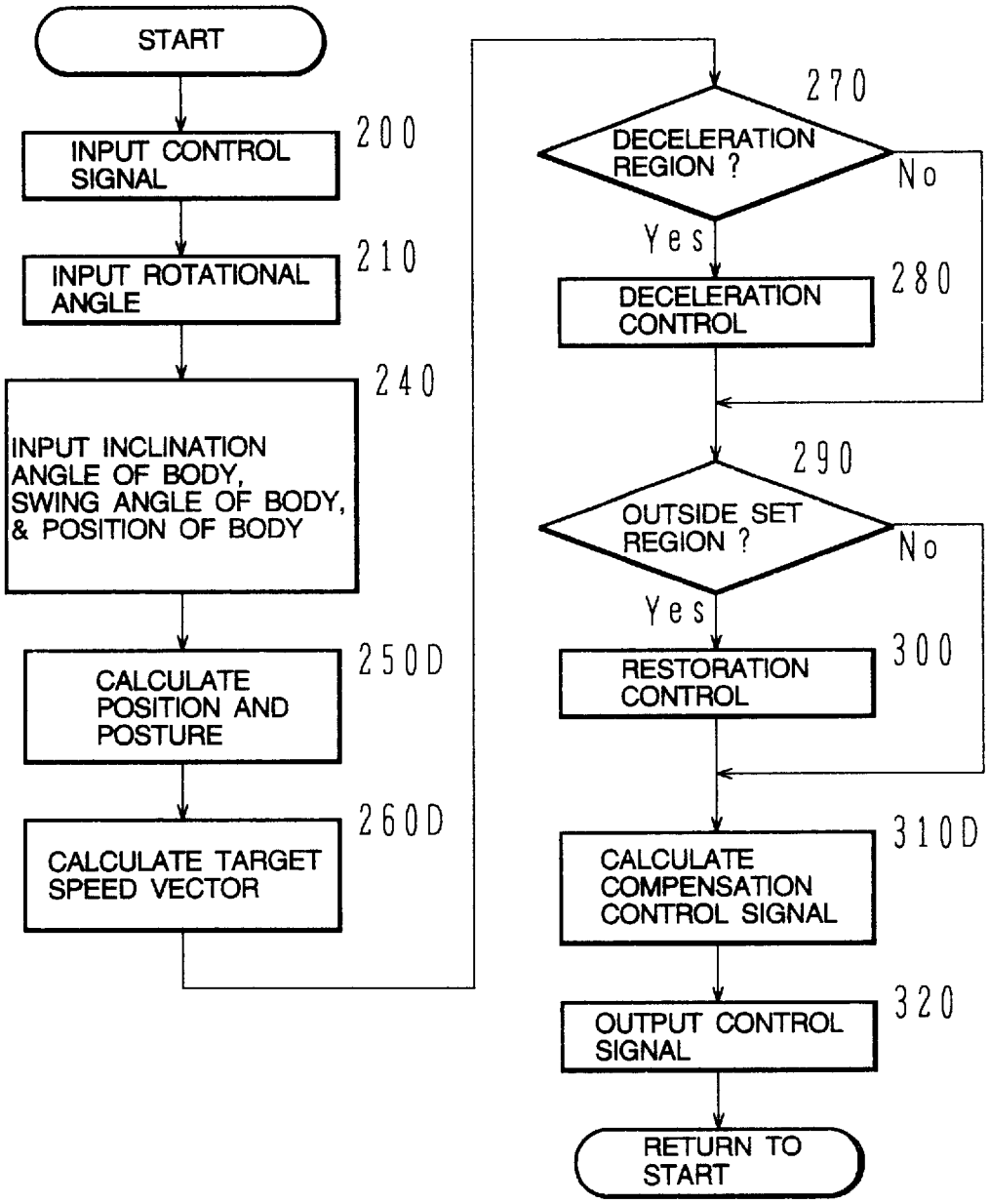
FIG. 40 is a flowchart showing control procedures executed in a control unit.

A control unit 9G is arranged to, in step 240 of FIG. 40, receive the inclination angle of the body 1B, the swing angle of the upper structure 1*d* and the position of the body 1B detected by the position/posture sensor 8*f* and, in step 250D, calculate the position and posture of the front attachment 1A based on the rotational angles of the boom 1*a,* the arm 1*b* and the bucket 1*c,* the inclination angle of the body 1B, the swing angle of the upper structure 1*d* and the position of the body 1B.

Then, in step 260D, a target speed vector Vcu at the end of the bucket 1*c* instructed by the control signals from the control lever units 14*a* to 14*c* for the front attachment 1A, the swing control lever unit 14*d* and the track control lever units 14*e,* 14*f* is calculated. A memory of the control unit 9G stores in advance the relationships between the control signals from the control lever units 14*a* to 14*f* and supply flow rates through the flow control valves 15*a* to 15*f,* the various dimensions of the front attachment 1A, the distance between the swing center and the front attachment 1A, and the relationship between the origin of the XYZ-coordinate system and the initial position of the body 1B. Corresponding values of the supply flow rates through the flow control valves 15*a* to 15*f* are determined from the control signals from the control lever units 14*a* to 14*f,* target driving speeds of the hydraulic cylinders 3*a* to 3*c,* the swing motor 3*d* and the track motors 3*e,* 3*f* are determined from those values of the supply flow rates, and the target speed vector Vcu at the bucket end is calculated based on those target driving speeds and the aforesaid various dimensions.

Further, in step 310D, control signals for the flow control valves 15*a* to 15*f* corresponding to the target speed vector Vcua after modification obtained in step 280 or 300 are calculated. This process is a reversal of the calculation of the target speed vector Vcu executed in step 260D.

With this embodiment, since the sensor for detecting the position and posture of the body is further provided, the excavation can be implemented efficiently and smoothly while limiting the region where the front attachment 1A is movable, not only in a vertical plane but also over any desired range of the ground in all directions.

Other Embodiments

Still other embodiments of the present invention will be described with reference to FIGS. 41 and 42. The foregoing embodiments have been described of a hydraulic excavator having a front attachment of three-fold structure comprising a boom, an arm and a bucket. However, there are other various types of hydraulic excavators having front attachment of different structures, and the present invention is also applicable to those other types of hydraulic excavators.

Figure 41:
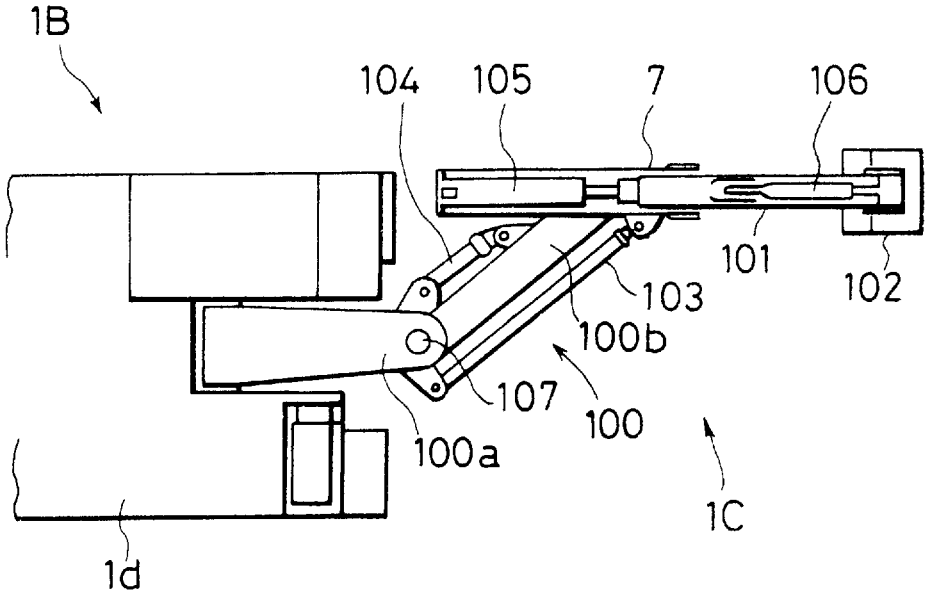
FIG. 41 is a top plan view showing an offset type hydraulic excavator to which the present invention is applied, as still another embodiment of the present invention.

FIG. 41 shows an offset type hydraulic excavator in which a boom can be swung transversely. This hydraulic excavator includes a multi-articulated front attachment 1C comprising an offset boom 100 consisted of a first boom 100*a* rotatable in the vertical direction and a second boom 100*b* swingable in the horizontal direction with respect to the first boom 100*a,* an arm 101 rotatable in the vertical direction with respect to the second boom 100*b,* and a bucket 102. A link 103 is disposed parallel on one side of the second boom 100*b,* and has one end coupled to the first boom 1*a* by a pin and the other end coupled to the arm 101 by a pin. The first boom 100*a* is driven by a first boom cylinder (not shown) which is similar to the boom cylinder 3*a* of the hydraulic excavator shown in FIG. 2. The second boom 100*b,* the arm 101 and the bucket 102 are driven respectively by a second boom cylinder 104, an arm cylinder 105 and a bucket cylinder 106. In such a hydraulic excavator, an angle sensor 107 for detecting a swing angle (offset amount) of the second boom 100*b* is provided as means for detecting status variables with regard to the position and posture of the front attachment 1*c,* in addition to the angle sensors 8*a,* 8*b,* 8*c* in the first embodiment and the inclination angle sensor 8*d*. A detection signal from the angle sensor 107 is also input to, for example, the front posture calculator 9*b* in the control unit 9 shown in FIG. 4 for modifying the boom length (i.e., the distance from a base end of the first boom 100*a* to a distal end of the second boom 100*b*). Thus, the present invention can be applied to the offset type hydraulic excavator as with the first to eighth embodiments.

Figure 42:
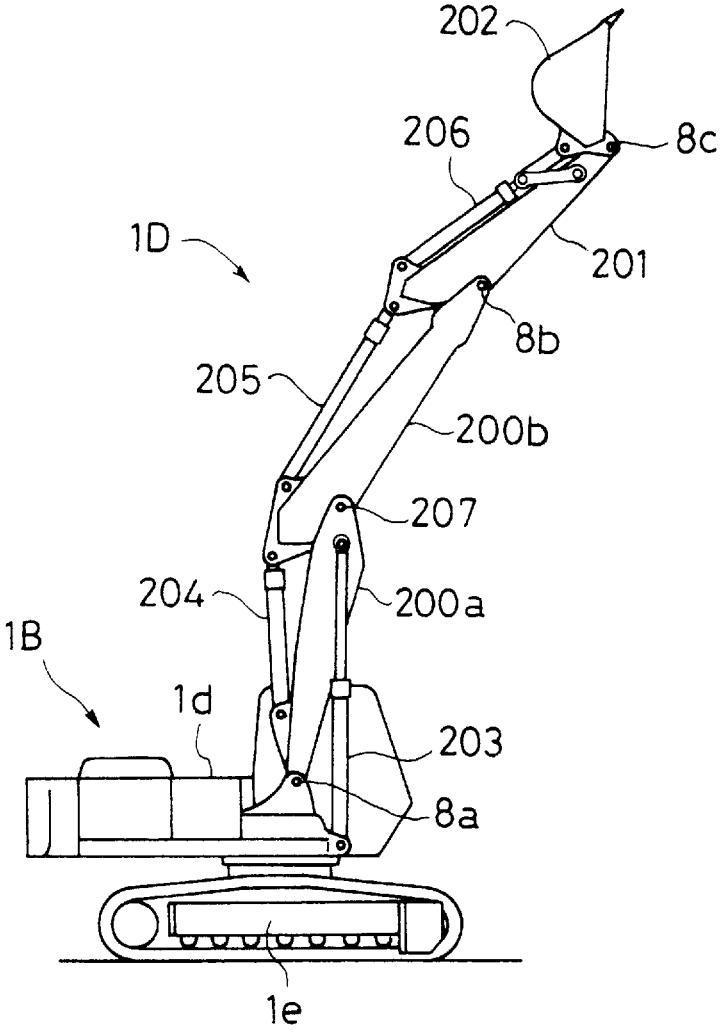
FIG. 42 s a side showing a two-piece beam type hydraulic excavator to which the present invention is applied, as still another embodiment of the present invention.

FIG. 42 shows a two-piece boom type hydraulic excavator in which a boom is divided into two parts. This hydraulic excavator includes a multi-articulated front attachment 1D comprising a first boom 200*a,* a second boom 200*b,* an arm 201 and a bucket 202. The first boom 100*a,* the second boom 200*b,* the arm 201 and the bucket 202 are driven respectively by a first boom cylinder 203, a second boom cylinder 204, an arm cylinder 205 and a bucket cylinder 206. In such a hydraulic excavator, an angle sensor 207 for detecting a rotational angle of the second boom 200*b* is provided as means for detecting status variables with regard to the position and posture of the front attachment 1*c,* in addition to the angle sensors 8*a,* 8*b,* 8*c* in the first embodiment and the inclination angle sensor 8*d*. A detection signal from the angle sensor 207 is also input to, for example, the front posture calculator 9*b* in the control unit 9 shown in FIG. 4 for modifying the boom length (i.e., the distance from a base end of the first boom 200*a* to a distal end of the second boom 200*b*). Thus, the present invention can be applied to the two-piece beam type hydraulic excavator as with the first to eighth embodiments.

In the foregoing embodiments, the predetermined location of the front attachment has been described as the end of the bucket. However, from the viewpoint of implementing the present invention in a simpler way, a pin at the arm tip end may be set to the predetermined location. Further, when the excavation region is set for the purpose of preventing interference between the front attachment and any other part, the pre determined location may be set at other suitable location where the interference would occur.

While the hydraulic drive system to which the present invention is applied has been described as a closed center system including the flow control valves 15*a* to 15*f* of closed center type, the present invention is also applicable to an open center system including flow control valves of open center type.

The relationships between the distance from the bucket end to the boundary of the set region and the deceleration vector and the restoration vector are not restricted to the relationships employed in the foregoing embodiments, but may be set in various ways.

The foregoing embodiments are arranged such that when the bucket end is away from the boundary of the set region, the target speed vector is output as it is. But in such a condition, the target speed vector may also be modified for any other purpose.

While the vector component of the target speed vector in the direction toward the boundary of the set region has been described as a vector component vertical to the boundary of the set region, it may be deviated from the vertical direction so long as the bucket end can be moved in the direction along the boundary of the set region.

While the second and third embodiments have been described as applying the present invention to the hydraulic excavator having the control lever units of hydraulic pilot type, similar advantages can also be provided in the case of a hydraulic excavator having electric lever units. When the present invention is applied to a hydraulic excavator having electric lever units, the pilot pressure sensors can be dispensed with.

In the embodiments, e.g., the first embodiment, wherein the present invention is applied to the hydraulic excavator having the control lever units of hydraulic pilot type, the proportional solenoid valves 10*a,* 10*b,* 11*a,* 11*b* are employed as the electro-hydraulic converting means and the pressure reducing means. However, the proportional solenoid valves may be replaced by any other suitable electro-hydraulic converting means.

Further, while the control lever units 14*a* to 14*f* and the flow control valves 15*a* to 15*f* have all been described as being of hydraulic pilot type, it is only required that at least the control lever units 14*a,* 14*b* and the flow control valves 15*a,* 15*b* for the boom and the arm are of hydraulic pilot type.

INDUSTRIAL APPLICABILITY

According to the present invention, since the movement of the front attachment in the direction toward the boundary of the set region is slowed down when it comes closer to the set region, the excavation within a limited region can efficiently be implemented.

According to the present invention, since the front attachment is controlled to return when it enters the set region, the excavation within a limited region can precisely be implemented even if the front attachment is moved fast, resulting in improved efficiency. Further, since the deceleration control is performed beforehand, the excavation within a limited region can smoothly be implemented even if the front attachment is moved fast.

According to the present invention, when the front attachment is away from the set region, the excavation can be implemented in a like manner to normal work.

According to the present invention, since the manipulation means of hydraulic pilot type are controlled so as to establish respective target pilot pressures, the function of efficiently implementing the excavation within a limited region can be added to any system including the manipulation means of hydraulic pilot type.

When the hydraulic drive system includes boom manipulation means and arm manipulation means of a hydraulic excavator as the manipulation means corresponding to the front members, digging work along the boundary of the set region can be implemented by using just one arm control lever.

According to the present invention, since the working speed can be set in accordance with the mode selected by mode switching means, it is possible to select the finishing work with great weight imposed on accuracy and the working speed. Accordingly, the work mode can optionally be set depending on the kind of work such that the bucket end is slowly moved when a high degree of finish accuracy is required, and it is moved fast when finish accuracy is not so required, but the working speed is important. As a result, working efficiency can be improved.

According to the present invention, the moving speed of the bucket end along the boundary of the set region is reduced if the distance between the position of a predetermined location of the front attachment and a construction machine body is increased. Therefore, in such a working posture that change in rotational angle of the front attachment is large with respect to the amounts by which the hydraulic actuators for the front members are extended or contracted, as result when the front attachment is located near its maximum reach, control accuracy is improved correspondingly.

According to the present invention, since the inclination angle sensor is provided, the excavation within a limited region can be implemented efficiently and smoothly regardless of any inclination of the body.

According to the present invention, since the angle sensor for detecting the swing angle of the upper structure is provided, the excavation can be implemented efficiently and smoothly while limiting the region where the front attachment is movable, not only in a vertical plane but also in the transverse direction of the body within the swing radius.

According to the present invention, since the sensor for detecting the position and posture of the body is further provided, the excavation can be implemented efficiently and smoothly while limiting the region where the front attachment is movable, not only in a vertical plane but also over any desired range of the ground in all directions.

We claim:

1. A region limiting excavation control system for a construction machine comprising a plurality of driven members including a plurality of front members which make up a multi-articulated type front device and are vertically movable, a plurality of hydraulic actuators for respectively driving said plurality of driven members, a plurality of manipulation means for instructing operation of said plurality of driven members, and a plurality of hydraulic control valves driven in accordance with control signals from said plurality of manipulation means for controlling flow rates of a hydraulic fluid supplied to said plurality of hydraulic actuators, wherein said system further comprises:

region setting means for setting a region where said front device is movable;

first detecting means for detecting status variables with regard to the position and posture of said front device;

first calculating means for calculating the position and posture of said front device based on signals from said first detecting means; and first signal modifying means for, based on the control signals from the manipulation means of said plurality of manipulation means which are associated with particular front members and the values calculated by said first calculating means, modifying the control signals from the manipulation means for said front device so that, when said front device is moved within said set region to approach the boundary of said set region, a moving speed of said front device in the direction toward the boundary of said set region only is reduced from before said front device reaches the boundary of the set region whereby the movement of the front device is gradually changed to a direction along the boundary of said set region, and further said front device is moved in the direction along the boundary of said set region when the front device reaches the boundary of the set region.

2. A region limiting excavation control system for a construction machine according to claim 1, further comprising second signal modifying means for, based on the control signals from the manipulation means for said front attachment so that, when said front attachment is outside said set region, said front attachment is returned to said set region.

3. A region limiting excavation control system for a construction machine according to claim 2, wherein said second signal modifying means comprises: second calculating means for calculating a target speed vector of said front attachment based on the control signals from the manipulation means associated with the particular front members; and fourth calculating means for receiving the values calculated by the first and second calculating means and modifying the target speed vector so that, when said front attachment is outside said set region, said front attachment is returned to said set region.

4. A region limiting excavation control system for a construction machine according to claim 3, wherein said fourth calculating means modifies said target speed vector so that said front attachment is returned to the boundary of said set region, by leaving the vector component of said target speed vector in the direction along the boundary of said set region remained, and changing the vector component of said target speed vector in the direction vertical to the boundary of said set region into a vector component of said target speed vector in the direction toward the boundary of said set region.

5. A region limiting excavation control system for a construction machine according to claim 4, wherein said fourth calculating means gradually reduces said vector component in the direction toward the boundary of said set region as a distance between said front attachment and the boundary of said set region decreases.

6. A region limiting excavation control system for a construction machine according to claim 1, wherein said first signal modifying means comprises:

second calculating means for calculating target speed vector of said front attachment based on the control signals from the manipulation means associated with the particular front members;

third calculating means for receiving the values calculated by said first and second calculating means and modifying said target speed vector such that, when said front attachment is within said set region near the boundary of said set region, a vector component of said target speed vector in the direction along the boundary of said set region remains and a vector component of said target speed vector in the direction toward the boundary of said set region is reduced; and valve control means for driving the associated hydraulic control valves so that said front attachment is moved in accordance with said target speed vector.

7. A region limiting excavation control system for a construction machine according to claim 6, wherein said third calculating means maintains said target speed vector as it is when said front attachment is within said set region but not near the boundary of said set region.

8. A region limiting excavation control system for a construction machine according to claim 6, wherein said third calculating means employs, as the vector component of said target speed vector in the direction toward the boundary of said set region, a vector component vertical to the boundary of said set region.

9. A region limiting excavation control system for a construction machine according to claim 6, wherein said third calculating means reduces the vector component of said target speed vector in the direction toward the boundary of said set region such that an amount of reduction in said vector component is increased as a distance between said front attachment and the boundary of said set region decreases.

10. A region limiting excavation control system for a construction machine according to claim 9, wherein said third calculating means reduces the vector component of said target speed vector in the direction toward the boundary of said set region by adding, to said vector component, a reversed speed vector which is increased as the distance between said front attachment and the boundary of said set region decreases.

11. A region limiting excavation control system for a construction machine according to claim 9, wherein said third calculating means sets the vector component of said target speed vector in the direction toward the boundary of said set region to 0 or a small value when said front attachment reaches the boundary of said set region.

12. A region limiting excavation control system for a construction machine according to claim 9, wherein said third calculating means reduces the vector component of said target speed vector in the direction toward the boundary of said set region by multiplying said vector component by a coefficient which is not larger than 1 and is gradually reduced as the distance between said front attachment and the boundary of said set region decreases.

13. A region limiting excavation control system for a construction machine according to claim 6, wherein said third calculating means maintains said target speed vector as it is when said front attachment is within said set region and said target speed vector is a speed vector in the direction away from the boundary of said set region, and modifies said target speed vector so that the vector component of said target speed vector in the direction toward the boundary of said set region is reduced depending on the distance between said front attachment and the boundary of said set region decreases, when said front attachment is within said set region and said target speed vector is a speed vector in the direction toward the boundary of said set region.

14. A region limiting excavation control system for a construction machine according to claim 6, wherein, of said plurality of manipulation means, at least the manipulation means associated with particular front members are of a hydraulic pilot type, outputting pilot pressures as said control signals, and a manipulation system including said manipulation means of hydraulic pilot type drives the corresponding hydraulic control valves, said control system further comprising second detecting means for detecting input amounts from said manipulation means of hydraulic pilot type; said second calculating means being means for calculating the target speed vector of said front attachment based on signals from said second detecting means; and said valve control means including fifth calculating means for calculating target pilot pressures for driving the corresponding hydraulic control valves based on said modified target speed vector, and pilot control means for controlling said manipulation system so that the calculated target pilot pressures are established.

15. A region limiting excavation control system for a construction machine according to claim 14, wherein said second detecting means comprises pressure sensors disposed in the pilot lines of said manipulation system.

16. A region limiting excavation control system or a construction machine according to claim 14, wherein said manipulation system includes a first pilot line for introducing a pilot pressure to the corresponding hydraulic control valve so that said front attachment is moved away from said set region, said fifth calculating means includes means for calculating the target pilot pressure in said first pilot line based on said modified target speed vector, and said pilot control means includes means for outputting a first electric signal corresponding to said target pilot pressure, electro-hydraulic converting means for converting said first electric signal into a hydraulic pressure and outputting a control pressure corresponding to said target pilot pressure, and higher pressure selecting means for selecting a higher one of the pilot pressure in said first pilot line and the control pressure output from said electro-hydraulic converting means, and introducing the selected pressure to the corresponding hydraulic control valve.

17. A region limiting excavation control system for a construction machine according to claim 16, wherein said particular front members include a boom and an arm of a hydraulic excavator, and said first pilot line is a boom-up side pilot line.

18. A region limiting excavation control system for a construction machine according to claim 14, wherein said manipulation system includes second pilot lines for introducing pilot pressures to the corresponding hydraulic control valves so that said front attachment is moved toward said set region, said fifth calculating means includes means for calculating the target pilot pressures in said second pilot lines based on said modified target speed vector, and said pilot control means includes means for outputting second electric signals corresponding to said target pilot pressures and pressure reducing means disposed in the second pilot lines and operated in accordance with said second electric signals for reducing the pilot pressures in said second pilot lines to said target pilot pressures.

19. A region limiting excavation control system for a construction machine according to claim 18, wherein said particular front members include a boom and an arm of a hydraulic excavator, and said second pilot lines are boom-down and arm-crowd side pilot lines.

20. A region limiting excavation control system for a construction machine according to claim 18, wherein said particular front members include a boom and an arm of a hydraulic excavator, and said second pilot lines are boom-down, arm-crowd and arm-dump side pilot lines.

21. A region limiting excavation control system for a construction machine according to claim 14, wherein said manipulation system includes a first pilot line for introducing a pilot pressure to the corresponding hydraulic control valve so that said front attachment is moved away from said set region, and second pilot lines for introducing pilot pressures to the corresponding hydraulic control valves so that said front attachment is moved toward said set region, said fifth calculating means includes means for calculating the target pilot pressures in said first and second pilot lines based on said modified target speed vector, and said pilot control means includes means for outputting first and second electric signals corresponding to said target pilot pressures, electro-hydraulic converting means for converting said first electric signal into a hydraulic pressure and outputting a control pressure corresponding to said target pilot pressure, higher pressure selecting means for selecting a higher one of the pilot pressure in said first pilot line and the control pressure output from said electro-hydraulic converting means and introducing the selected pressure to the corresponding hydraulic control valve, and pressure reducing means disposed in the second pilot lines and operated in accordance with said second electric signals for reducing the pilot pressures in said second pilot lines to said target pilot pressures.

22. A region limiting excavation control system for a construction machine according to claim 21, wherein said particular front members include a boom and an arm of a hydraulic excavator, and said first pilot line is a boom-up side pilot line.

23. A region limiting excavation control system for a construction machine according to claim 21, wherein said particular front members include a boom and an arm of a hydraulic excavator, and said second pilot lines are boom-down and arm-crowd side pilot lines.

24. A region limiting excavation control system for a construction machine according to claim 21, wherein said particular front members include a boom and an arm of a hydraulic excavator, and said second pilot lines are boom-down, arm-crowd and arm-dump side pilot lines.

25. A region limiting excavation control system for a construction machine according to claim 1, further comprising mode switching means capable of selecting any of plural work modes including a normal mode and a finish mode, wherein said first signal modifying means receives a selection signal from said mode switching means (20), and modifies the control signals from said manipulation means so that when said front attachment is within said set region near the boundary of said set region, the moving speed of said front attachment in the direction toward the boundary of said set region is reduced, and further when said mode switching means selects the finish mode, the moving speed of said front attachment in the direction along the boundary of said set region becomes smaller than in the case of selecting the normal mode.

26. A region limiting excavation control system for a construction machine according to claim 1, wherein said first signal modifying means recognizes a distance between the position of a particular location of said front attachment and a construction machine body based on the value calculated by said first calculating means, and modifies the control signals from said manipulation means so that when said front attachment is within said set region near the boundary of said set region, the moving speed of said front attachment in the direction toward the boundary of said set region is reduced, and further if said distance (X) becomes large, the moving speed of said front attachment in the direction along the boundary of said set region is also reduced.

27. A region limiting excavation control system for a construction machine according to claim 1, wherein said first detecting means includes a plurality of angle sensors for detecting rotational angles of said plurality of front members.

28. A region limiting excavation control system for a construction machine according to claim 1, wherein said first detecting means includes a plurality of displacement sensors for detecting strokes of said plurality of actuators.

29. A region limiting excavation control system for a construction machine according to claim 1, wherein said first detecting means includes an inclination angle sensor for detecting an inclination angle of a body of said construction machine.

30. A region limiting excavation control system for a construction machine according to claim 1, wherein said plurality of driven members further include an undercarriage and an upper structure mounted on said undercarriage in a horizontally swingable manner and supporting a base end of said front attachment in a vertically rotatable manner, and said first detecting means includes a swing angle sensor for detecting a swing angle of said upper structure.

31. A region limiting excavation control system for a construction machine according to claim 1, wherein said first detecting means includes a position/posture sensor for detecting the position and posture of the body of said construction machine.

32. A region limiting excavation control system for a construction machine according to claim 1, wherein said particular front members include a boom and an arm of a hydraulic excavator.

33. A region limiting excavation control system for a construction machine according to claim 1, wherein said particular front members include an offset boom and an arm of an offset type hydraulic excavator.

34. A region limiting excavation control system for a construction machine according to claim 1, wherein said particular front members include first and second booms and an arm of a two-piece boom type hydraulic excavator.

* * * * *